US007207141B2

(12) United States Patent
Sullivan

(10) Patent No.: US 7,207,141 B2
(45) Date of Patent: Apr. 24, 2007

(54) SLIDING DOOR INSERT FOR PORTABLE PET PORTAL

(75) Inventor: Thomas D. Sullivan, Hamilton, NJ (US)

(73) Assignee: Accession, Inc., Hamilton, NJ (US)

( * ) Notice: Subject to any disclaimer, the term of this patent is extended or adjusted under 35 U.S.C. 154(b) by 294 days.

(21) Appl. No.: 10/938,839

(22) Filed: Sep. 10, 2004

(65) Prior Publication Data

US 2006/0053693 A1 Mar. 16, 2006

(51) Int. Cl.

| | |
|---|---|
| ***E05D 15/48*** | (2006.01) |
| ***E05D 15/00*** | (2006.01) |
| ***E06B 3/50*** | (2006.01) |
| ***E06B 3/70*** | (2006.01) |
| ***E05C 19/18*** | (2006.01) |

(52) U.S. Cl. ..... 49/169; 49/168; 49/234; 52/455; 52/457; 160/205; 292/288

(58) Field of Classification Search ..... 49/169, 49/176, 149, 449, 450, 226, 232, 234; 52/204.51, 52/455, 457, 458; 160/180, 116, 205; 292/288, 292/289, 293, 259 R, DIG. 46, DIG. 15
See application file for complete search history.

(56) References Cited

U.S. PATENT DOCUMENTS

| | | | | |
|---|---|---|---|---|
| 3,184,803 | A * | 5/1965 | Peel | 49/388 |
| 3,420,001 | A * | 1/1969 | Raymon | 49/407 |
| 3,471,189 | A * | 10/1969 | Ness | 292/266 |
| 3,654,733 | A | 4/1972 | Blackwell | 49/168 |
| 3,811,224 | A * | 5/1974 | Garrison | 49/168 |
| 3,816,967 | A * | 6/1974 | Littrell | 49/449 |
| 3,878,645 | A | 4/1975 | Porter | 49/169 |
| 4,047,331 | A * | 9/1977 | Davlantes | 49/171 |
| 4,322,913 | A | 4/1982 | Himmer | 49/168 |
| 4,408,416 | A | 10/1983 | Davlantes | 49/168 |
| 4,776,133 | A * | 10/1988 | Green | 49/394 |
| 4,927,198 | A * | 5/1990 | Fennell et al. | 292/306 |
| 5,185,954 | A * | 2/1993 | Waddle, Sr. | 49/168 |
| 5,269,097 | A | 12/1993 | Davlantes | 49/169 |
| 5,287,654 | A | 2/1994 | Davlantes | 49/169 |
| 5,946,855 | A | 9/1999 | Miconi | 49/163 |
| 6,272,793 | B1 | 8/2001 | Davlantes | 49/168 |
| 7,063,123 | B2 * | 6/2006 | Lethers | 160/180 |

* cited by examiner

*Primary Examiner*—Jerry Redman
*Assistant Examiner*—Andrea L. Coulter
(74) *Attorney, Agent, or Firm*—Watov & Kipnes, P.C.; Kenneth Watov

(57) ABSTRACT

A portable pet portal insert for a sliding patio door includes separate top, center, and bottom modules that can be assembled together through use of tongue and groove fittings therebetween, with the bottom module having a cutout portion adapted for receiving a pet portal, the pet portal including a pivotal flap, a cam operated lock for preventing movement of the flap away from an associated frame, and a weather seal mechanism.

50 Claims, 70 Drawing Sheets

SLIDING DOOR INSERT FOR PORTABLE PET PORTAL

BACKGROUND OF THE INVENTION

Pet access doors provide an opening, usually equipped with a swinging flap, through which pets can leave or enter a home or other building. The pet access door may be set in a frame for installation in a wall or solid core door. In order to allow a means of passage for a pet through a sliding glass patio door, the door must be left ajar by sliding the moveable glass door away from the patio door frame. The majority of pet access doors manufactured for sliding glass patio doors consist of a rectangular panel designed to fill the opening created when the sliding glass patio door is ajar. A pet portal is inserted into the rectangular panel providing a means of egress and ingress for the pet. Generally sliding glass patio door pet access doors are constructed of a glass panel in the upper portion and a swinging flap pet portal in the lowermost portion encased in an aluminum frame.

A number of undesirable attributes are associated with the current art involving sliding glass patio door pet access doors. The majority of pet access doors manufactured for sliding glass patio doors require permanent of semi-permanent installations while others may require modification of one or more components of the existing sliding glass patio door to facilitate installation of the pet access door.

Current art limits the size of the pet access door to the specifications determined at the time of manufacture and cannot be modified in the field. Therefore, once purchased and installed the sliding glass patio door pet access door may be too large for young pets or become too small for pets as they grow or may not be suitable for subsequent pet needs.

The aluminum framed glass panel and swinging flap pet portal construction of the majority of sliding glass patio door pet access doors results in poor insulation quality and limits privacy when in use. Generally, the aluminum frame of the pet access door is designed to abut the moveable sliding door and the patio door frame. This configuration relies on a self stick soft rubber weather strip and the method and level of pressure applied to hold the moveable sliding glass patio door against the pet access door and the patio door frame. The integral height adjustable insert at the uppermost portion of the pet access door and the swinging flap pet port in the lowermost portion of the pet access door are also prone to air infiltration. Furthermore, the barrier to heat loss or gain through the single pain of glass in most pet access doors is inferior to most insulated double or triple pain sliding glass patio doors. When in use the sliding glass patio door curtains, drapes, vertical blinds or other privacy covering must be left open to permit the pet access to the pet portal. Leaving the sliding glass patio door coverings open in this manner may result in a loss of privacy.

Storage and transport of most sliding glass patio door pet access doors is costly and inconvenient. The majority of sliding glass patio door pet access doors are of a one piece glass and aluminum frame construction and roughly equivalent in length to the height of a sliding glass patio door opening. The size of the pet access door makes storage difficult and limits the method of transportation resulting in excessive transportation costs.

The purpose of the invention, therefore, is to provide a sliding glass patio door pet access door that, requires no modification to existing sliding glass patio door to install, can be modified in the field to grow with a pet, offers optimal insulation quality and privacy and facilitate transportation and storage capability.

SUMMARY OF THE INVENTION

The invention provides a modular component pet access door designed for use in sliding glass patio doors. The modular construction permits the apparatus to be packaged and stored in a portable compact container when in a disassembled state. The compact size of the disassembled unit minimizes storage space requirements while facilitating transportation opportunities by the retailer and consumer. Top, bottom and center modules of the apparatus are insulation filled injection and/or injection blow molded polymer components offering an insulation value and privacy superior to existing art. The pet portal assembly is designed with a tapered flap and floating magnetic weather seal offering a barrier to air infiltration superior to magnetic flap closures on most sliding glass patio door pet access doors. Furthermore, pet portal assembly permits the portal flap to be lowered into a channel formed by the interior and exterior frame components to create an effective flap lock with the turn of a knob. Modular construction and the design of components permit the invention to be changed in the field to accommodate a variety of styles and sizes of sliding glass patio doors. The universal nature of the modular construction and component system enhances the portability of the apparatus and permits the pet access door to be adjusted in the field to accommodate a growing pet or a new pet.

The invention requires no tools to install nor does it require modification to any component of an existing sliding glass patio door. The apparatus is modular in construction consisting primarily of five pre-assembled components. When assembled the modules and components create a sliding glass patio door pet access door panel. The five components are interlocked through a tongue and groove system molded into the modules and components. A tongue molded into the top and bottom of the uppermost and lower most modules slide into grooves molded into the top and bottom of the center module, the bottom of the top weather seal and the top of the bottom weather seal.

In the preferred embodiment the center module of the pet access door panel is provided with a universal locking system installed and the bottom module with a pet portal assembly installed. The universal locking system permits the sliding glass patio door locking components to be used in conjunction with the invention installed when opening or closing the moveable sliding glass door.

In another embodiment, the invention is provided without a universal locking system installed in the center module of the pet access door panel. In this embodiment the drop lock security lock component of the invention is used in place of the sliding glass door locking components with the invention installed when opening or closing the moveable sliding glass door.

In another embodiment, the invention is provided without a universal locking system installed in the center module of the pet access door panel and the bottom module is provided as a blank panel without the pet portal assembly installed. In this embodiment, the drop lock security lock component of the invention is used in place of the sliding glass door locking components with the invention installed when opening or closing the moveable sliding glass door. The bottom module is provided as a blank panel and designed to permit the consumer to install other commercially available pet portals.

The invention is designed to be assembled in the field by the consumer. The five primary modules and components slide together forming a rigid panel with a height adjustable weather seal in the uppermost portion of the assembled panel. Once assembled the panel may be installed and removed as one piece. The leading edge of the panel is designed to fit into the moveable sliding door side of the patio door frame to create a secure fit and effective weather seal. The trailing edge of the assembled panel forms a channel designed to receive the leading edge of the moveable sliding patio door similar to the patio door frame creating a secure fit and effective weather seal. When raised to an upright position, inserted into the patio door upper track and dropped into the patio door lower track the assembled panel fills and seals the opening necessary for the pet portal. After installation of the assembled panel into the sliding glass patio door the drop lock security lock component of the invention is installed between the trailing edge of the moveable sliding glass door and the patio door frame abutting the fixed glass door. The drop lock component of the invention serves as a secondary security lock in the preferred embodiment and as a primary locking system in another embodiment. The drop lock handle is conveniently located allowing the handle bar to be lifted from a locked position into a stored unlocked position. In so doing, the moveable sliding glass patio door may be opened to permit standard use of the patio door or to facilitate installation and removal of the pet access door assembled panel.

BRIEF DESCRIPTION OF THE DRAWINGS

The present embodiments of the invention are described in detail below with reference to the drawings, in which like items are identified by the same reference designation, wherein;

FIG. 49I is a partial cross sectional front view of the bottom module subassembly with pet portal assembly installed taken along line 49I—49I of FIG. 49C, illustrating the function of the floating magnetic weather seal with the pet portal flap in a closed position.

FIG. 59C is a bottom plan view of the ramp or platform resting board.

FIG. 59D is a back side elevational view of the ramp or platform resting board.

FIG. 59E is a front elevational view of the ramp or platform resting board.

FIG. 60A is an exploded assembly view of a partial left side elevational view of the pet access door panel bottom module and left side elevational view of the bottom module weather seal shown with a left side elevational view of the drop lock security lock unattached.

FIG. 60B is a partial left side elevational view of the pet access door panel bottom module and left side elevational view of the bottom module weather seal shown with a partial left side elevational view of the drop lock security lock attached and in a lowered position.

FIG. 60C is a partial left side elevational view of the pet access door panel bottom module and left side elevational view of the bottom module weather seal shown with a partial left side elevational view of the drop lock security lock attached and in a partially raised position.

FIG. 60D is an exterior elevational view of a sliding glass patio door with the pet access door panel installed showing a step down to the exterior ground surface.

FIG. 60E is an exterior elevational view of a sliding glass patio door with the pet access door panel installed and the ramp or platform resting board attached and in a lowered position.

FIG. 60F is an exterior elevational view of a sliding glass patio door with the pet access door panel installed and the ramp or platform resting board attached and in a partially raised position.

FIG. 60G is an exterior elevational view of a sliding glass patio door with the pet access door panel installed and the ramp or platform resting board attached and in a fully raised position.

DETAILED DESCRIPTION OF THE INVENTION

Figure 1:
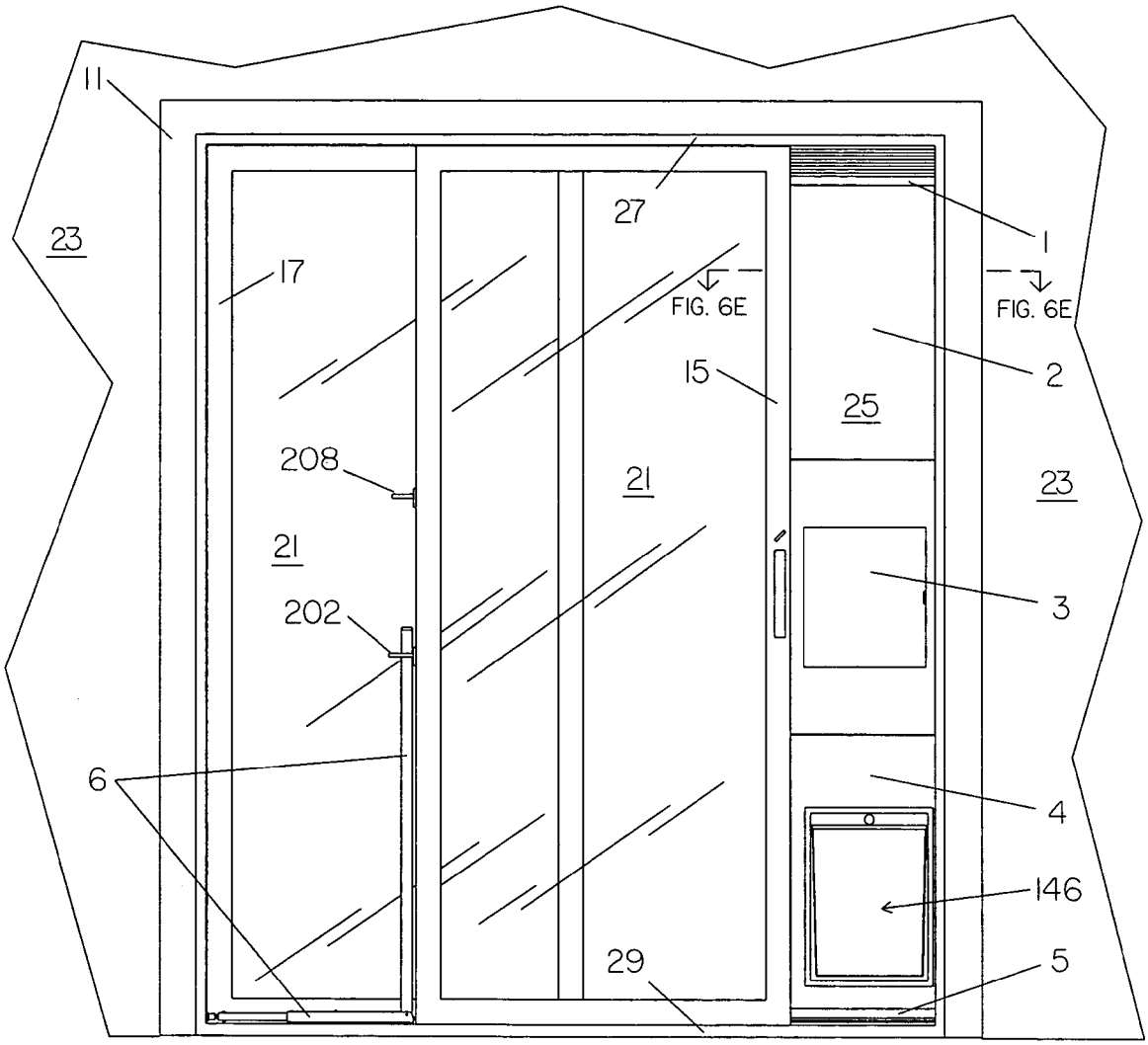
FIG. 1 is a front or interior elevational view of the pet access door installed in a sliding glass patio door with the moveable sliding door in a closed position, providing partial access through the sliding glass door when the moveable sliding door is moved to an open position, for various embodiments of the invention.
Figure 2:
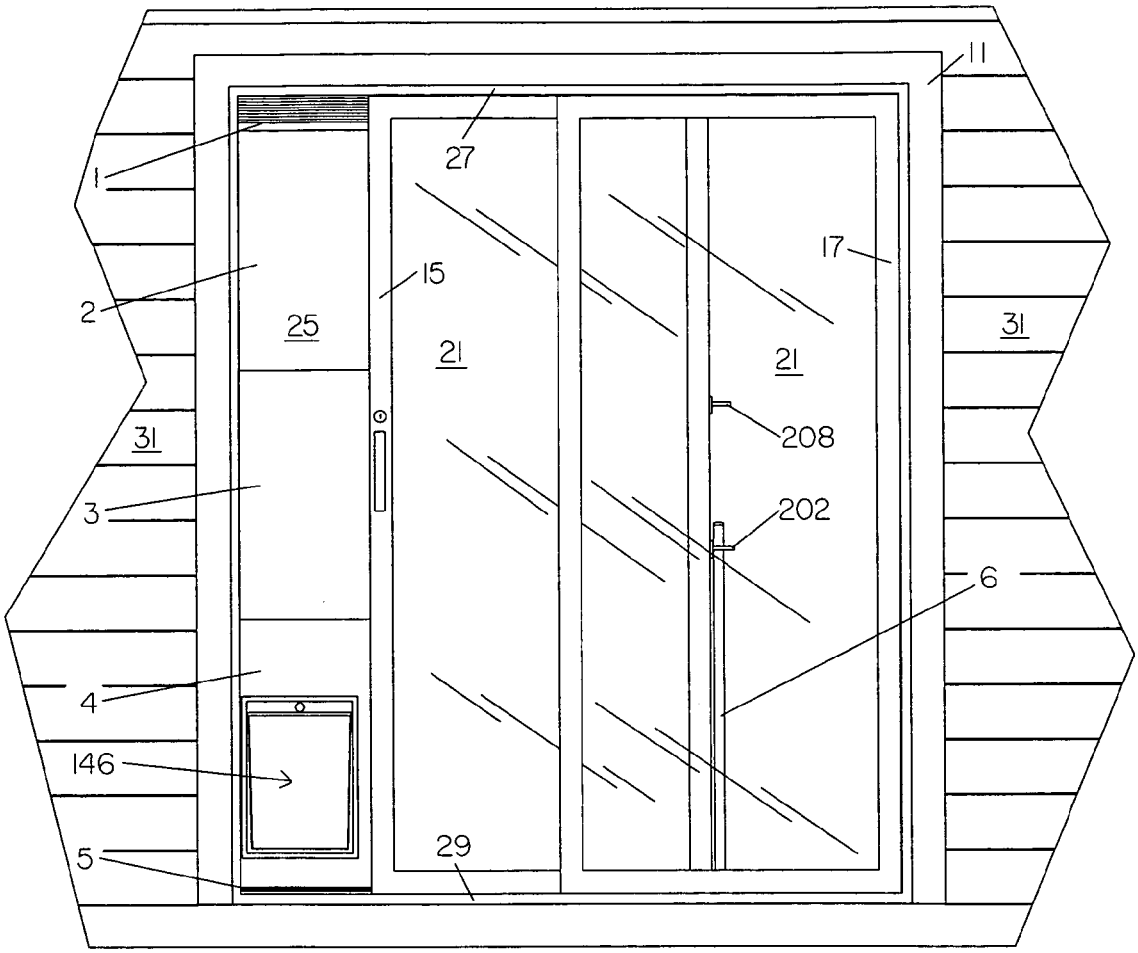
FIG. 2 is a back or exterior elevational view of the pet access door installed in a sliding glass patio door with the moveable sliding door in a closed position, providing partial access through the sliding glass door when the moveable sliding door is moved to an open position.

As shown in FIGS. 1–3, the preferred embodiment of the invention, pet door panel 25, is installed between the sliding door frame 11, and the leading side of frame 15 on movable sliding door 21, to provide a means of ingress and egress for a pet. Drop lock security lock 6 is installed on the interior side of stationary sliding door 21, between sliding door frame 11, and the trailing side of frame 15 on movable sliding door 21, to secure pet door panel 25 between sliding door frame 11 and the leading side of frame 15 on movable siding door 21, to prevent movable sliding door 21 from being opened with pet door panel 25 installed. Sliding door frame 11 is typically secured to a building structure 23, such as a home or office. For illustrative purposes all elevational views, except as noted, depict the sliding glass patio door in a right opening configuration. Therefore, when describing various elements of the invention reference made to right and left side views pertains to installation of the invention in a right opening sliding glass door configuration. However, since the invention may be installed in either a right or left opening sliding glass patio door configuration the term left or right is relative, therefore, the terms leading, trailing, interior and exterior are used in combination or in place of the terms right and left side and front and back views where referenced.

The sliding door frame 11 has a lower track portion 29 and an upper track portion 27. The lower track portion 29 slideably receives at least one sliding door member 21 therein. A complimentary upper track portion 27 is typically positioned on the upper side of the siding glass door frame 11, in alignment with the lower track portion 29, enabling the sliding door member 21 to be slideably moved between open and closed positions within the sliding door frame 11.

Figure 3A:
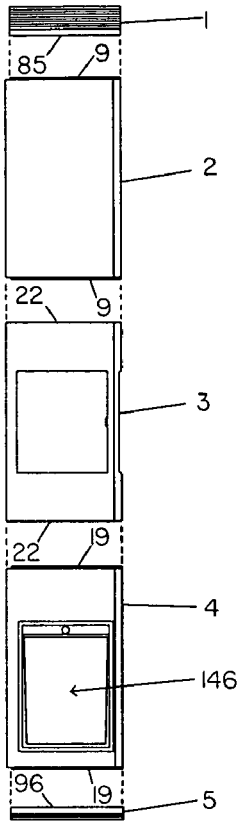
FIGS. 3A–3C show front elevational assembly views of the five primary modules and components comprising the pet access door panel, and illustrate how the modules and components slide together to assemble the pet access door.
Figure 3B:
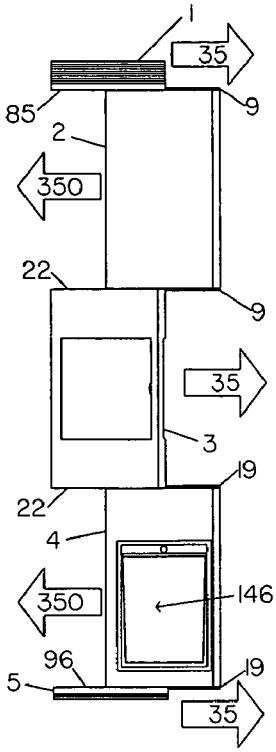

The preferred embodiment of the invention consists of a pet door panel 25 with pet portal 146, drop lock security lock 6 with locking bracket 202, and storage bracket 208. As shown in FIG. 3A, pet door panel 25 is an assembly consisting of five primary components; top module weather seal 1, top module 2, center module 3, bottom module 4 with pet portal 146 and bottom module weather seal 5. Top module weather seal 1, top module 2, center module 3, bottom module 4 with pet portal 146, and bottom module weather seal 5 are slideably attached to one another for assembly, disassembly, or replacement, as shown in FIG. 3B, via an interlocking tongue and groove system integral to each component. More particularly, interlocking groove 85, located in the lowermost portion of top module weather seal 1, is slideably attached to interlocking tongue 9 located on the uppermost portion of top module 2, as indicated by directional arrow(s) 35 and/or 350. Interlocking tongue 9, located on the lowermost portion of top module 2, is slideably attached to interlocking groove 22 located on the uppermost portion of center module 3, as indicated by directional arrows 35 and/or 350. Interlocking groove 22 located in the lowermost portion of center module 3 is slideably attached to interlocking tongue 19 located in the uppermost portion of bottom module 4 as indicated by directional arrows 35 and/or 350. Interlocking tongue 19 located in the lowermost portion of bottom module 4 is slideably attached to interlocking groove 96 located in the uppermost portion of bottom module weather seal 5 as indicated by directional arrows 35 and/or 350.

Figure 3C:
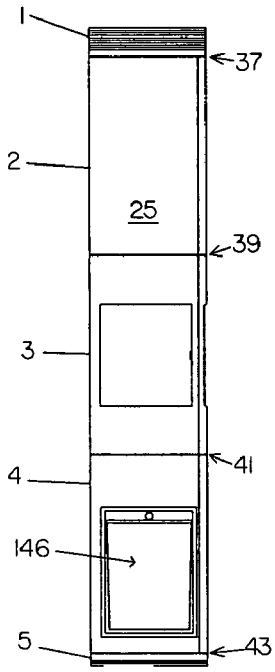

FIG. 3C shows assembled pet door panel 25 with pet portal 146. Top module weather seal 1 is attached to top module 2 at seam 37, top module 2 is attached to center module 3 at seam 39, center module 3 with pet portal 146 is attached to bottom module 4 at seam 41, and bottom module 4 with pet portal 146 is attached to bottom module weather seal 5 at seam 43.

Figure 3D:
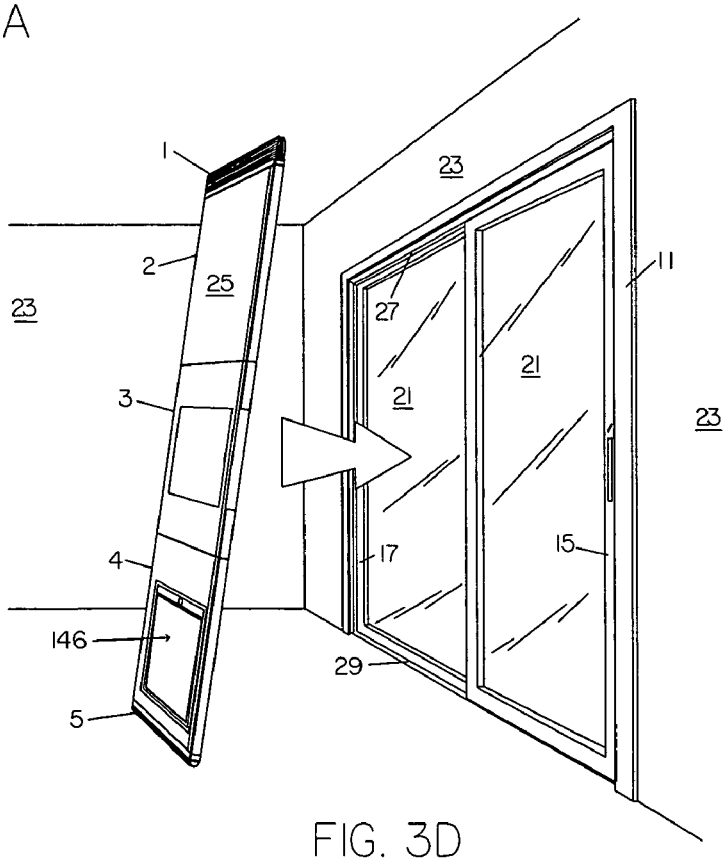
FIG. 3D is a perspective view illustrating the initiation of installation of the pet access door into a sliding glass patio door.
Figure 3E:
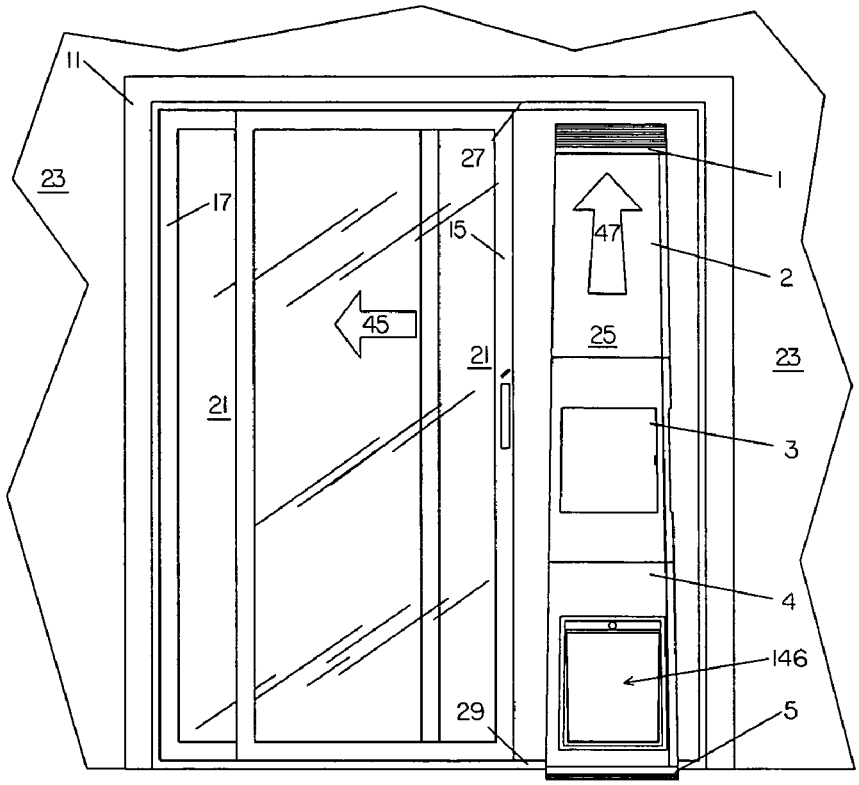
FIG. 3E is a partial perspective and elevational view illustrating a step in the installation of the pet access door into a sliding glass patio door.
Figure 3F:
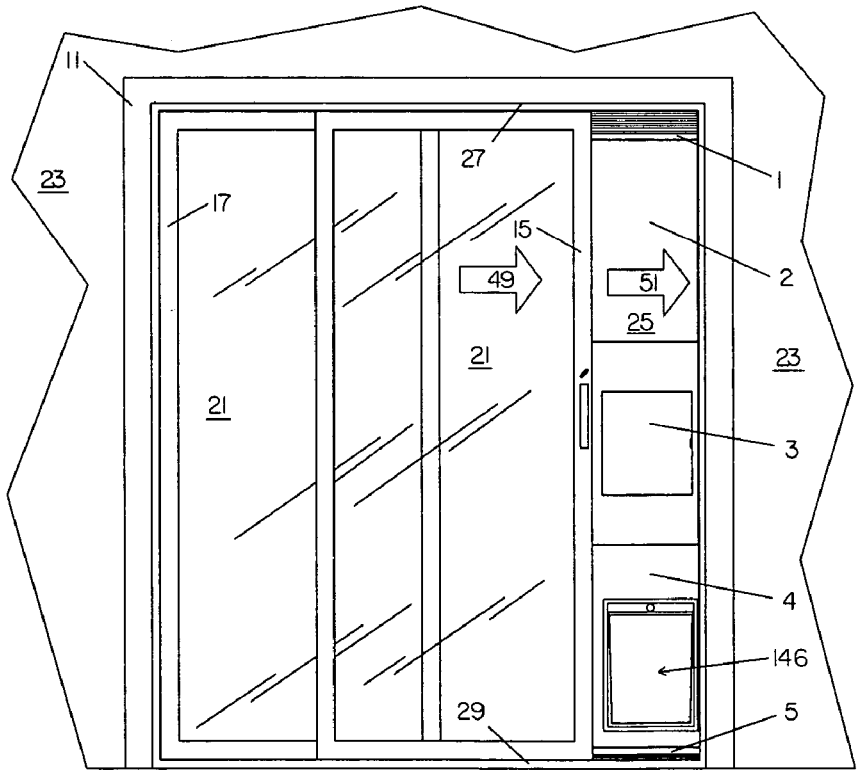
FIG. 3F is an elevational view illustrating a step in the installation of the pet access door into a sliding glass patio door.

FIGS. 3D–3F show installation of the assembled pet door panel 25 with pet portal 146 into an existing sliding glass door assembly. Although assembled pet door panel 25 may be assembled in place within sliding door frame 11, the preferred method of assembly is accomplished on a flat surface such as a floor or table top. When assembled outside of sliding door frame 11, the inventive assembled pet door panel 25 is brought to sliding door frame 11 as shown in FIG. 3D. FIG. 3E shows movable sliding glass door 21 being pulled away from sliding door frame 11 to open movable sliding glass door 21 as indicated by directional arrow 45, to permit pet door panel 25 to be installed. The top module weather seal 1 component located on the uppermost portion of assembled pet door panel 25 is lifted up into a recess of upper track portion 27 of sliding door frame 11, as shown in by directional arrow 47, and then rotated into alignment with the upper track portion 27 and a recess of lower track portion 29 of sliding door frame 11. As shown is FIGS. 17–18 and described in detail later, the top module weather seal 1 is constructed to allow a spring loaded flexible sleeve to compress in order to fit pet door panel 25 between upper track portion 27 and lower track portion 29 of sliding door frame 11. When in alignment with upper track portion 27 and lower track portion 29 of sliding door frame 11, the bottom module weather seal 5 component located on the lowermost portion of assembled pet door panel 25 is lowered into the recessed lower track portion 29 of sliding door frame 11. As shown in FIG. 3F, after assembled pet door panel 25 is in place in upper track portion 27 and lower track portion 29 of sliding door frame 11, between the leading side of frame 15 on movable sliding glass door 21 and sliding door frame 11, movable sliding glass door 21 is pulled closed against assembled pet door panel 25 as indicated by directional arrow 49. In turn, assembled pet door panel 25 is pulled against sliding door frame 11 as indicated by directional arrow 51 restricting access through movable sliding glass door 21, while providing egress and ingress for pets through pet portal 146. Frame 15 of movable sliding glass door 21 abuts the trailing side of assembled door panel 25 within a channel formed by trailing side weather seal shims 12 or 13 (see FIGS. 6E and 7E) in top module 2 and bottom module 4, and weather seal shims 87 or 89 (see FIGS. 11A–C, and 12A–C) in center module 3, that comprise assembled pet door panel 25, with assembled pet door panel 25 installed and movable sliding glass door 21 in a closed position. When installed, the leading side of assembled pet door panel 25 abuts sliding door frame 11. In the preferred embodiment of the invention, center module 3 contains a universal locking system shown in FIGS. 34–47, described later, that allows the installed assembled pet door panel 25 to lock into sliding door frame 11, and movable glass sliding door 21 to lock into the installed assembled pet door panel 25.

After installation of assembled pet door panel 25 as described above, drop lock security lock 6 is installed between the trailing side of frame 15 on movable sliding glass door 21 and sliding door frame 11, as shown in FIG. 1. Drop lock security lock 6 described later and shown in detail in FIGS. 57–58 consists of an adjustable lower housing assembly that sits in lower track portion 29 of sliding door frame 11 between the trailing side of frame 15 on movable sliding door 21 and sliding door frame 11 with assembled pet door panel 25 installed. Drop lock security lock 6 is attached to the trailing side of frame 15 on movable sliding door 21 by drop lock security lock 6 handlebar 180 (see FIGS. 57C, 57E, and 58A) and locking bracket 202 which is mounted on the trailing side of frame 15 of movable sliding door 21. Drop lock security lock 6 can be installed in any sliding glass door between the trailing side of frame 15 on movable sliding glass door 21 and sliding door frame 11, with or without assembled pet door panel 25 installed to prevent forced entry from the exterior or unintentional opening from the interior of the structure.

In another embodiment of the invention, drop lock security lock 6 is the primary means of locking movable sliding glass door 21 with assembled pet door panel 25 installed. In order to open movable sliding glass door 21, the handlebar 180 is rotated out of a locked position in locking bracket 202 and lifted to storage bracket 208 also located on the trailing side of frame 15 on movable sliding glass door 21. In so doing, the adjustable telescoping housing 188 (see FIGS. 58A–58K) is lifted out of lower track portion 29 of sliding door frame 11 allowing movable sliding glass door 21 to be pulled opened for passage or installation or removal of assembled pet door panel 25.

Top module 2, center module 3, and bottom module 4 are designed to be of an injection molded or injection blow molded polymer construction with a rigid insulation core. This type of construction provides privacy while providing insulation quality superior to prior art. All three modules are designed to fit a variety of sliding glass patio door heights and door thicknesses through an adjustable top module weather seal 1 and left or trailing side and right or leading side weather seal shims 12 or 13, and 8, respectively.

FIGS. 4A–4D are front or interior, top, trailing and leading side views of assembled pet access door top module 2. The back or exterior view of top module 2 is a mirror image of the front or interior view of top module 2 illustrated in FIG. 4A. The bottom view of top module 2 is identical to the top view of module 2 illustrated in FIG. 4B. The front of top module 2 includes an interlocking tongue 9 in the uppermost portion of top module 2, and an identical interlocking tongue 9 located in the lowermost portion of top module 2. Leading side weather seal shim 8 is designed to fill and seal the channel 61 (see FIG. 6E) in the upright portion of sliding door frame 11. Channel 61 is configured to receive leading side frame 15 of movable sliding glass door 21 in thick sliding glass patio door applications, as shown in FIG. 6E. For purposes of example, a thick sliding patio door 21 typically has a leading edge or side thickness of 1¾ inch, whereas a thin sliding patio door 21 typically has a leading edge or side thickness 1½ inch. FIG. 6E is an exploded assembly and partial cross sectional top view of leading side frame 15 of movable sliding glass door 21, top module 2 of pet door panel 25, and upright portion of sliding door frame 11.

Figure 4C:
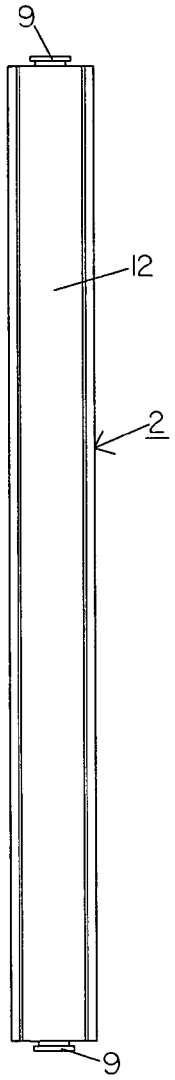
FIGS. 4A, 4C, and 4D are front elevational or interior, left elevational or trailing side, and right elevational or leading side views, respectively, of the top module subassembly with weather seal shims in place.
Figure 4A:
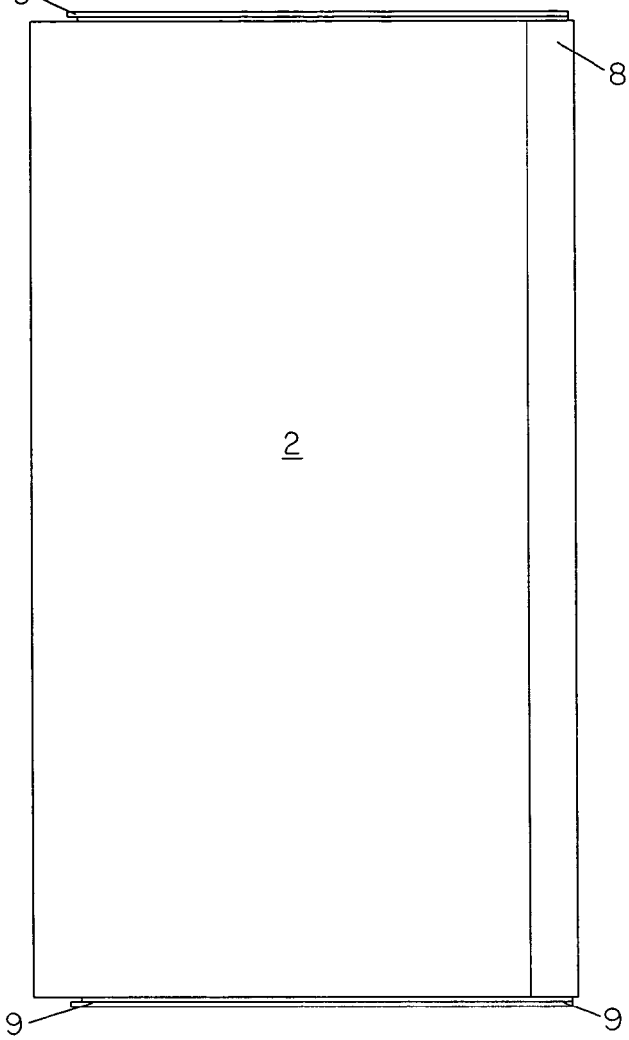
Figure 4D:
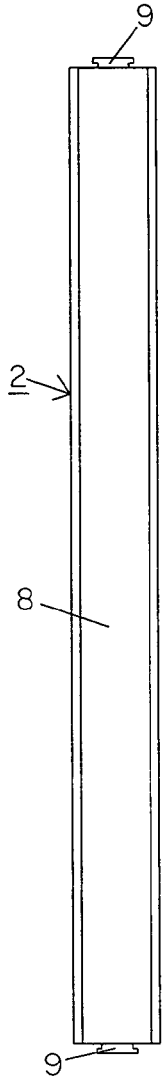

FIG. 4C is a left or trailing side view of module 2, which shows trailing side weather seal shim 12 installed thereon. FIG. 4D is a right or leading side view of top module 2 which shows leading side weather seal shim 8, as installed. Both FIGS. 4C and 4D show trailing and leading side views, respectively, of top module 2 tongue 9 at the uppermost and lowermost portions of top module 2.

Figure 4B:
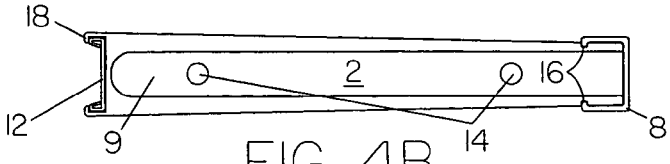
FIG. 4B is a top plan view of the top module subassembly with weather seal shims in place, the bottom plan view being identical thereto.

FIG. 4B is a top view of top module 2, which shows both the leading side 8 and trailing side 12 weather seal shims and top module weather seal 1 spring guide holes 14. Leading weather seal shim 8 is not necessary when used in combination with a thin movable sliding glass door 21 since the leading edge of top module 2 fits into channel 61 as shown in FIG. 7E. Channel 61, for example, typically has a width of 1 13/16 inch for thick siding patio doors 21, and 1 9/16 inch for thin sliding patio doors 21. With the invention configured for a thin sliding glass patio door application, leading side weather seal shim 8 is omitted and trailing side weather seal shim 13 is used in place of trailing side weather seal shim 12 as shown in FIG. 7E.

FIG. 7E is an exploded assembly and partial cross sectional top view of leading side frame 15 of movable sliding glass door 21, top module 2 of assembled pet door panel 25, and an upright portion of sliding door frame 11. As shown in FIG. 4B, weather seal shim 8 is designed to slide or snap into identical retention grooves 16 located on a vertical plane on both the front and back sides adjacent to the right or leading side of top module 2. Trailing side weather seal shim 12 located on the trailing side of top module 2 is contained within retention lips 18, as shown in FIG. 4B, and is designed to accept the leading side frame 15 of movable sliding glass door 21 in thick sliding glass patio door applications.

Figure 6B:
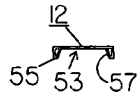
FIG. 6B is a top plan view of the left or trailing side top and bottom module thick patio door weather seal shim, the bottom plan view being identical thereto.
Figure 6C:
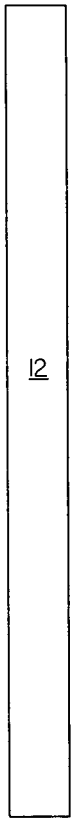
FIGS. 6A, 6C, and 6D are front elevational, back elevational, and right elevational side views, respectively, of the left or trailing side top and bottom module thick patio door weather seal shim, the left elevational side view being identical to the latter.
Figure 6A:
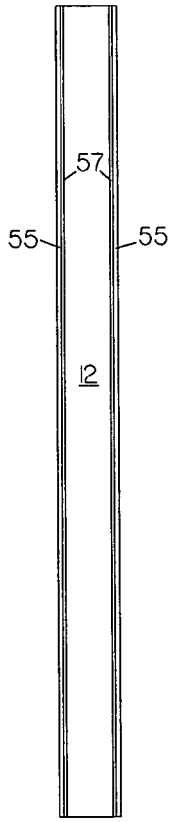
Figure 6D:
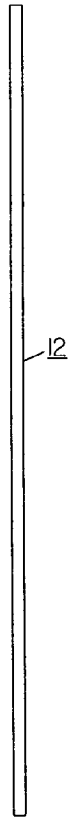
Figure 6E:
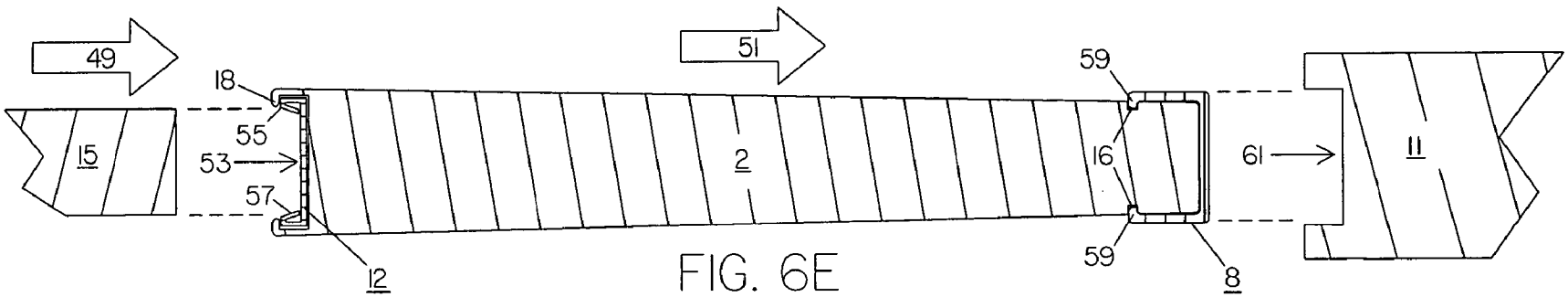
FIG. 6E is a partial cross sectional view taken along 6E—6E of FIG. 1 of the moveable patio door, trailing side weather seal shim, pet access door, leading edge weather seal shim and sliding glass patio door frame, illustrating function of the weather seal shims in a thick patio door configuration.
Figure 7B:
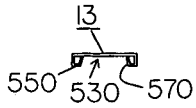
FIG. 7B is a top plan view of the left or trailing side top and bottom module thin patio door weather seal shim, the bottom plan view being identical thereto.
Figure 7C:
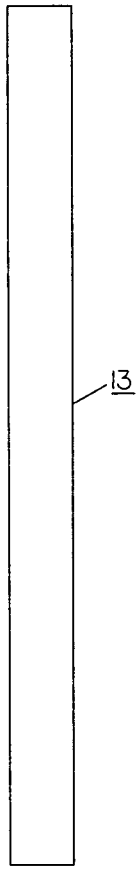
FIGS. 7A, 7C, and 7D are front elevational, back elevational, and right elevational side views, respectively, of the left or trailing side top and bottom module thin patio door weather seal shim, the left elevational side view being identical to the latter.
Figure 7A:
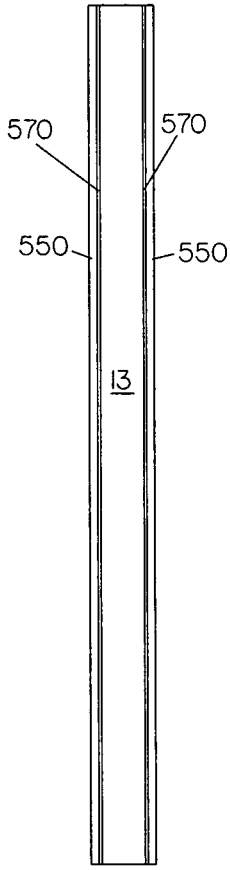

FIGS. 6A–6D show various views, respectively, of thick sliding glass patio door trailing side weather seal shim 12, and FIGS. 7A–7B show various views, respectively, of thin sliding glass patio door trailing side weather seal shim 13. FIGS. 6B and 7B show channels 53 and 530, which are designed to receive frame 15 of movable sliding glass door 21 in a thick sliding glass patio door application. The width of bends running along the vertical axis of trailing side weather seal shim 12 and 13 shown as 55 and 550 in FIGS. 6A, 6B, 6E, 7A, 7B and 7E, respectively, serve as a shim in either thin or thick movable sliding glass door 21 configurations. In FIGS. 6B and 6E vertical axis bends 55 are thin creating a wide channel 53 designed to receive leading side frame 15 of movable sliding glass door 21 in a thick sliding glass door application. Vertical axis bend 550 shown in FIGS. 7B and 7E is wider than bend 55 of shim 12, which narrows channel 530 to receive leading side frame 15 of movable sliding glass door 21 in a thin sliding glass door application. A portion of trailing side weather seal shim 12 and 13 shown as 57 and 570, respectively, in FIGS. 6A, 6B, 7A and 7B is bent inward along a vertical axis to create channel 53, 530, walls designed to create an effective weather seal against leading side frame 15 of sliding glass door 21. FIGS. 8A–8D show various views of right or leading side weather seal shim 8 used on top module 2 to fill and seal channel 61 in the upright portion of door frame 11 in thick movable sliding glass door 21 configuration as shown in FIG. 6E.

Figure 5C:
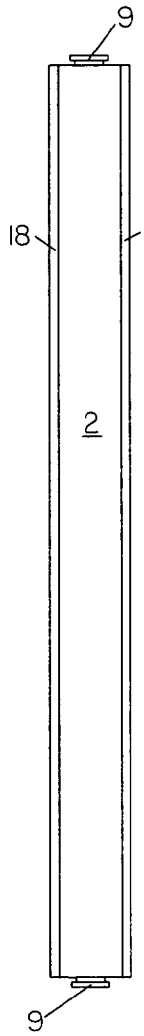
FIGS. 5A, 5C, and 5D are front elevational or interior, left elevational or trailing side, and right elevational or leading side views, respectively, of the top module without weather seal shims.
Figure 5A:
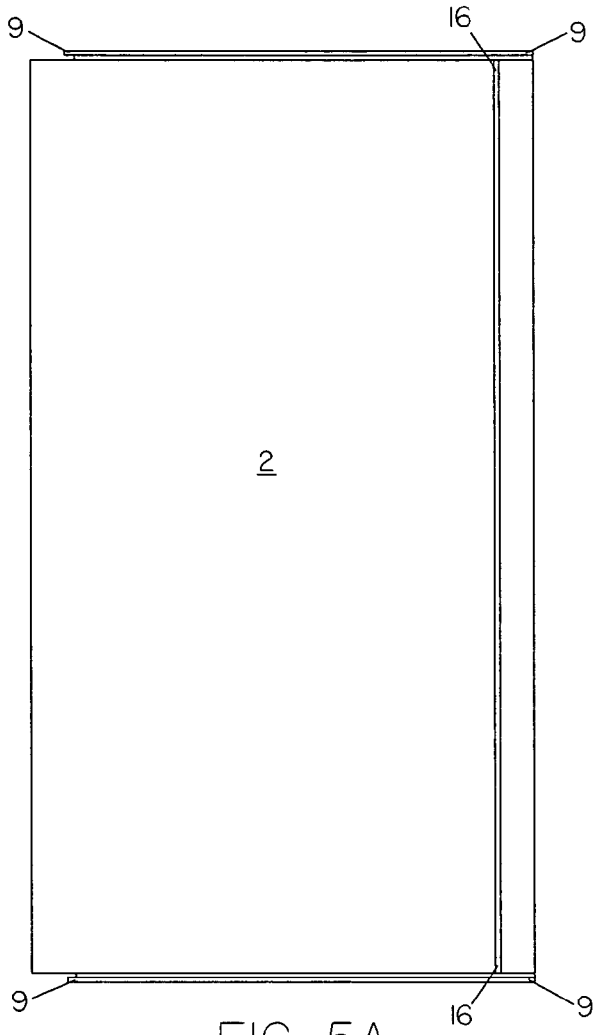
Figure 5D:
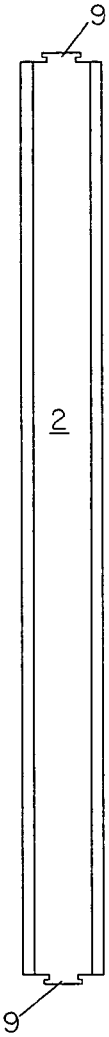
Figure 5B:
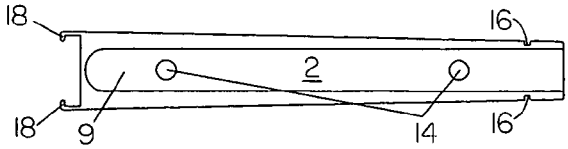
FIG. 5B is a top plan view of the top module without weather seal shims, the bottom plan view being identical thereto.

FIGS. 5A–5D are front or interior, top, trailing and leading side views of top module 2 with trailing and leading side weather seal shims removed. The back or exterior view of top module 2 is a mirror image of the front or interior view of top module 2 illustrated in FIG. 5A. The bottom view of top module 2 is identical to the top view of module 2 illustrated in FIG. 5B. FIG. 5A is a front or interior view of top module 2 showing interlocking tongue 9 in the uppermost portion of top module 2 and an identical interlocking tongue 9 located in the lowermost portion of top module 2. FIG. 5A also shows the left or trailing side 10 and right or leading side 7 of top module 2. Retention grooves 16 for receiving and retaining right or leading side weather seal shim 8 are shown running vertically at the right or leading side 7 of top module 2. FIG. 5B is a top view of top module 2 showing interlocking tongue 9. Interlocking tongue 9 runs along a horizontal plane on the top and bottom of top module 2. FIG. 5B shows top module weather seal spring guide holes 14 which run through interlocking tongue 9 into top module 2 in the uppermost and lowermost portion of top module 2. Right or leading side weather seal shim retention grooves 16 and left or trailing side weather seal shim retention lips 18 are shown in FIG. 5B. FIG. 5C is a left or trailing side view of top module 2, and FIG. 5D is a right or leading side view of top module 2.

FIGS. 6A–6D show various views of trailing side weather seal shim 12 which is designed for use in thick sliding glass patio door applications. FIG. 6A is a tailing side view of trailing weather seal shim 12 showing shim spacer bends 55 and sealing tabs 57. FIG. 6B is a top view of trailing weather seal shim 12, the bottom view is identical to the top view. Top view FIG. 6B shows channel 53 designed to accept the leading side of door frame 15 of movable sliding glass door 21. Channel 53 is formed by shim spacer bends 55 and sealing tabs 57 that run vertically along the length of trailing weather seal shim 12. FIG. 6C is a back side view of trailing side weather seal shim 12, and FIG. 6D is a side view of tailing side weather seal shim 12.

FIG. 6E is a partial cross sectional top view of movable sliding glass door 21 leading side frame 15, assembled pet access door top module 2 configured for thick sliding glass patio door and upright portion of sliding glass patio door frame 11. FIG. 6E shows leading side frame 15 of movable sliding glass patio door 21 sliding into the trailing side of assembled pet access door top module 2 in the direction indicated by directional arrow 49. Leading side frame 15 of movable siding glass patio door 21 fits into channel 53 formed by shim spacer bends 55 and sealing tabs 57 in the trailing side weather seal shim 12. Trailing weather seal shim 12 is retained in the trailing side of pet access door module 2 by retention lips 18. Leading side door frame 15 of movable sliding glass door 21 is guided into channel 53 and held in place by shim spacer bends 55. When leading door frame 15 is seated in channel 53, tabs 57 are compressed and held against leading door frame 15 of movable sliding glass door 21 to create an effective weather seal; The leading side of assembled pet access door top module 2 slides into channel 61 of the upright portion of sliding glass patio door frame 11 in the direction indicated by directional arrow 51. The leading side of assembled pet access door top module 2 is configured for a thick sliding glass patio door and therefore, shows leading side weather seal shim 8 affixed to assemble top module 2. As shown in FIGS. 8A–8D and described in greater detail later, leading side weather seal shim 8 is held in place on top module 2 by retaining tabs 59 that snap or slide into retention grooves 16 located on the leading side of pet access door top module 2. Leading side weather seal shim 8 is designed to fit into and seal against channel 61 in upright portion of sliding glass patio door frame 11.

Figure 7D:
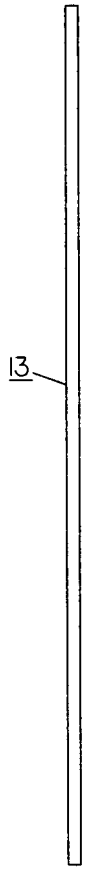
Figure 7E:
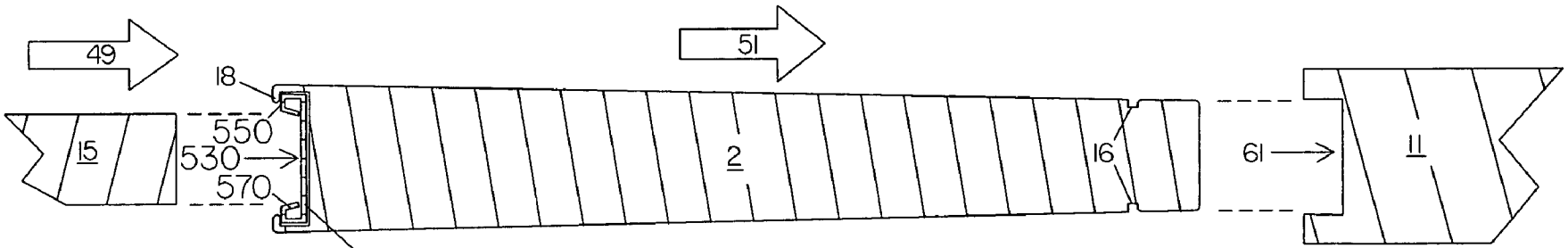
FIG. 7E is a partial cross sectional view taken along 6E—6E of FIG. 1 of the moveable patio door, trailing side weather seal shim, pet access door and sliding glass patio door frame, illustrating the function of the trailing side weather seal shim and the leading side of the pet access door in a thick patio door configuration.

FIGS. 7A–7D show various views of trailing side weather seal shim 13 which is designed for use in thin sliding glass patio door applications. FIG. 7A is a tailing side view of trailing weather seal shim 13 showing shim spacer bends 550 and sealing tabs 570. FIG. 7B is a top view of trailing weather seal shim 13, the bottom view is identical to the top view. Top view FIG. 7B shows channel 530 designed to accept the leading side of door frame 15 of movable sliding glass door 21. Channel 530 is formed by shim spacer bends 550 and sealing tabs 570 that run vertically along the length of trailing weather seal shim 13. FIG. 7C is a back side view of trailing side weather seal shim 13 and FIG. 7D is a side view of tailing side weather seal shim 13.

FIG. 7E is a partial cross sectional top view of movable sliding glass door 21 leading side frame 15, assembled pet access door top module 2 configured for thin sliding glass patio door and upright portion of sliding glass patio door frame 11. FIG. 7E shows leading side frame 15 of movable sliding glass patio door 21 sliding into the trailing side of assembled pet access door top module 2 in the direction indicated by directional arrow 49. Leading side frame 15 of movable siding glass patio door 21 fits into channel 530 formed by shim spacer bends 550 and sealing tabs 570 in the trailing side weather seal shim 13. Trailing weather seal shim 13 is retained in the trailing side of pet access door module 2 by retention lips 18. Leading side door frame 15 of movable sliding glass door 21 is guided into channel 530 and held in place by shim spacer bends 550. When leading slide door frame 15 is seated in channel 530, tabs 570 are compressed and held against leading door frame 15 of movable sliding glass door 21 to create an effective weather seal. The leading side of assembled pet access door top module 2 slides into channel 61 of the upright portion of sliding glass patio door frame 11 in the direction indicated by directional arrow 51. The leading side of assembled pet access door top module 2 is configured for a thin sliding glass patio door, and therefore fits and seals in channel 61 of the upright portion of sliding glass patio door frame 11 without the need for a leading side weather seal shim 8, as required with a thick sliding glass door.

Figure 8B:
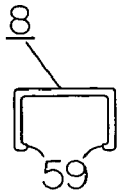
FIG. 8B is a top plan view of the right or leading side top and bottom module weather seal shim required for thick patio door installations of the pet access door, the bottom plan view being identical thereto.
Figure 8C:
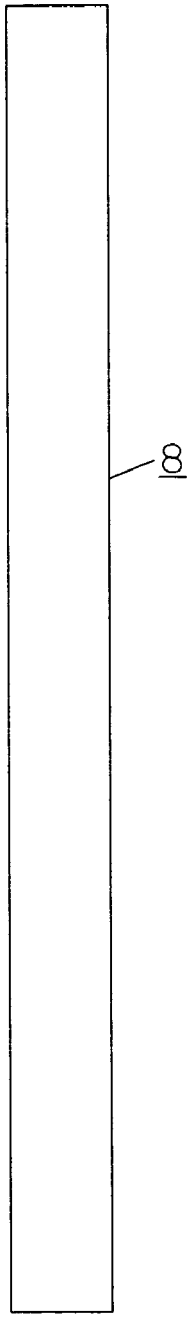
FIGS. 8A, 8C, and 8D are front elevational, back elevational, and right elevational side views, respectively, of the right or leading side top and bottom module weather seal shim required for thick patio door installations of the pet access door, the left elevational side view being identical to the latter.
Figure 8A:
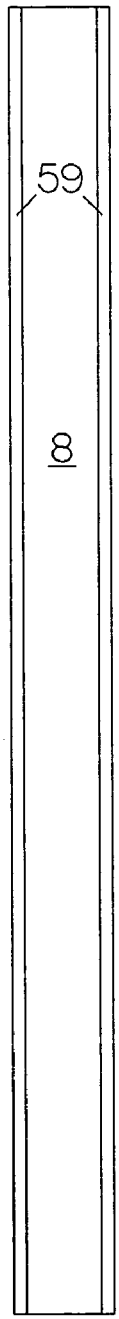
Figure 8D:
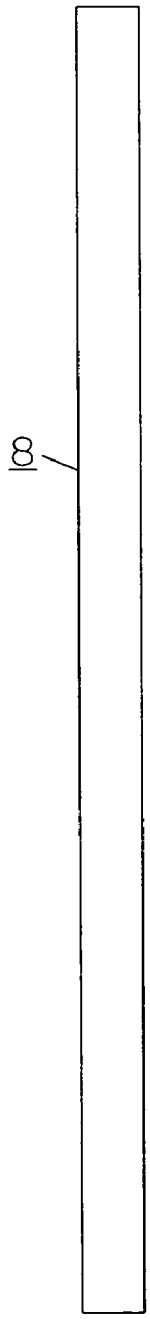

FIGS. 8A–8D show various views of leading side weather seal shim 8. FIG. 8A is a back side view of leading side weather seal shim 8 showing retaining tabs 59 that interlock with retention grooves 16 in pet access door top module 2. FIG. 8B is a top view of weather seal shim 8. The bottom view of weather seal shim 8 is identical to top view FIG. 8B. FIG. 8B shows retaining tabs 59 that interlock with retention grooves 16 in pet access door top module 2. FIG. 8C is a leading side view of leading side weather seal shim 8, and FIG. 8D is a side view of leading side weather seal shim 8.

Figure 9C:
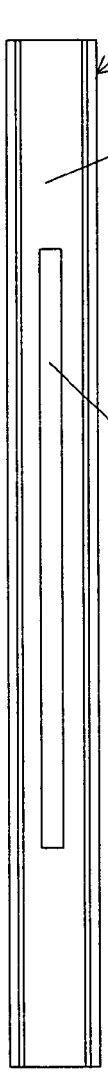
FIGS. 9A, 9C, and 9D are front elevational or interior side, left elevational or trailing side, and right elevational or leading side views, respectively, of the center module subassembly with weather seal shims in place.
Figure 9A:
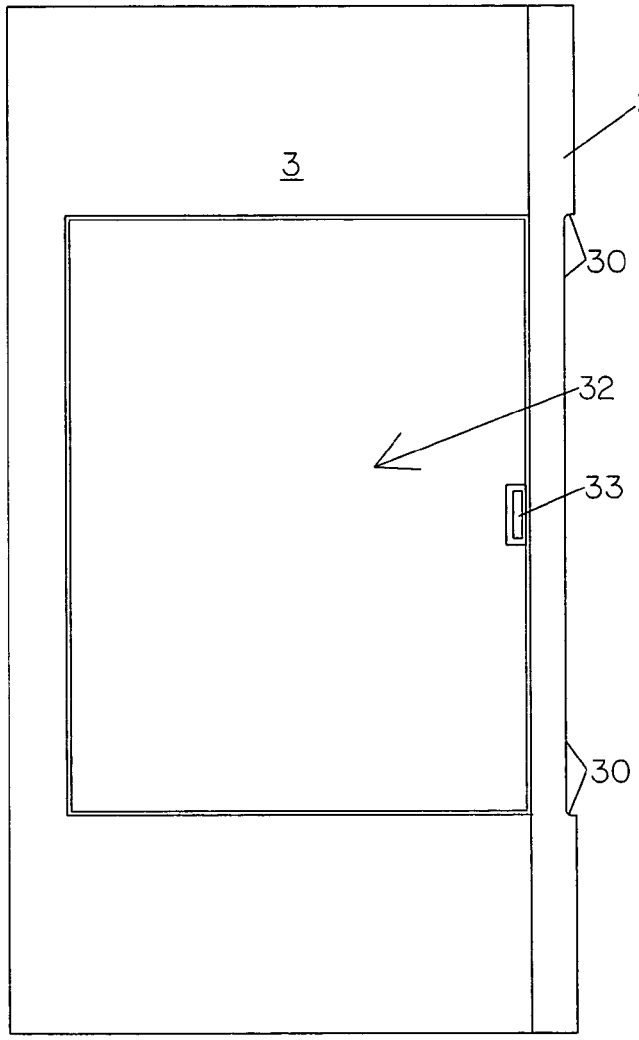
Figure 9D:
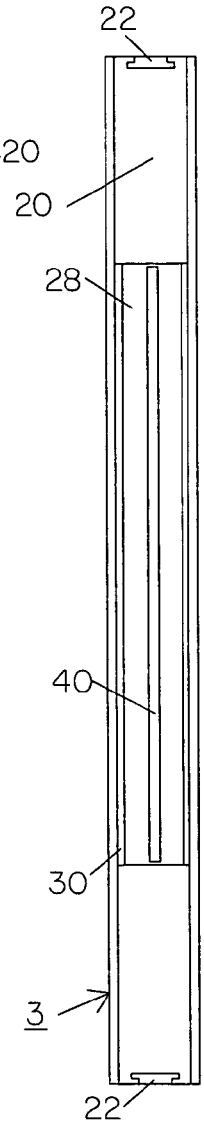
Figure 9B:
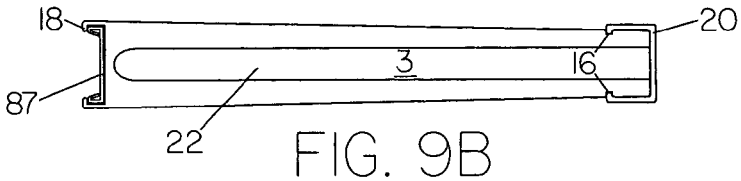
FIG. 9B is a top plan view of the center module subassembly with weather seal shims in place, the bottom plan view being identical thereto.

FIGS. 9A–9D show various views of assembled pet access door center module 3. FIG. 9A is a front or interior view of center module 3 showing access door 32 with opening tab 33, and leading side weather seal shim 20 with external catch screw mount recess 30. FIG. 9B is a top view of assembled pet access door center module 3. The bottom view of assembled pet access door center module 3 is identical to the top view FIG. 9B. FIG. 9B is a top view of center module 3, which shows both the leading side 20 and trailing side 87 weather seal shims. Leading weather seal shim 20 is not necessary when used in combination with a thin movable sliding glass door 21 since the leading side of center module 3 fits into channel 61, the same as the leading side of top module 2 described earlier and as shown in FIG. 7E. With the invention configured for a thin sliding glass patio door application, leading side weather seal shim 20 is omitted, and trailing side weather seal shim 89 is used in place of trailing side weather seal shim 87, the same as trailing side weather seal shim 13 on top module 2 described earlier, as shown in FIG. 7E. Weather seal shim 20 is designed to slide or snap into retention grooves 16 located on a vertical plane on both the front and back sides adjacent to the right or leading side of center module 3 as shown in FIG. 9B. Trailing side weather seal shim 87 located on the trailing side of center module 3 contained within retention lips 18 is designed to accept the leading side of frame 15 of movable sliding glass door 21 in thick sliding glass patio door applications. Interlocking groove 22 is located on a horizontal plane on the uppermost and lowermost portions of center module 3 as shown in FIG. 9B. Grooves 22 interlock with tongues 9, 19 located on top module 2 and bottom module 4, respectively. FIG. 9C is a trailing side view of assembled pet access door center module 3 showing slot 36 in trailing side weather seal shim 87 designed to accommodate a universal locking mechanism in another embodiment of the invention. FIG. 9D is a leading side view of assembled pet access door center module 3 showing interlocking grooves 22 in the uppermost and lowermost portions of center module 3 with leading side weather seal shim 20 in place. FIG. 9D shows external catch slot 40 in leading side weather seal shim 20. Externally mounted catch cavity 28 and slot 40 designed to accommodate a universal locking mechanism in another embodiment of the invention are shown in the leading side of center module 3 in FIG. 9D.

Figures 10A, 10B, 10C, 10D, 10E:
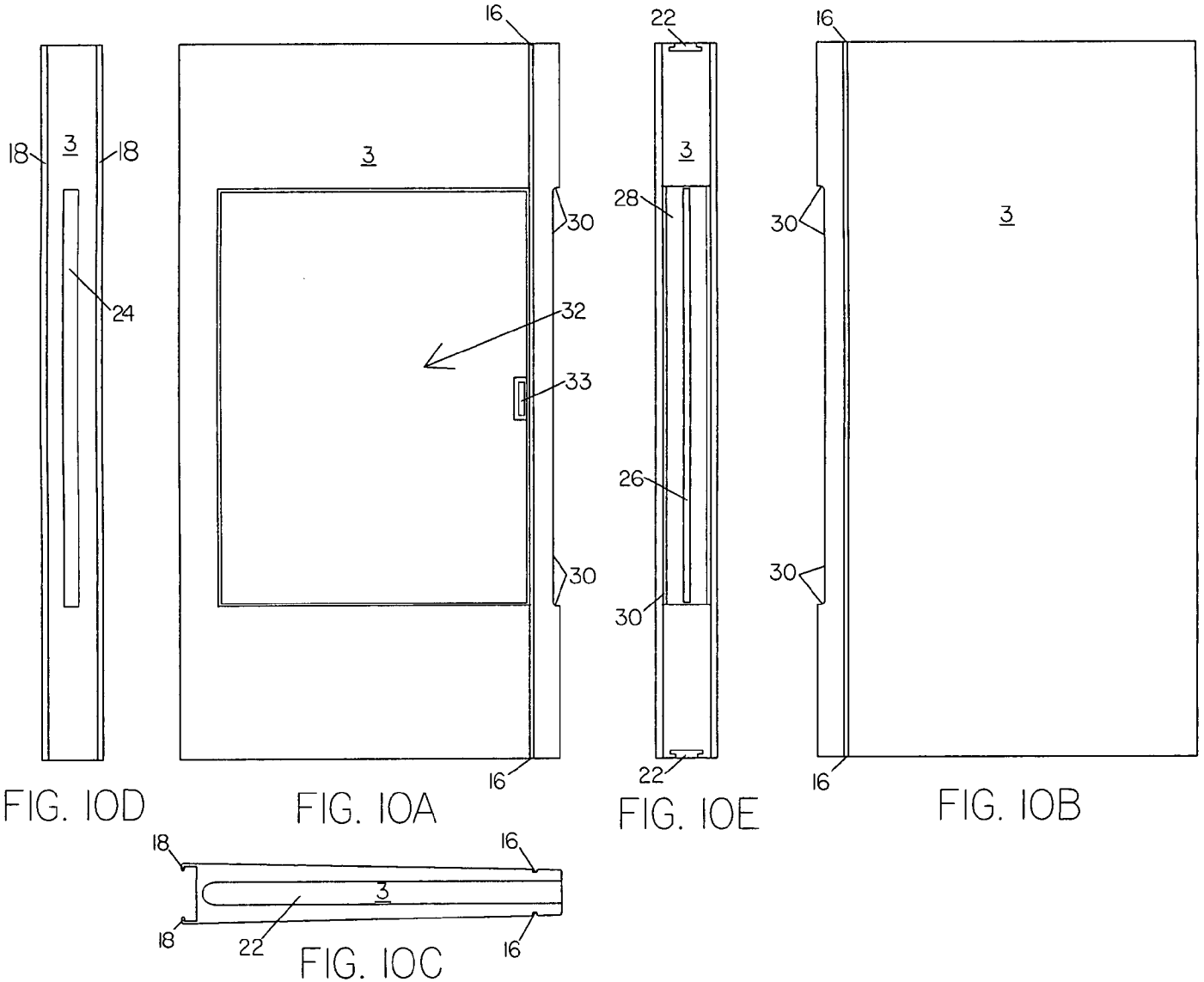
FIGS. 10A, 10B, 10D, and 10E are front elevational or interior, back elevational or exterior, left elevational or trailing side, and right elevational or leading side views, respectively, of the center module without weather seal shims.
FIG. 10C is a top plan view of the center module without weather seal shims, the bottom plan view being-identical thereto.
Figure 11D:
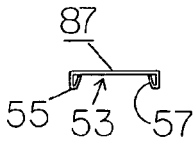
FIGS. 11A, 11C, and 11D are front elevational, back elevational, and right elevational side views, respectively, of the left or trailing side center module thick patio door weather seal shim, the left elevational side view being identical to the latter.
Figure 11A:
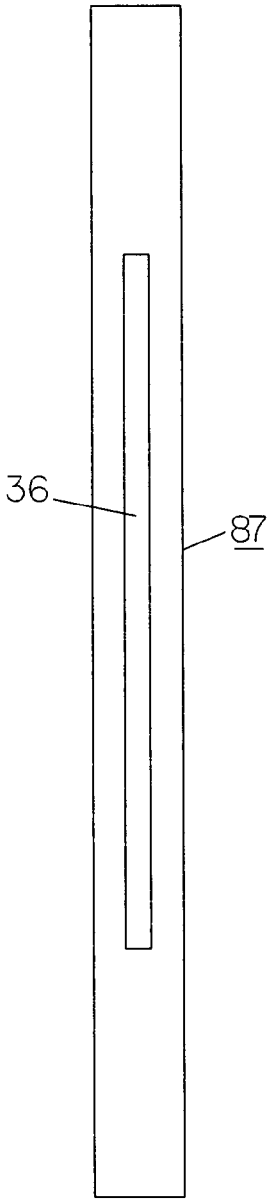
Figure 11B:
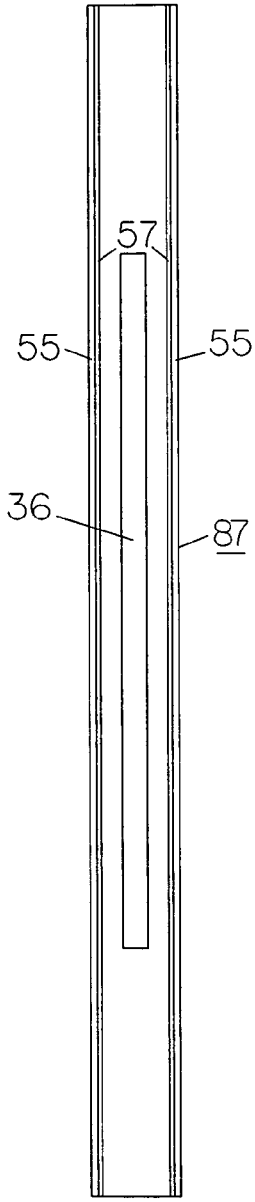
FIG. 11B is a top plan view of the left or trailing side center module thick patio door weather seal shim, the bottom plan view being identical thereto.
Figure 11C:
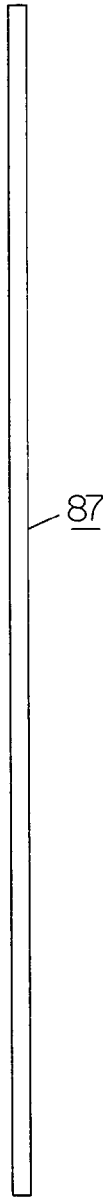
Figure 12D:
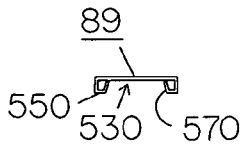
FIGS. 12A, 12C, and 12D are front elevational, back elevational, and right elevational side views, respectively, of the left or trailing side center module thin patio door weather seal shim, the left elevational side view being identical to the latter.
Figure 12A:
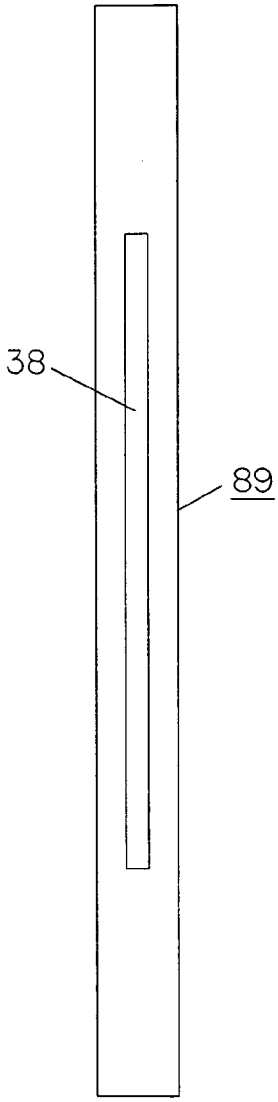
Figure 12B:
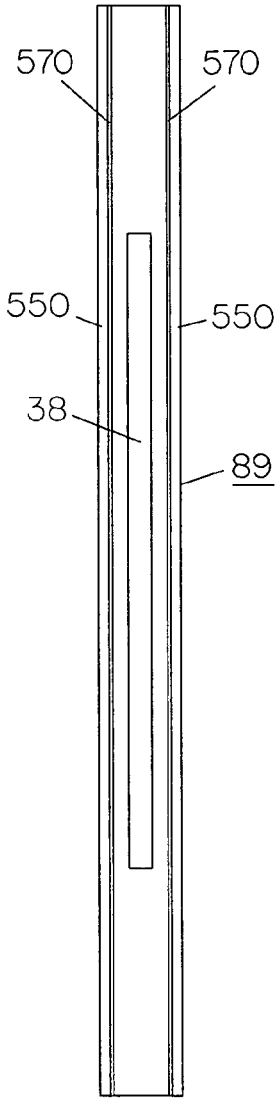
FIG. 12B is a top plan view of the left or trailing side center module thin patio door weather seal shim, the bottom plan view being identical thereto.
Figure 12C:
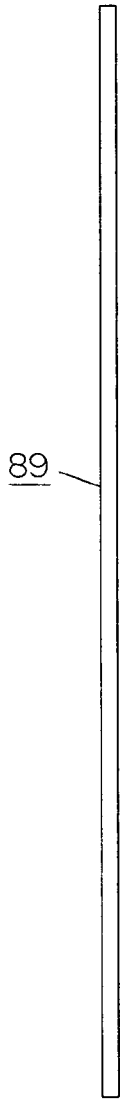
Figure 13D:
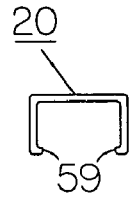
FIGS. 13A–13D are front elevational, back elevational, right elevational side views, and a top plan view, respectively, of the top and bottom module leading edge weather seal shim required for thick patio door installations of the pet access door, the left elevational side view being identical to the latter.
Figure 13A:
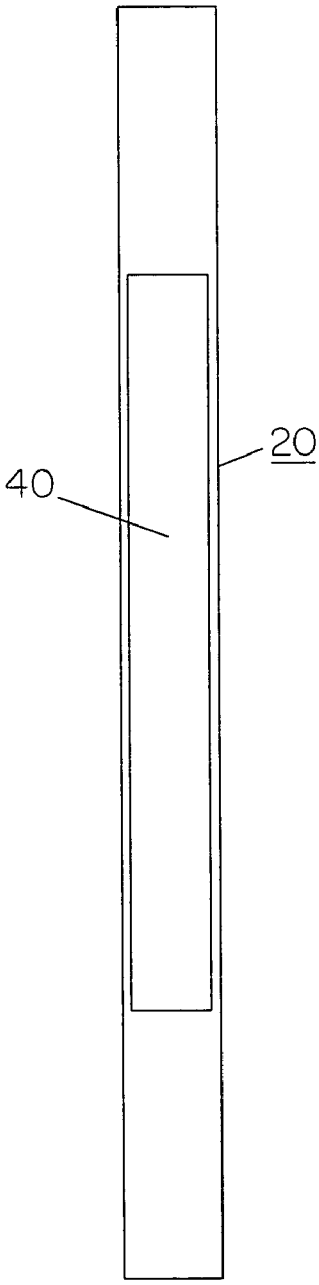
Figure 13B:
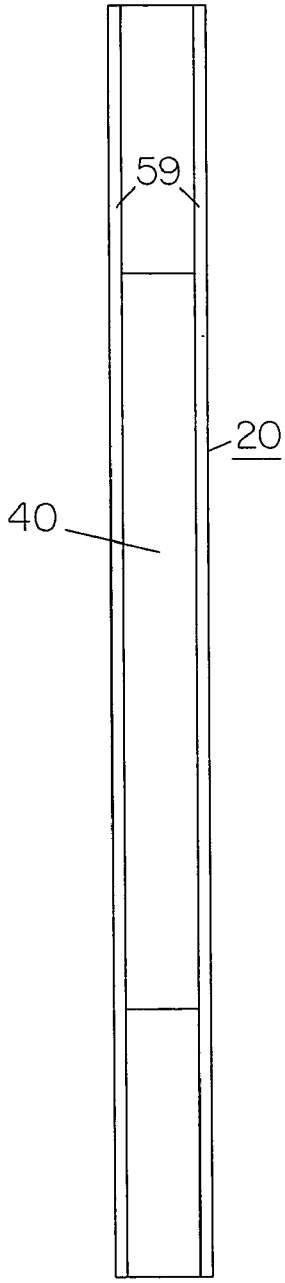
Figure 13C:
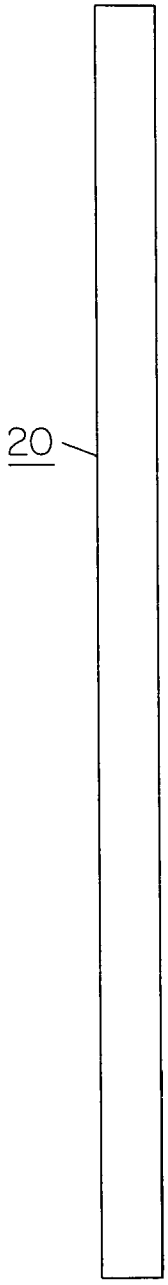

FIGS. 10A–10E are various views of center module 3. FIG. 10A is a front or interior view showing access door 32 with access door opening tab 33. Interlocking leading side weather seal shim grooves 16, and externally mounted catch mounting screw recess 30 on the leading side 7 of center module 3 are shown in FIG. 10A. FIG. 10B is a back or exterior side view of center module 3 showing the interlocking leading side weather seal shim groove 16, and externally mounted catch mounting screw recess 30. FIG. 10C is a top view of center module 3 showing interlocking groove 22, interlocking leading side weather seal shim grooves 16, and trailing side weather seal shim retention lips 18. FIG. 10D is a trailing side view of center module 3 showing slot 24 designed to accommodate a universal locking mechanism in another embodiment of the invention. FIG. 10E is a leading side view of center module 3 showing interlocking groove 22, externally mounted catch cavity 28, and externally mounted catch mounting screw recess 30. Slot 26 designed to accommodate a universal locking mechanism in another embodiment of the invention is shown in FIG. 10E.

FIGS. 11A–11D show various views of thick sliding glass patio door center module 3 trailing side weather seal shim 87, and FIGS. 12A–12D show various views of thin sliding glass patio door center module 3 trailing side weather seal shim 89. Except for the universal locking mechanism slots 36 and 38 as shown in FIGS. 11A and 11B, 12A and 12B, respectively, trailing weather seal shims 87 and 89 in center module 3 are designed and function the same as trailing side weather seal shims 12 and 13, respectively, in top module 2. Note in this regard, FIGS. 6A–6E and 7A–7E, and the description of design and function described earlier. When referring to FIGS. 6A–6E substitute center module 3 trailing weather seal shim 87 for top module 2 trailing side weather seal shim 12. When referring to FIGS. 7A–7E substitute center module 3 trailing side weather seal shim 89 for top module 2 trailing side weather seal shim 13. FIGS. 13A–13D show various views of right or leading side weather seal shim 20 used on center module 3 to fill and seal channel 61 in the upright portion of door frame 11 in thick movable sliding glass door 21 configuration as shown in FIG. 6E. Except for universal locking mechanism slot 40, leading side weather seal shim 20 in center module 3 is designed and functions the same as leading side weather seal shim 8 in top module 2. In this regard, note FIGS. 8A–8D and FIG. 6E and the description of the design and function described earlier. When referring to FIGS. 8A–8D and FIG. 6E, substitute center module 3 leading side weather seal shim 20 for top module 2 leading side weather seal shim 8.

Figure 14A:
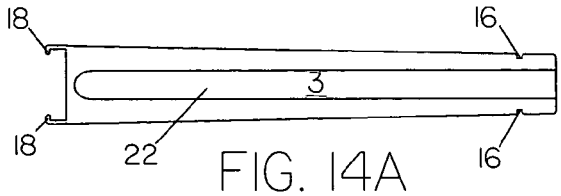
FIG. 14A is a top plan view of the center module configured for alternative and additional embodiments of the invention, the bottom plan view being identical thereto.
Figure 14C:
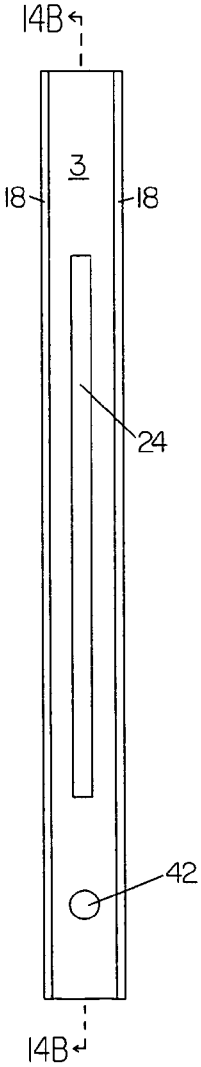
FIGS. 14C and 14D are left elevational or trailing side and right elevational or leading side views, respectively, of the center module configured for alternative and additional embodiments of the invention.
Figure 14B:
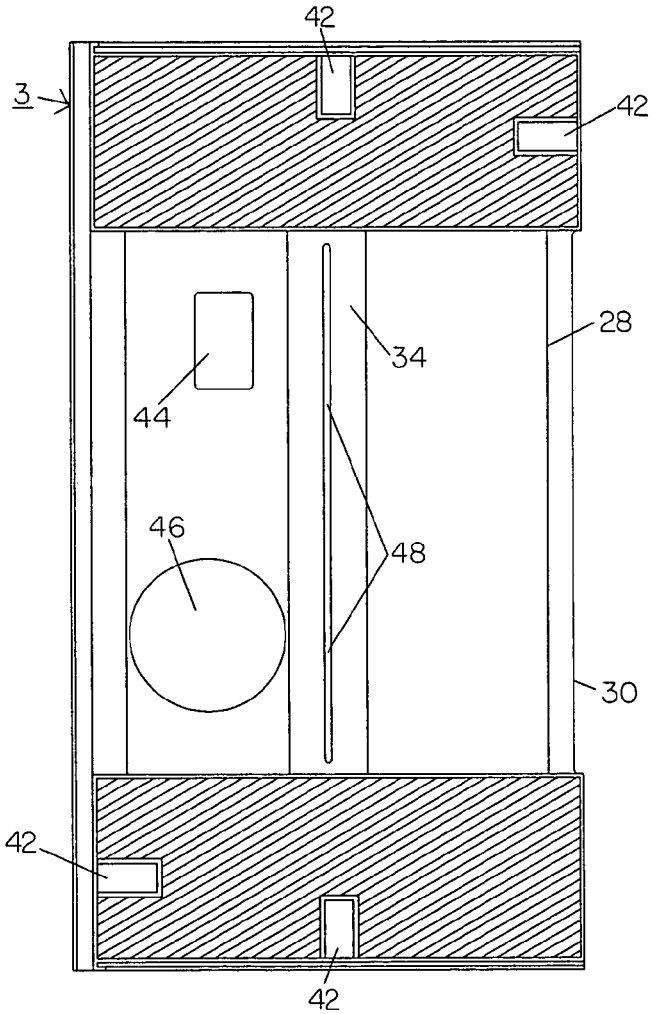
FIG. 14B is a front cross sectional view taken along 14B—14B from FIG. 14C of center module configured for alternative and additional embodiments of the invention.
Figure 14D:
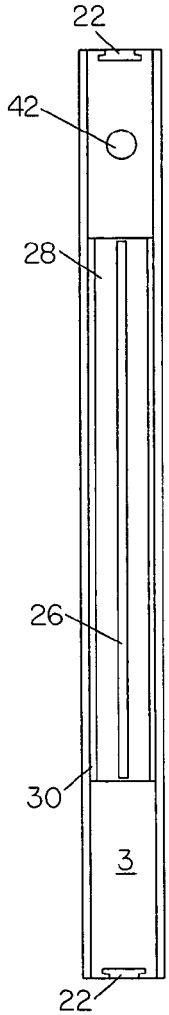

FIGS. 14A–14D show various views of center module 3 with provision for another embodiment of the invention. FIG. 14A is a top view which is identical to the bottom view showing a cross sectional view reference to FIG. 14B. FIG. 14B is a cross sectional view of center module 3 showing pressure switch cavities 42, battery compartment 44, and alarm compartment 46 designed to facilitate installation of an alarm system in another embodiment of the invention. A channel 34 and vertical adjustment slot 48 associated with a universal locking assembly as part of another embodiment of the invention are shown in FIG. 14B. FIG. 14C is a trailing side view of center module 3 showing universal locking mechanism slot 24 and alarm system pressure switch hole 42 which are features associated with another embodiment of the invention. FIG. 14D is a leading side view of center module 3 which shows interlocking groove 22, externally mounted catch cavity 28, and externally mounted catch mounting screw recess 30. Cavity 28 and mounting screw recess 30 will accommodate a sliding glass patio door with externally mounted catch as shown in FIG. 47C. In another embodiment of the invention, a universal locking mechanism and alarm system may be incorporated into the device. Provision for a universal locking mechanism slot 26 and pressure switch hole 42 are shown in FIG. 14D.

Figure 15C:
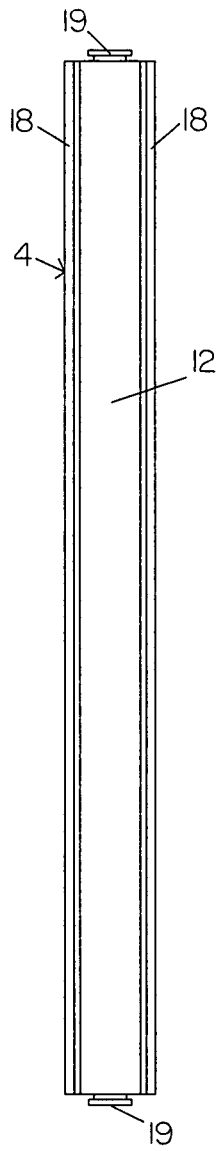
FIGS. 15A, 15C, and 15D are front elevational or interior, left elevational or trailing side, and right elevational or leading side views, respectively, of the bottom module subassembly with weather seal shims in place.
Figure 15A:
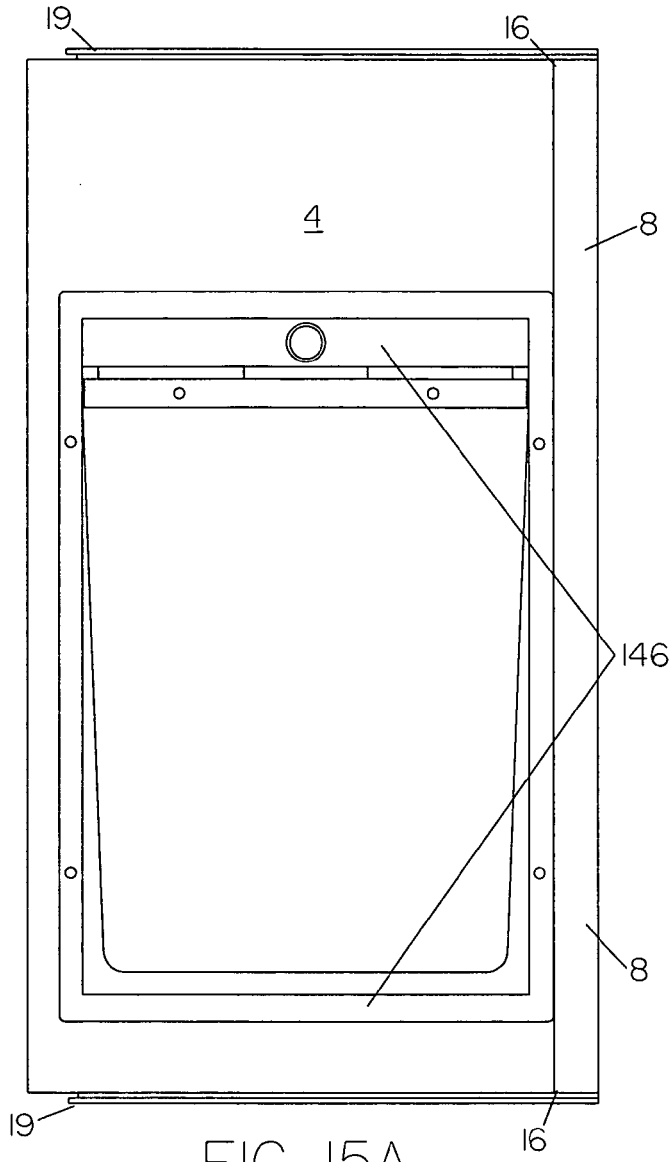
Figure 15D:
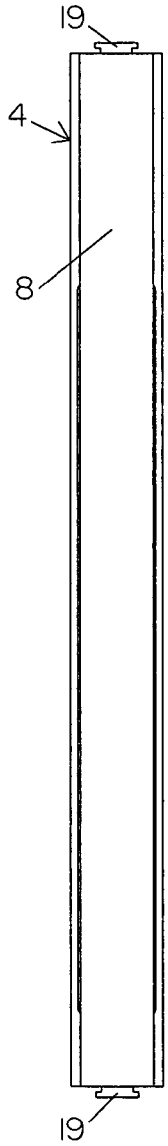
Figure 15B:
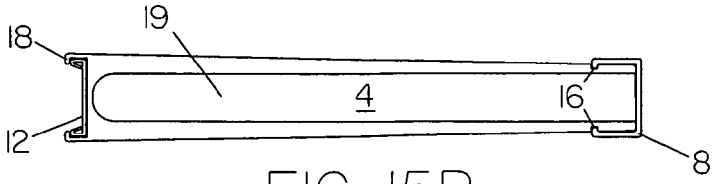
FIG. 15B is a top plan view of the bottom module subassembly with weather seal shims in place, the bottom plan view being identical thereto.

FIGS. 15A–15D show various views of the assembled pet access door bottom module 4 configured in the preferred embodiment of the invention with pet portal assembly 146 installed. Pet portal assembly 146 is described later. FIG. 15A is a right or interior side view of assembled pet access door bottom module 4 with pet portal assembly 146 installed. Interlocking tongue 19 running along a horizontal plane is shown at the uppermost and lowermost portions of assembled pet access door bottom module 4 in FIG. 15A. Leading side weather seal shim 8 is shown assembled to the leading side 7 of assembled pet access door bottom module 4 in FIG. 15A. FIG. 15B is a top view of assembled pet access door bottom module 4 and is identical to the bottom view. FIG. 15B shows interlocking tongue 19, leading side weather seal shim 8, and interlocking weather seal grooves 16 in the leading side of bottom module 4. Trailing side thick movable sliding glass patio door weather seal shim 12, and trailing side weather seal shim retention lips 18 are shown in the trailing side of assembled pet access door bottom module 4 in FIG. 15B. FIG. 15C is a trailing side view of assembled pet access door bottom module 4, which shows thick movable sliding glass patio door weather seal shim 12 running along a vertical plane and interlocking tongue 19 in the uppermost and lowermost portions of assembled pet access door bottom module 4. FIG. 15D is a leading side view of assembled pet access door bottom module 4 showing interlocking tongue 19 in the uppermost and lowermost portions of bottom module 4 and leading side weather seal shim 8 running along a vertical plane.

Figure 16B:
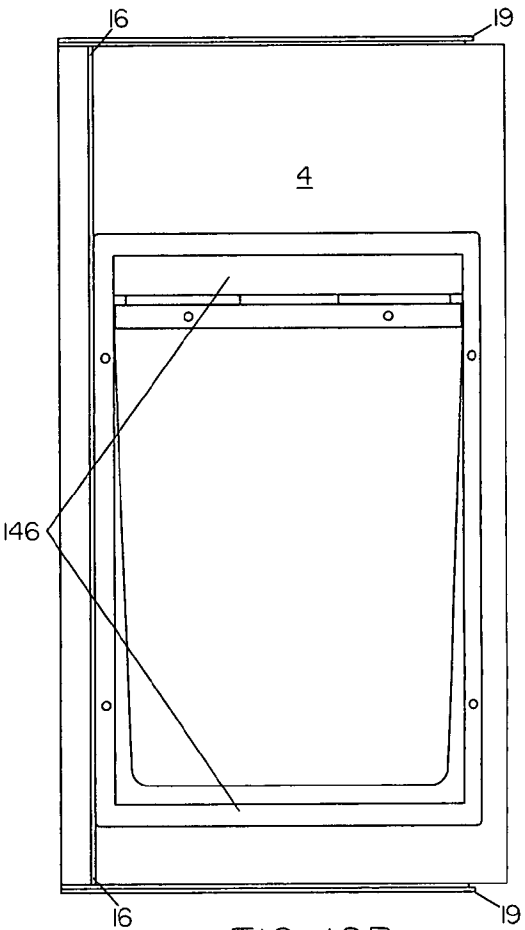
FIG. 16B is a top plan view of the bottom module without weather seal shims, the bottom plan view being identical thereto.
Figure 16E:
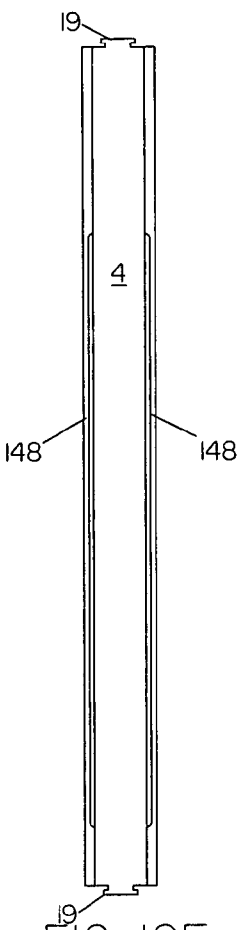
FIGS. 16A, 16C, and 16E are front elevational or interior, left elevational or trailing side, and right elevational or leading side views, respectively, of the bottom module without weather seal shims.
Figure 16A:
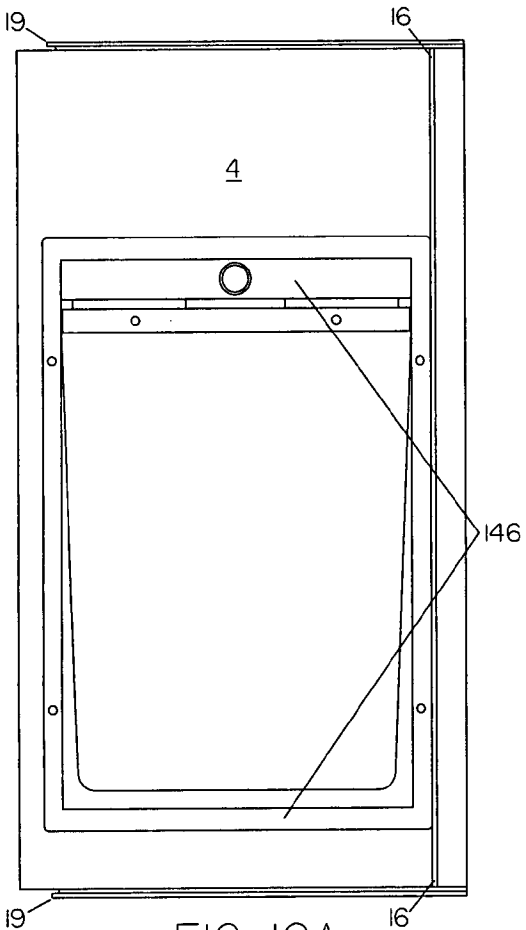
Figure 16D:
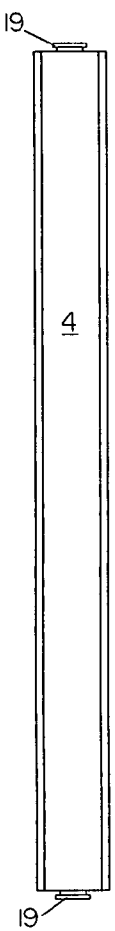
Figure 16C:
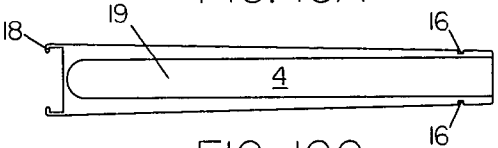

FIGS. 16A–16E show various views of bottom module 4 with trailing and leading side weather seal shims 8 and 12 removed. FIG. 16A is a front or interior side view of bottom module 4 with pet portal assembly 146 installed. FIG. 16B is a back or exterior side view of bottom module 4 with pet portal assembly 146 installed and is a mirror view of the front or interior view 16A except for the flap lock knob. FIGS. 16A and 16B show interlocking tongue 19 in the uppermost and lowermost portions of bottom module 4 and interlocking weather seal groove 16 running along a vertical plane on the leading side of bottom module 4. FIG. 16C is a top view of bottom module 4, the bottom view is identical to the top view. FIG. 16C shows interlocking tongue 19, interlocking leading side weather seal shim groove 16, trailing side weather seal shim retention lip 18 at the trailing side of bottom module 4. FIG. 16D is a trailing side view of bottom module 4 showing interlocking tongue 19 in the uppermost and lowermost portions of bottom module 4. FIG. 16E is a leading side view of bottom module 4 showing pet portal assembly flange 148 and interlocking tongue 19 in the uppermost and lowermost portions of bottom module 4. See FIGS. 6A–6E and FIGS. 7A–7E and description of design and function of trailing side and leading side weather seal shims described earlier.

Figure 17C:
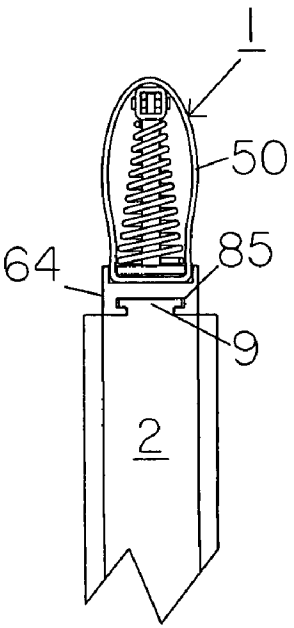
FIGS. 17A–17C are front or interior, left or trailing side, and right or leading side elevational views, respectively, of the top weather seal subassembly affixed to the top module subassembly.
Figure 17A:
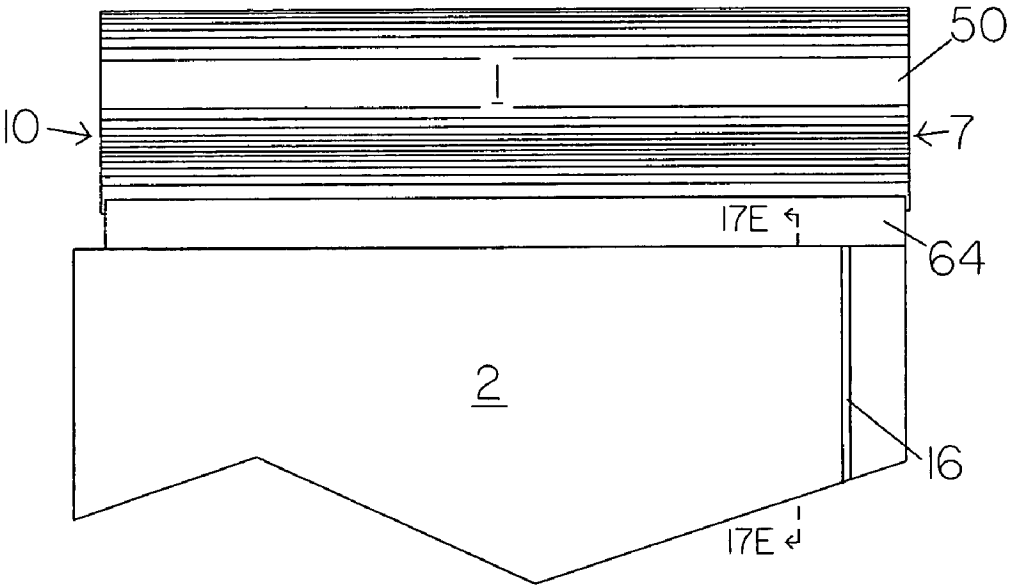
Figure 17B:
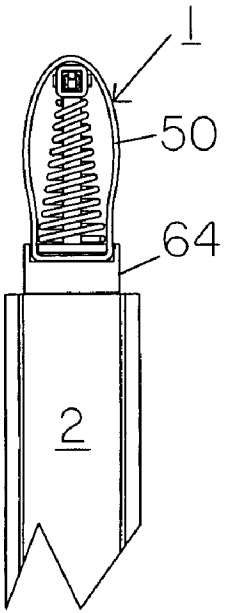

FIGS. 17A–17B are interior, trailing side and leading side elevational views of top module weather seal 1 shown attached to top module 2. FIG. 17A is an interior side elevational view of top module weather seal 1 attached to top module 2 showing top module weather seal sleeve 50 and base 64, and a partial view of top module 2 with interlocking leading side weather seal shim groove 16. FIG. 17B is a trailing side elevational view of the top module weather seal attached to top module 2 showing top module weather seal sleeve 50, base 64, and partial elevational view of top module 2. FIG. 17C is a leading side elevational view of top module weather seal 1 and a partial elevational view of top module 2. FIG. 17C shows top module weather seal sleeve 50, base 64, interlocking groove 85, and a partial elevational view of top module 2 and interlocking tongue 9. Top module weather seal 1 is slideably attached to top module 2 by sliding top module weather seal 1 to cause interlocking groove 85 to mate with interlocking tongue 9 as shown in FIG. 17C.

Figure 18A:
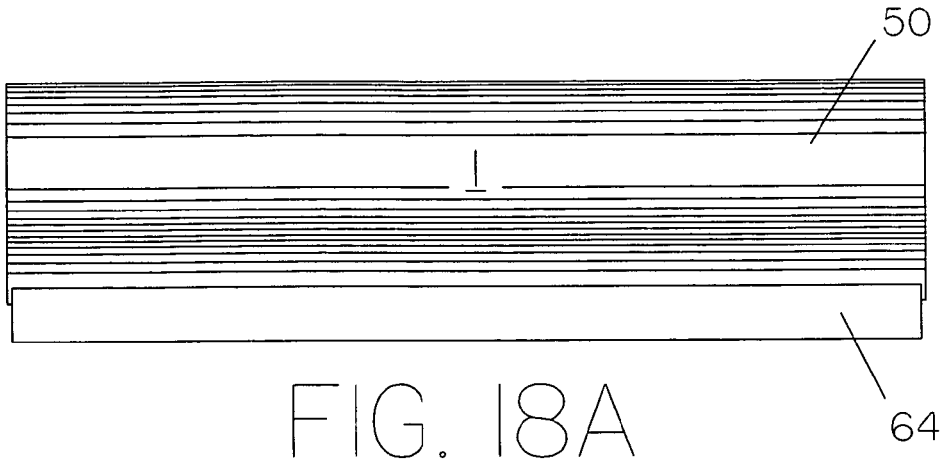
FIGS. 18A–18C are front elevational, top plan, and bottom plan views, respectively, of the top weather seal subassembly.
Figure 18B:
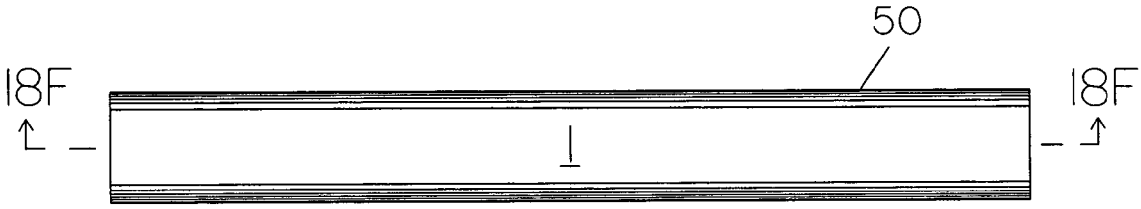
Figure 18C:
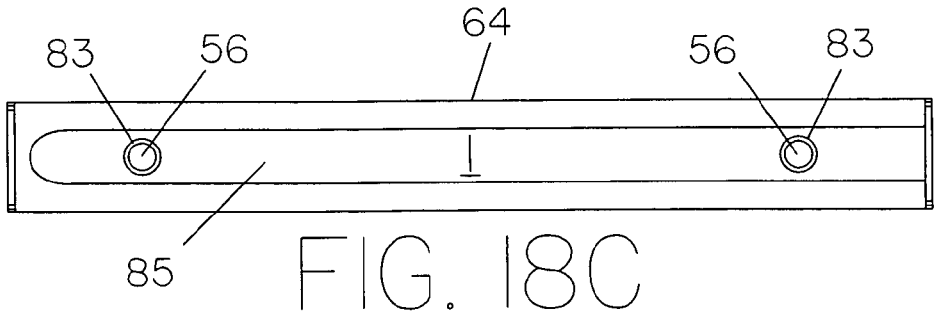

FIGS. 18A–18C show various views of top module weather seal 1. FIG. 18A is an interior side view showing the top module weather seal sleeve 50 and base 64. The exterior view is identical to FIG. 18A. FIG. 18B is a top view of top module weather seal 1 showing top module weather seal sleeve 50. FIG. 18C is a bottom view of top module weather seal 1 showing interlocking groove 85, spring guide stop counter bore 83, and spring guide 56 in top module weather seal base 64.

Figure 18E:
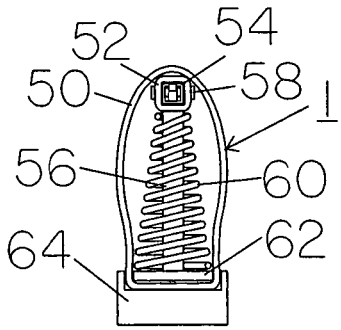
FIGS. 18D and 18E are left side elevational or trailing side, and right side elevational or leading side views, respectively, of the top weather seal subassembly.
Figure 18D:
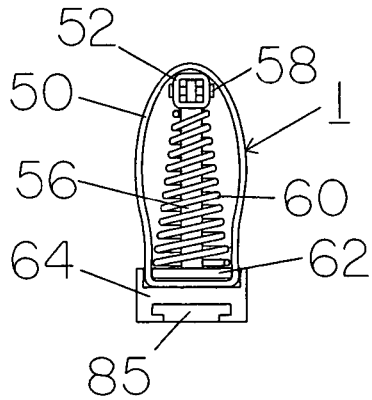
Figure 18F:
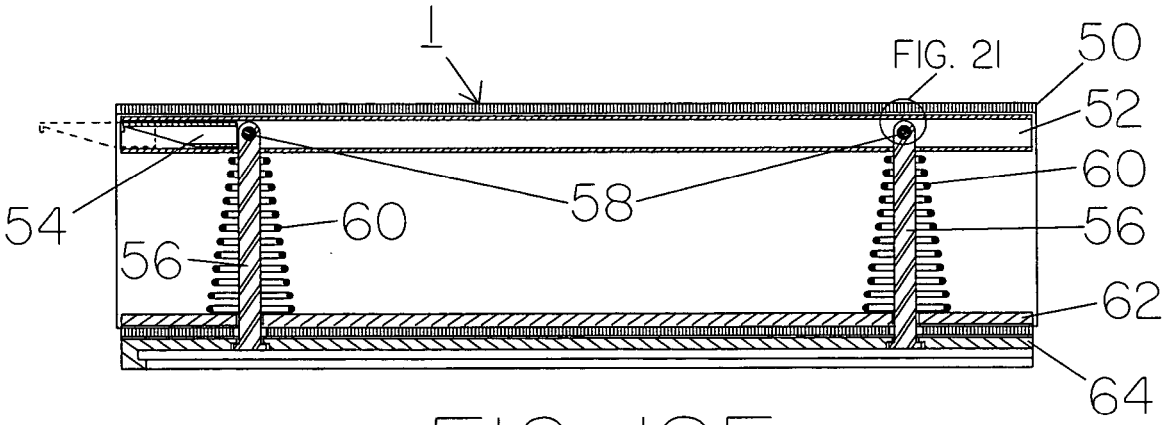
FIG. 18F is a front cross sectional view taken along 18F—18F from FIG. 18C of the top weather seal subassembly.
Figure 19A:
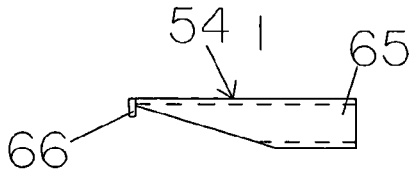
FIGS. 19A–19E are front elevational, left side elevational, top plan, bottom plan, and right side elevational views, respectively, of the top weather seal subassembly patio door hold-down wedge component.
Figure 19B:
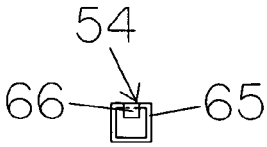
Figure 19C:
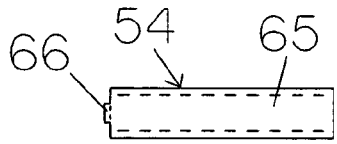
Figure 19D:
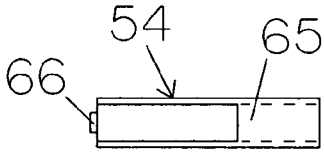
Figure 19E:
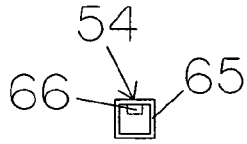

FIG. 18D is a leading side view of top module weather seal 1 showing interlocking groove 85 and the relationship of top module weather seal components, including sleeve 50, base 64, sleeve retainer 62, tension bar 52, tension bar spring 60, tension bar spring guides 56, tension bar pin and retainer set 58. FIG. 18E is a trailing side view of top module weather seal 1 and very similar to the leading side view FIG. 18D with the addition of the movable sliding patio door hold-down wedge 54. FIG. 18F is an interior cross sectional view of top module weather seal 1 and further illustrates the relationship of the various components comprising the assembly. Top module weather seal 1 is an assembly designed to slideably attach to assembled top module 2 of the pet access door panel 25. The top module weather seal functions as a filler to compensate for different heights of sliding glass patio doors as produced by the various manufacturers in order to produce an effective weather seal. FIG. 19A is an interior side view of patio door hold-down wedge 54 showing pull tab 66 and the wedge shape of the body 65. FIG. 19B is a trailing side view of patio door hold-down wedge 54 showing the pull tab 66. FIG. 19C is a leading side view, and FIG. 19D is a bottom side view.

Figure 20A:
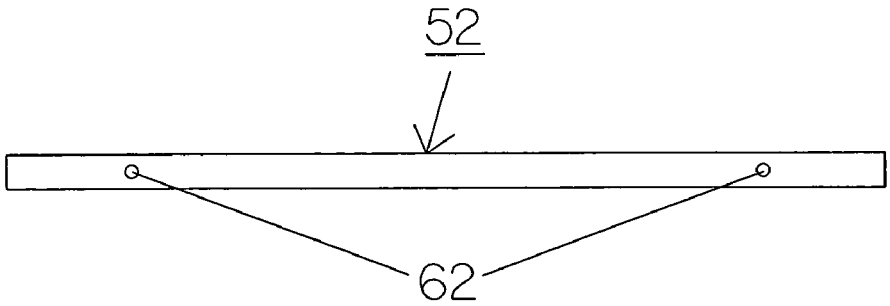
FIGS. 20A–20D are front elevational (back elevational being identical thereto), right side elevational (left side elevational being identical thereto), top plan and bottom plan views, respectively, of the top weather seal subassembly tension bar component.
Figure 20B:
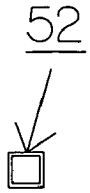
Figure 20C:
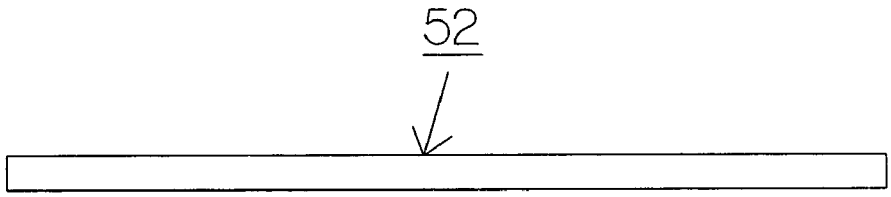
Figure 20D:
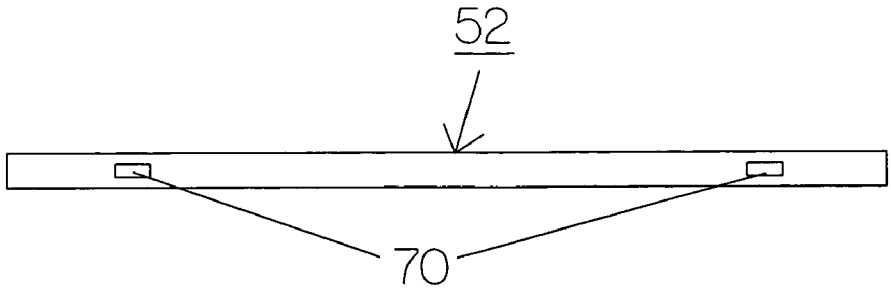
Figure 21:
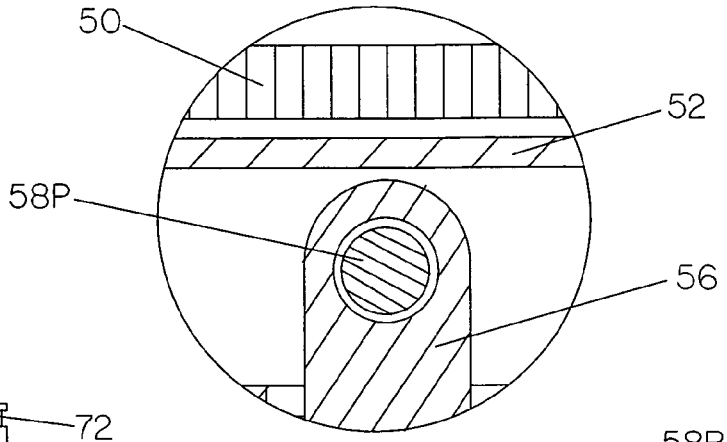
FIG. 21 is an enlarged cross sectional view of the area of the top weather seal subassembly shown within circle labeled "FIG. 21" of FIG. 18F.
Figure 22A:
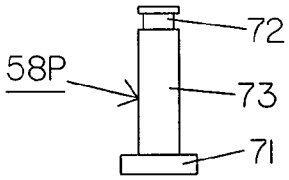
FIGS. 22A–22C are front elevational (back, right, and left side elevational views being identical thereto), top plan, and bottom plan views, respectively, of the top weather seal subassembly tension bar spring guide retaining pin component.
Figure 23A:
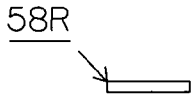
FIGS. 23A and 23B are side elevational, and top plan views, respectively, of the top weather seal subassembly tension bar spring guide retaining pin retainer.
Figure 22B:
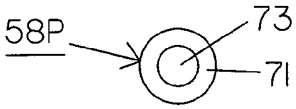
Figure 23B:
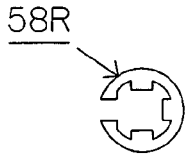
Figure 22C:
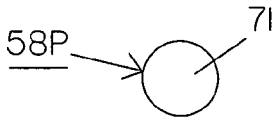
Figure 24A:
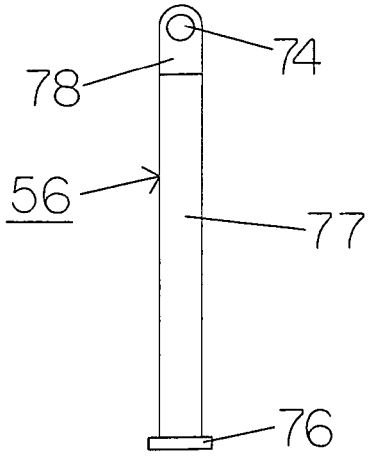
FIGS. 24A–24D are front elevational, side elevational, top plan and bottom plan views, respectively, of the top weather seal subassembly tension bar spring guide component.
Figure 24B:
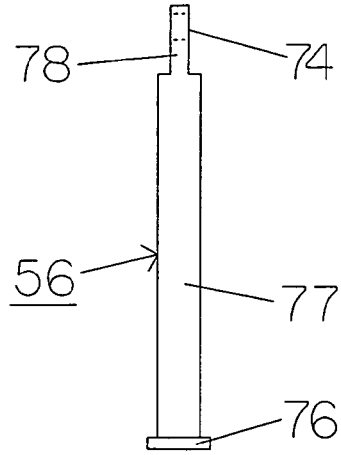
Figure 24C:
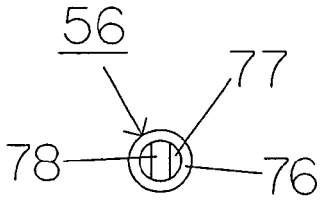
Figure 24D:
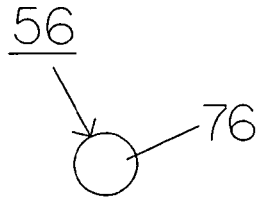
Figure 25:
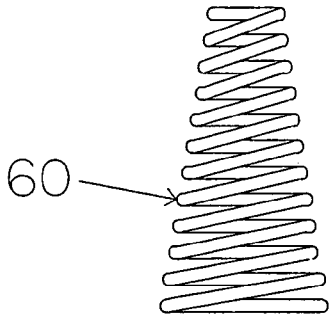
FIG. 25 is a front elevational view of the top weather seal subassembly tension bar conical spring component.
Figure 26A:
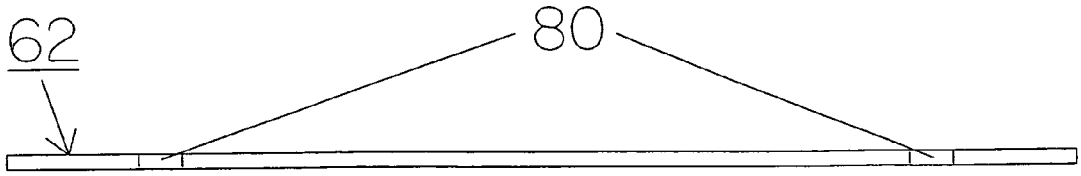
FIGS. 26A–26C are front elevational (back elevation view being identical thereto), top plan (bottom plan view being identical thereto), and left side elevational (right side elevational view being identical thereto) views, respectively, of the top weather seal subassembly sleeve retainer component.
Figure 26B:
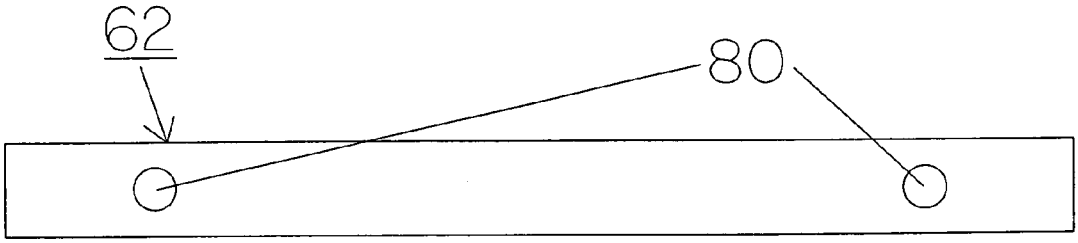
Figure 26C:
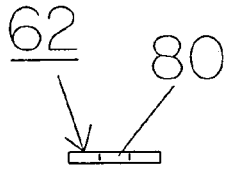

FIGS. 20A–20D show various views of tension bar 52. FIG. 20A is an interior view showing spring guide pin and retaining ring holes 62. FIG. 20B is a trailing side view. FIG. 20C is a top view. FIG. 20D is a bottom view showing spring guide slots 70. FIG. 21 is an enlarged partial cross sectional view of the spring guide pin 58P, spring guide 56, tension bar 52 and top module weather seal sleeve 50. FIG. 22A is a front view of tension bar spring guide pin 58P showing the pin stop or head 71, shaft 73 and retaining ring groove 72. FIGS. 22B–22C are top and bottom views, respectively, of tension bar spring guide pin 58P. FIGS. 23A–23B are side and top views, respectively, of tension bar spring guide pin retaining ring 58R. FIGS. 24A and 24B are front and right side views, respectively, of tension bar spring guide 56, the back and left side views are identical to FIGS. 24A and 24B, respectively. FIGS. 24A and 24B show tension bar spring guide pin hole 74, tension bar insertion tab 78, spring guide shaft 77, and spring guide stop 76. FIGS. 24C and 24D are top and bottom views, respectively, of tension bar spring guide 56. FIG. 25 is a side view of tension bar spring 60. FIG. 26A is a front view of sleeve retainer 62 showing spring guide holes 80. FIG. 26B is a top view of sleeve retainer 62 showing spring guide through holes 80. FIG. 26C is a leading edge or side view of sleeve retainer 62. Back, bottom and trailing side views of sleeve retainer 62 are identical to FIG. 26A, FIG. 26B and FIG. 26C, respectively.

Figure 27A:
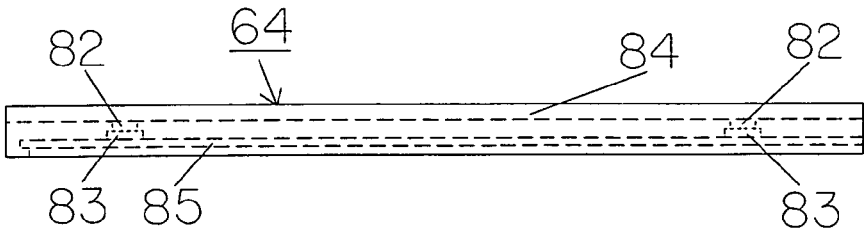
FIGS. 27A–27F are front elevational (back elevational view being a mirror image), top plan, bottom plan, cross sectional taken along 27D—27D of FIG. 27C, right side elevational, and left side elevational views, respectively, of the top weather seal subassembly base component.
Figure 27B:
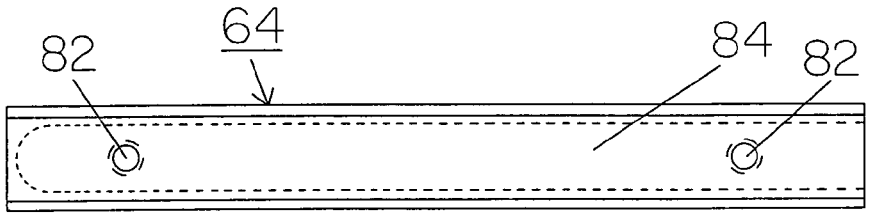
Figure 27C:
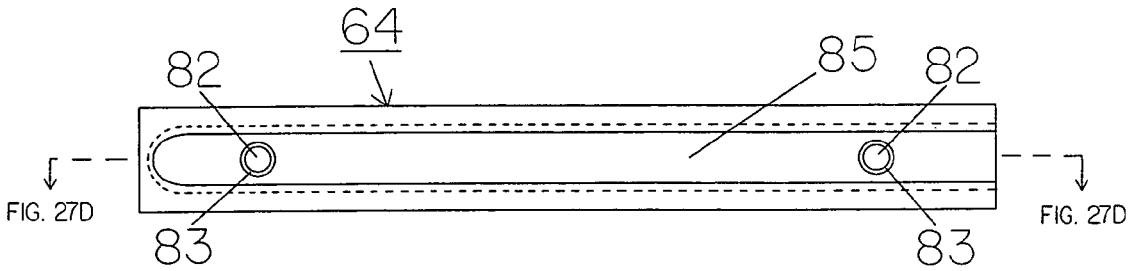
Figure 27D:
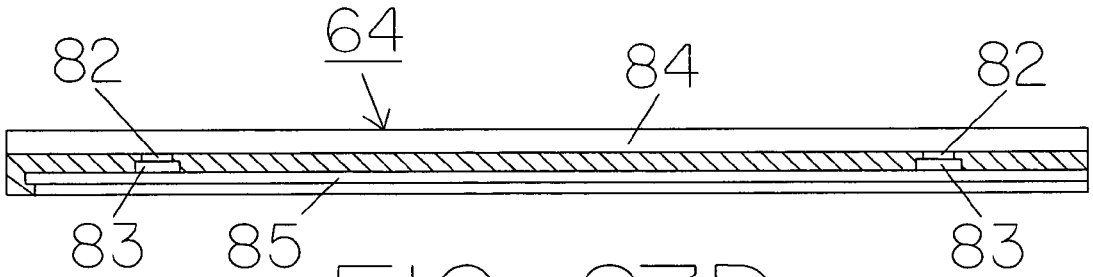
Figure 27E:
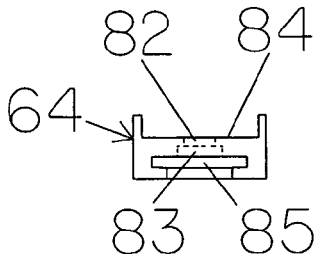
Figure 27F:
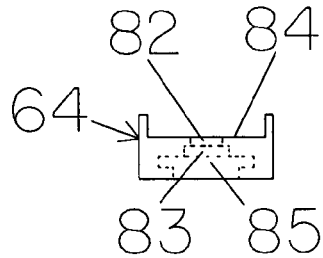
Figure 28A:
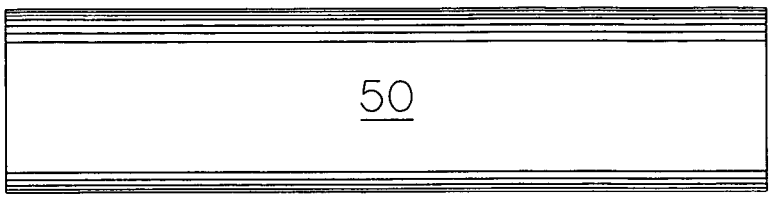
FIGS. 28A–28D are front elevational, top plan, right side elevational (left side elevational view being identical thereto), and bottom plan views, respectively, of the top weather seal subassembly sleeve component.
Figure 28C:
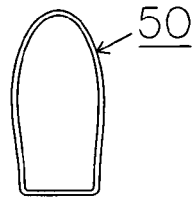
Figure 28B:
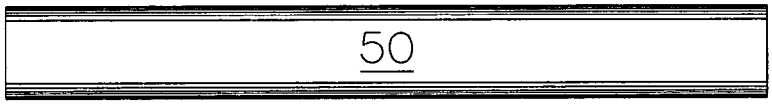
Figure 28D:
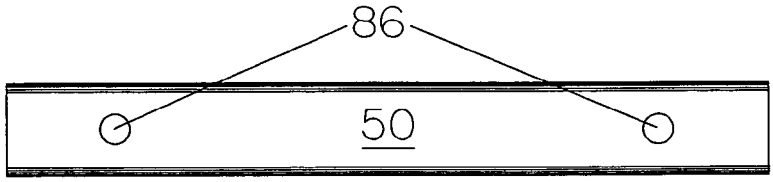

FIG. 27A is a front view of top module weather seal base 64. FIG. 27B is a top view of base 64 showing spring guide holes 82 and sleeve retainer channel 84. FIG. 27C is a bottom view of base 64 showing spring guide holes 82, spring guide stop counter bores 83 and interlocking groove 85. FIG. 27D is an interior side cross sectional view taken along 27D-27D of base 64, showing sleeve and retainer channel 84, interlocking groove 85, spring guide holes 82, and spring guide stop counter bores 83. The exterior side view is a mirror image of FIG. 27D. FIG. 27E is a leading or right side elevational view of base 64 showing sleeve and retainer channel 84 and interlocking groove 85. FIG. 27F is a trailing or left side elevational view of base 64 showing sleeve and retainer channel 84. FIG. 28A is front elevational view, FIG. 28B a top plan view, FIG. 28C a leading or right side elevational view, and FIG. 28D is a bottom plan view of top module weather seal 1 rubber sleeve 50, respectively.

Figure 17D:
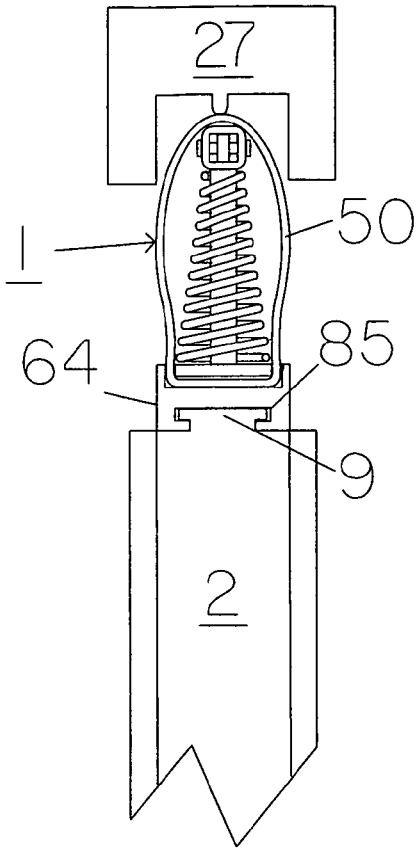
FIG. 17D is a right elevational or leading side view of the top module weather seal subassembly affixed to the top module subassembly showing seating of the sleeve portion of the top module weather seal into an upper track portion of the sliding glass patio door.
Figure 17E:
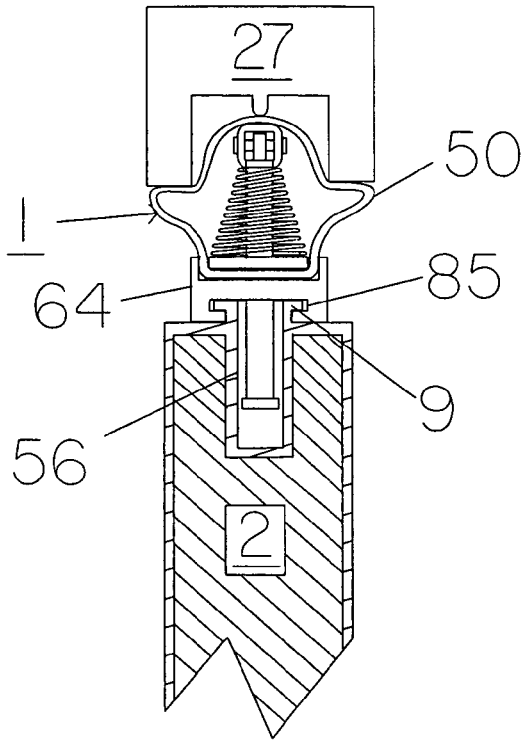
FIGS. 17E is a partial cross sectional view taken along 17E—17E of FIG. 17A.

As shown in FIG. 18F tension bar spring guides 56 are inserted through holes 82, 83, 80 in the bottom of base 64 (see FIG. 27C), sleeve 50, sleeve retainer 62, respectively, and the open center of conical tension bar springs 60. The insertion tab 78 of each tension bar spring guide 56 (see FIG. 24A) is then inserted into slot 70 (see FIG. 20D) in tension bar 52, and then attached by insertion of pin and retaining ring set 58 through holes in tension bar 52, and hole 74 in spring guide 56 within sleeve 50. Tension bar spring guide stop 76, the length of spring 60 and the diameter of sleeve 50 limit the extension of the tension bar 52. The length of travel is dependent upon the length of the tension bar spring guides 56, springs 60 and sleeve 50. Once the top module weather seal 1 is attached, pet access door panel 25 as shown in FIGS. 3A–3C is installed into the sliding glass patio door 21 by inserting and lifting the top module weather seal 1 at the uppermost portion of assembled pet access door panel 25 into the upper track portion 27 as shown in FIGS. 3D–3E. When lifting the assembled pet access door panel 25 the top module weather seal 1 is compressed. This causes sleeve 50 to compress against tension bar 52. Tension bar 52 compresses conical springs 60 by pushing down on spring guides 56 which are pushed through holes in the bottom of base 64, and through spring guide holes in top module 2, as shown in FIG. 17E. This compression of top module weather seal 1 allows the lowermost portion of assembled pet access door panel 25 to be lifted over then lowered into the lower track portion 29 of the sliding glass patio door. Once in place, as in FIG. 3F, the top module weather seal 1 tension bar springs 60 cause tension bar 52 and sleeve 50 to extend into and against the walls of upper track portion 27 of the sliding glass patio door as shown in FIGS. 17D and E. The movable sliding glass door on some patio doors may be lifted out of the lower track portion 29 when the movable sliding glass patio door is ajar as would be the case with a pet access door panel 25 installed. In order to prevent the movable sliding glass patio door 21 from being lifted with the pet access panel 25 installed, the invention is equipped with a hold-down wedge 54 located in the trailing side of tension bar 52. Once the assembled pet access door panel 25 is installed, patio door hold-down wedge 54 shown in FIGS. 19A–19E is extended by pulling on tab 66 attached to patio hold-down wedge body 65. When the movable sliding glass patio door 21 is closed against the assembled pet access door panel 25, the movable sliding glass patio door 21 slides under hold-down wedge 54. Hold-down wedge 54 prevents the movable sliding glass patio door 21 from being lifted out of its associated lower track portion 29. The combination of top module weather seal 1 and bottom module weather seal 5 permits the pet door panel 25 to fit into a range of frame heights, such as for example from 76.0 inches to 82.0 inches.

Figure 29C:
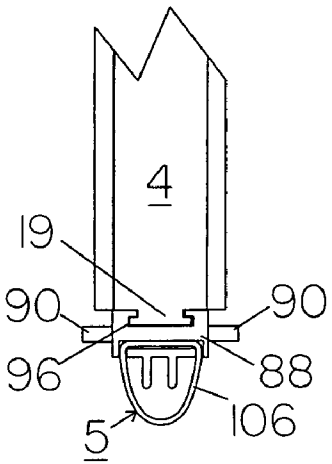
FIGS. 29A–29C are front elevational, left elevational or trailing side, and right elevational or leading side views, respectively, of the bottom weather seal subassembly affixed to the bottom module subassembly.
Figure 29A:
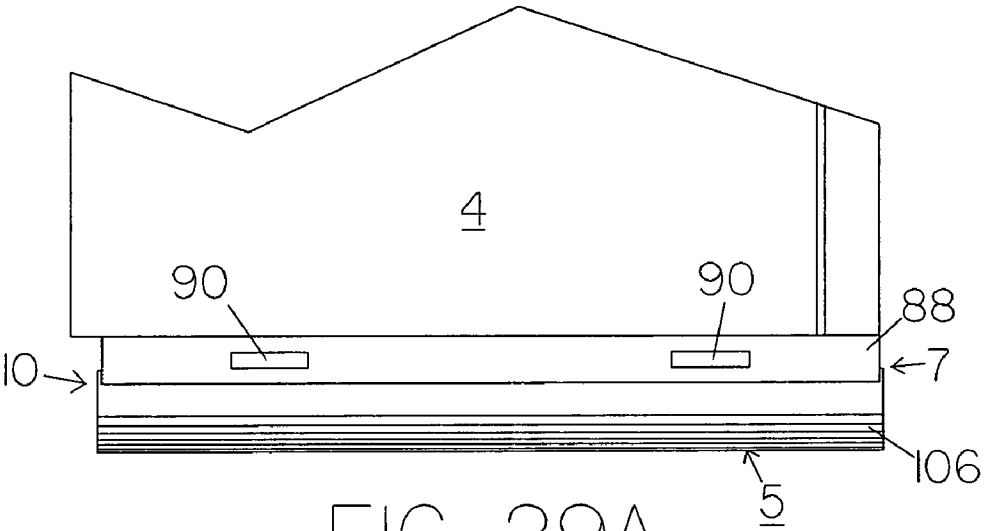
Figure 29B:
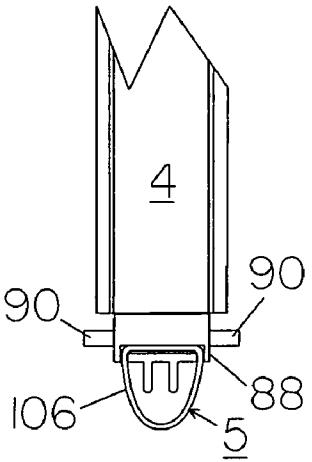

FIG. 29A is an interior front elevational view of bottom module weather seal 5 and a partial front elevational view of bottom module 4 showing rubber sleeve 106, base 88 with mounting brackets 90. FIG. 29B is a trailing or left side elevational view of bottom module weather seal 5, and a partial trailing side elevational view of bottom module 4 showing rubber sleeve 106, base 88 with mounting brackets 90. FIG. 29C is a leading or right side elevational view of bottom module weather seal 5 and a partial leading or right side elevational view of bottom module 4 showing rubber sleeve 106, base 88 with mounting brackets 90, interlocking groove 85, and interlocking tongue 19 on bottom module 4 installed in interlocking groove 96 of base 88.

Figure 30A:
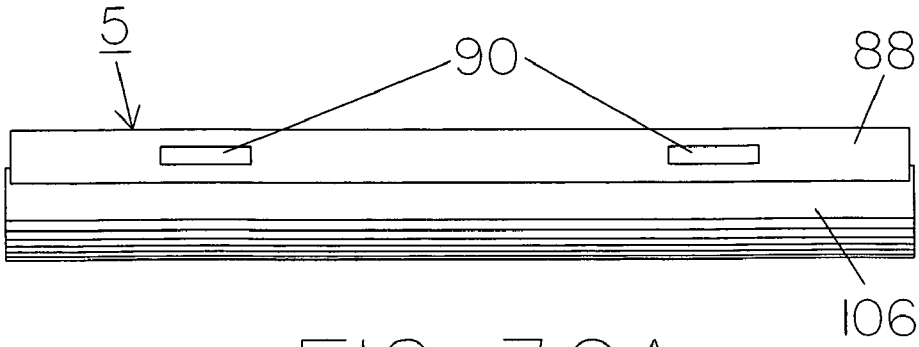
FIGS. 30A–30C are front elevational (back elevational view being identical thereto), top plan, and bottom plan views, respectively, of the bottom weather seal subassembly.
Figure 30B:
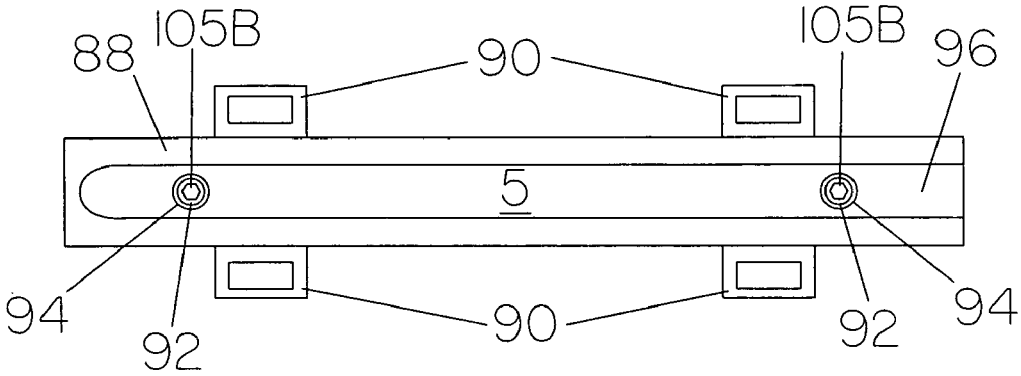
Figure 30C:
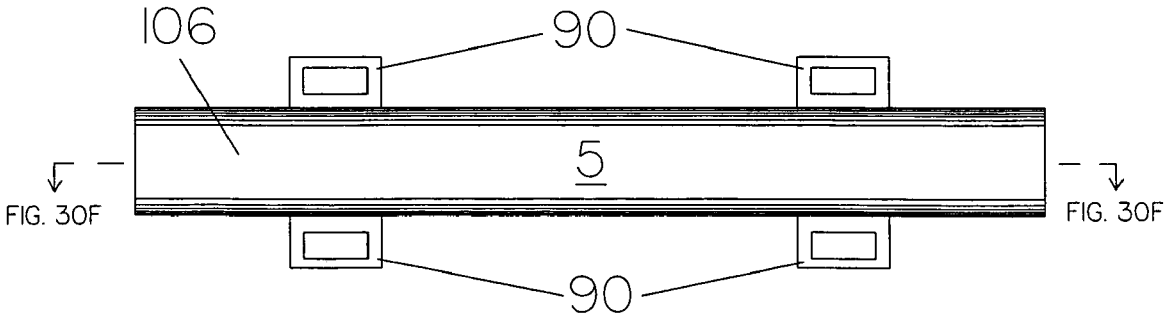
Figure 30D:
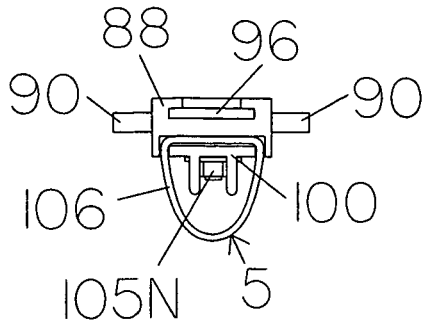
FIGS. 30D and 30E are right side elevational or leading side, and left side elevational or trailing side views of the bottom weather seal subassembly.
Figure 30E:
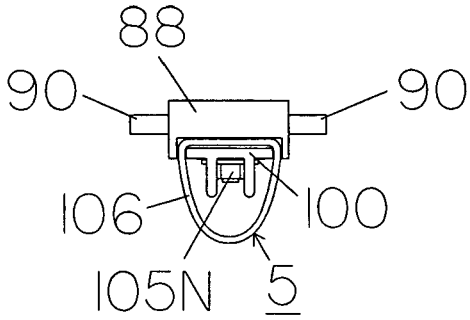
Figure 30F:
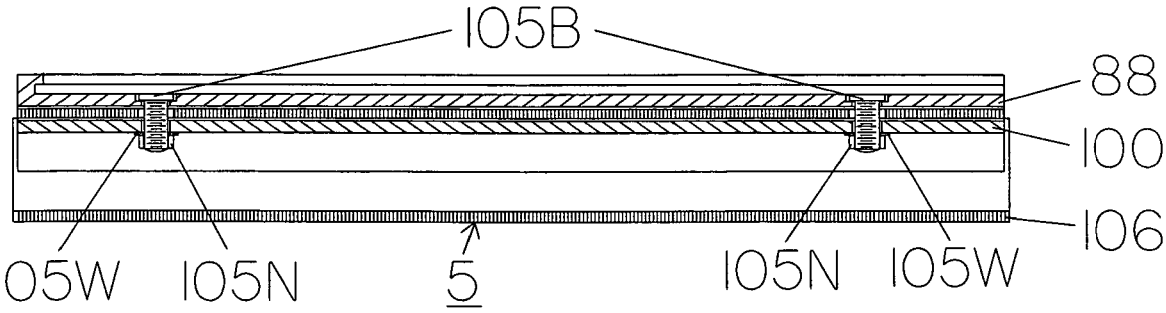
FIG. 30F is a cross sectional view taken along 30F—30F from FIG. 30C of the bottom weather seal subassembly.

FIG. 30A is an interior front elevational view of bottom module weather seal 5 showing rubber sleeve 106, base 88 with mounting brackets 90. FIG. 30B is a top plan view of bottom module weather seal 5, showing base 88 with interlocking groove 96, sleeve retainer bolt 105B, sleeve retainer bolt hole 92, sleeve retainer bolt head counter bore 94 and mounting brackets 90. FIG. 30C is a bottom plan view of bottom module weather seal 5 showing rubber sleeve 106 and mounting brackets 90. FIG. 30D is a leading or right side view of bottom module weather seal 5 showing rubber sleeve 106, sleeve retainer 100, sleeve retainer nut 105N, base 88 with interlocking groove 96 and mounting brackets 90. FIG. 30E is a trailing or left side view of bottom module weather seal 5 showing rubber sleeve 106, sleeve retainer 100, sleeve retainer nut 105N, and base 88 with mounting brackets 90. FIG. 30F is an interior cross sectional view of bottom module weather seal 5 showing rubber sleeve 106, sleeve retainer 100, sleeve retainer nut 105N, sleeve retainer washer 105W, sleeve retainer bolt 105B and base 88.

Figure 31A:
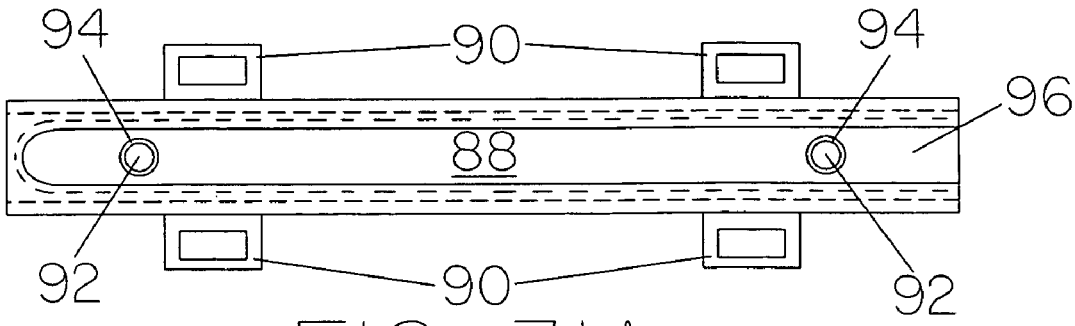
FIGS. 31A–31E are top plan, bottom plan, front elevational (back elevational view being a mirror image), right side elevational, and left side elevational views, respectively, of the bottom weather seal subassembly base component.
Figure 31B:
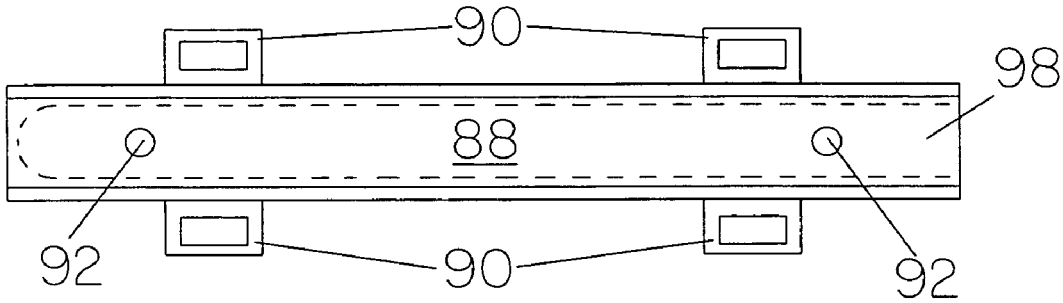
Figure 31C:
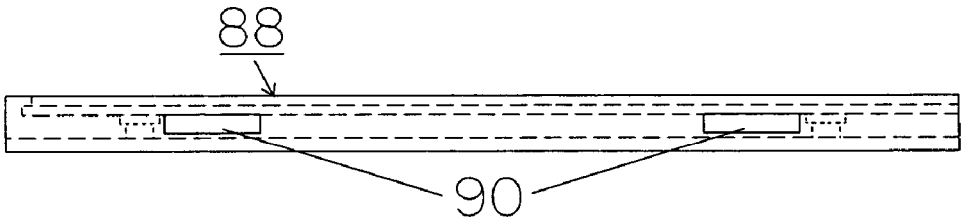
Figure 31D:
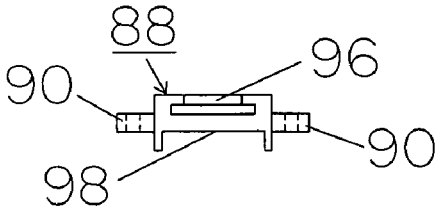
Figure 31E:
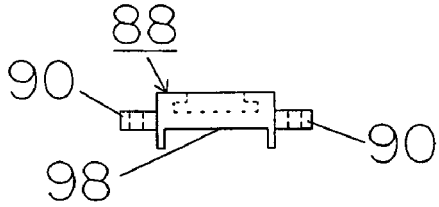

FIG. 31A is a top plan view of bottom module weather seal 5 base 88 showing interlocking groove 96, retainer bolt hole 92, retainer bolt head counter bore 94 and mounting brackets 90. FIG. 31B is a bottom plan view of bottom module weather seal 5 base 88 showing sleeve and retainer channel 98, sleeve retainer bolt holes 92 and mounting brackets 90. FIG. 31C is an interior front elevational view of bottom module weather seal 5 base 88 showing mounting brackets 90. FIG. 31D is a leading side or right side elevational view of bottom module weather seal 5 base 88 showing interlocking groove 96, sleeve and retainer channel 98 and mounting brackets 90. FIG. 31E is a trailing side or left side elevational view of bottom module weather seal 5, base 88 showing sleeve and retainer channel 98, and mounting brackets 90.

Figure 32A:
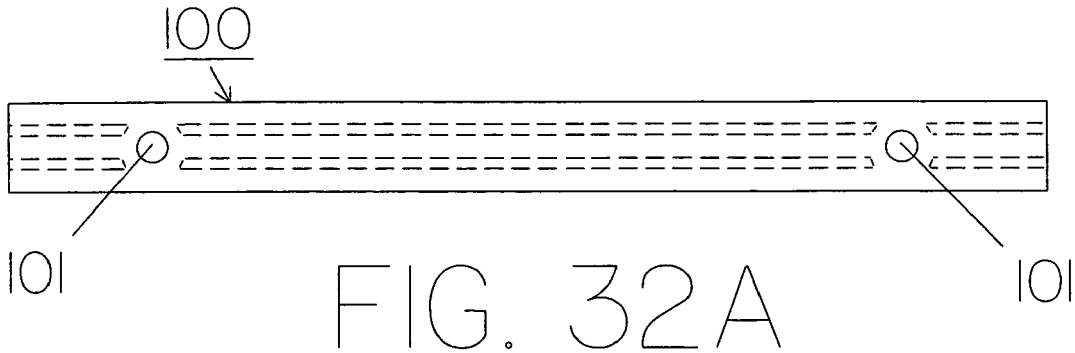
FIGS. 32A–32D are top plan, bottom plan, front elevational (back elevational view being identical thereto), and right side elevational (left side elevational being identical thereto), views, respectively, of the bottom weather seal subassembly sleeve retainer component.
Figure 32B:
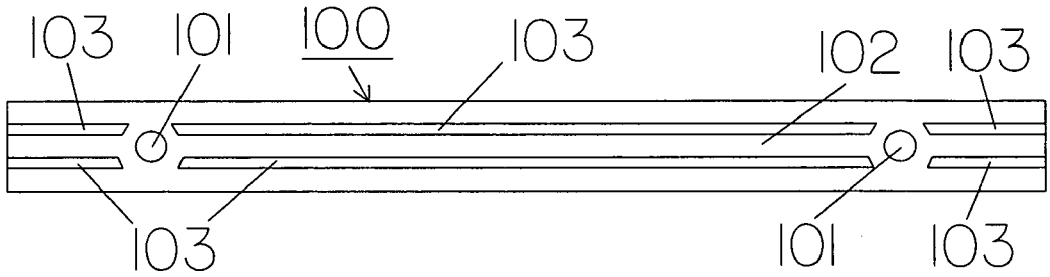
Figure 32C:
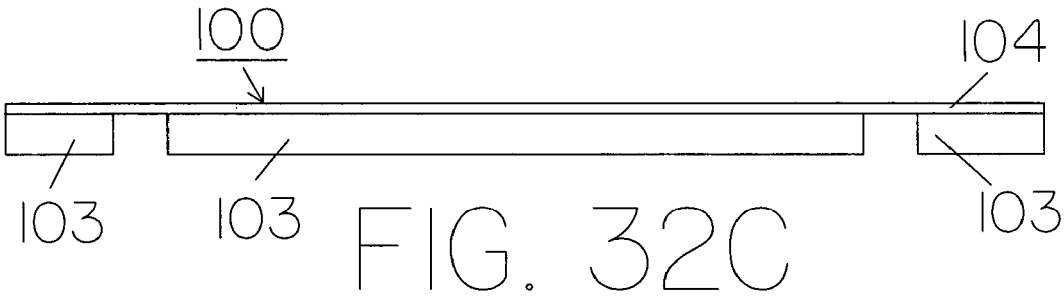
Figure 32D:
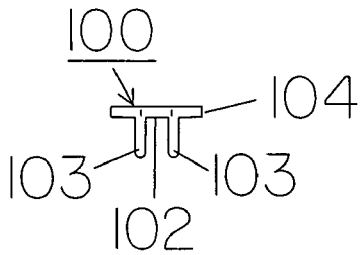

FIG. 32A is a top plan view of bottom module weather seal 5 retainer 100 showing retainer bolt holes 101. FIG. 32B is a bottom plan view of retainer 100 showing parallel seal channel ridges 103, seal channel 102, and sleeve retainer bolt holes 101. FIG. 32C is a front elevational view of bottom module weather seal sleeve retainer 100 showing seal channel ridges 103 and sleeve retainer flange 104. FIG. 32D is a leading side or right side elevational view of bottom module weather seal 5 sleeve retainer 100 showing seal channel ridges 103, seal channel 102, and sleeve retainer flange 104.

Figure 33A:
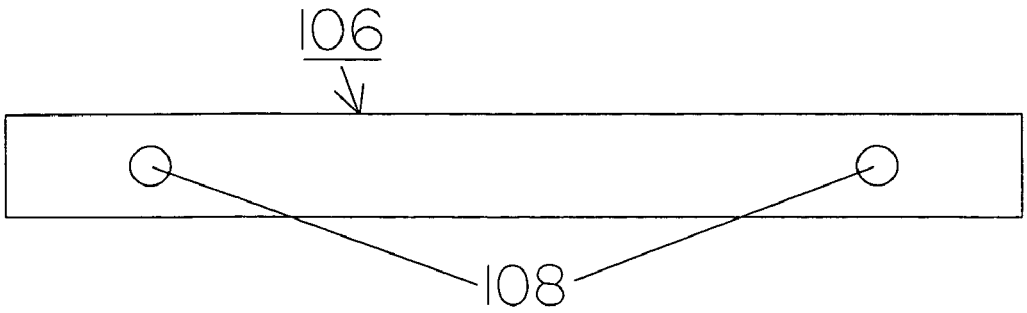
FIGS. 33A–33D are top plan, bottom plan, front elevational (back elevational view being identical thereto), and right side elevational (left side elevational view being identical thereto) views, respectively, of the bottom weather seal subassembly sleeve component.
Figure 33B:
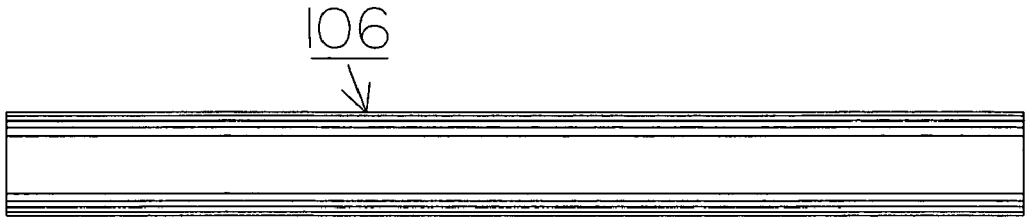
Figure 33C:
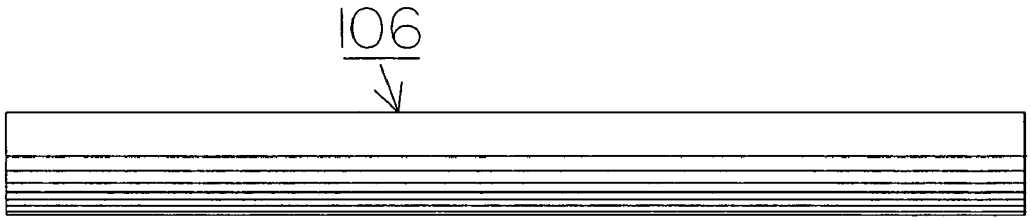
Figure 33D:
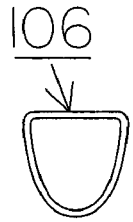

FIG. 33A is a top plan view of bottom module weather seal 5 rubber sleeve 106 showing retainer bolt holes 108. FIG. 33B is a bottom view of bottom module weather seal 5 rubber sleeve retain 106. FIG. 33C is a front elevational view of bottom module weather seal 5 rubber sleeve 106. FIG. 33D is a leading or right side elevational view of bottom module weather seal 5 rubber sleeve 106.

As shown in FIG. 30F, rubber sleeve 106 is retained in sleeve and retainer channel 98 by sleeve retainer bolts 105B inserted through base 88 sleeve retainer bolt holes 92, sleeve retainer bolt holes 108 in rubber sleeve 106 and sleeve retainer bolt holes 101 in sleeve retainer 100. Sleeve retainer washers 105W and nuts 105N compress sleeve retainer 100 sandwiching rubber sleeve 106 between sleeve retainer 100 and base 88 within sleeve and retainer channel 98. As shown in FIG. 3D, when installed into the sliding glass patio door the bottom module weather seal 5 located at the lowermost portion of pet access door panel 25 is lowered into lower track portion 29 of the sliding glass patio door. In so doing, rubber sleeve 106 of bottom module weather seal 5 is compressed over the guide rail in lower track 29 portion of the sliding glass patio door 21, and into seal channel 102 between parallel seal channel ridges 103. The flexible nature of rubber sleeve 106 causes the outer walls to bulge filling the channel in lower track portion 29 of the sliding glass patio door creating an effective weather seal.

Figure 34B:
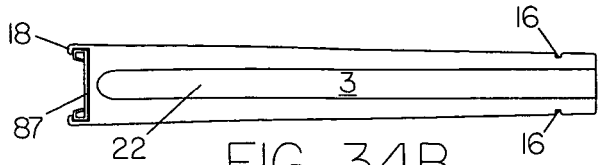
FIG. 34B is a top plan view of the center module with the universal locking assembly installed, for a preferred embodiment of the invention, bottom plan view being identical thereto.
Figure 34C:
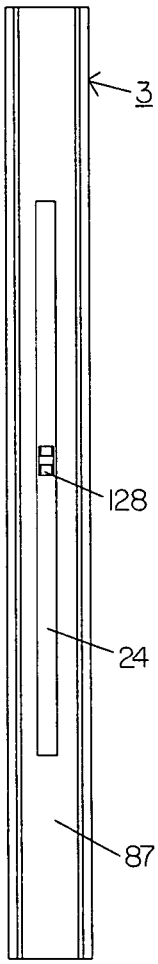
FIGS. 34A, 34C, and 34D are front or interior, left or trailing side, and right or leading side elevational views, respectively, of the center module subassembly with universal locking assembly installed, for a preferred embodiment of the invention.
Figure 34A:
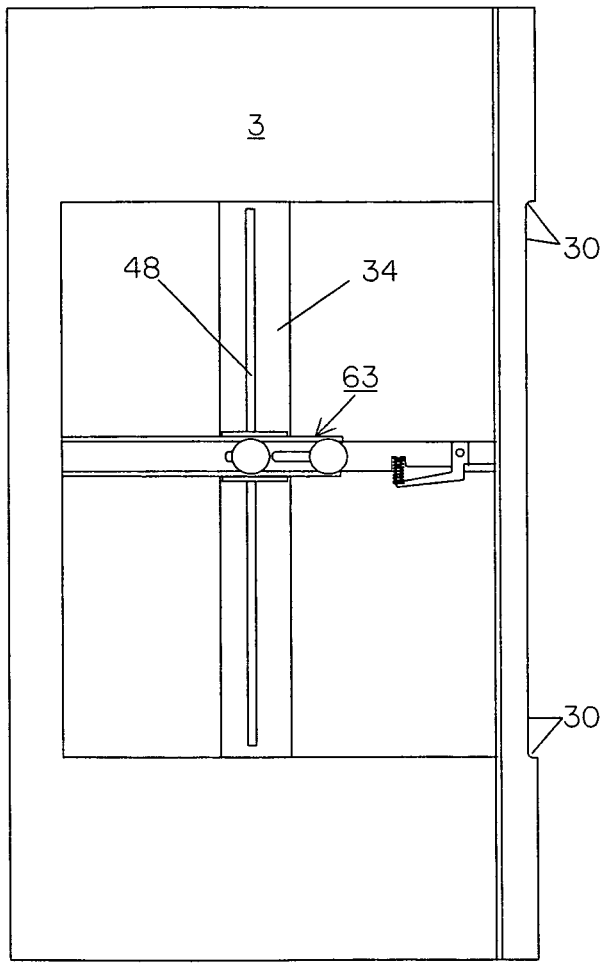
Figure 34D:
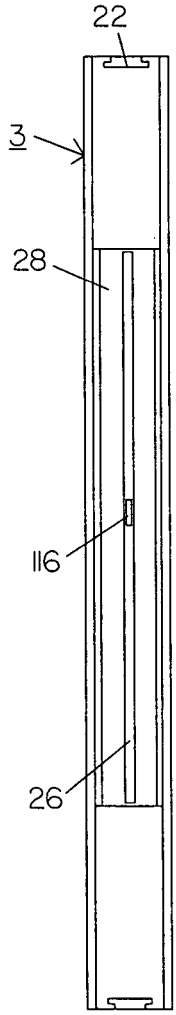

FIGS. 34A–34D show various views of assembled center module 3 configured in the preferred embodiment of the invention with a universal locking assembly 63 installed. FIG. 34A is a front elevational view of assembled center module 3 shown with access door 32 removed exposing universal locking assembly 63, the latter including carrier vertical recess 34, and vertical adjustment slot 48. FIG. 34B is a top plan view of assembled center module 3, the bottom plan view being identical. FIG. 34C is a trailing or left side elevational view of assembled center module 3 showing universal locking assembly catch 128 and associated vertical adjustment slot 24. FIG. 34D is a leading or right side elevational view of assembled center module 3 showing a recess 30 and cavity 28 designed to accommodate externally mounted sliding glass patio door catches and mounting hardware. Universal locking assembly latch 116 is shown in vertical adjustment slot 26 in FIG. 34D.

Figure 35A:
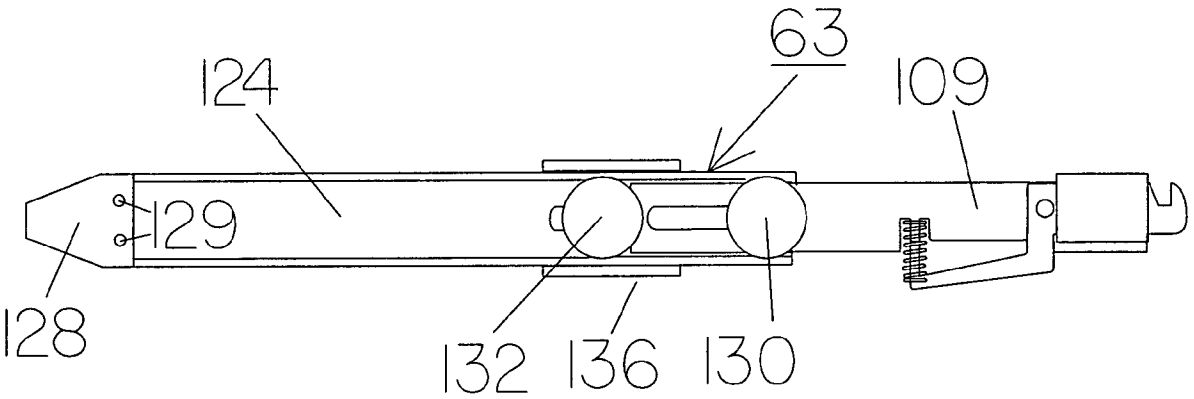
FIGS. 35A and 35B are front elevational, and top plan views, respectively, of the universal locking assembly.
Figure 35B:
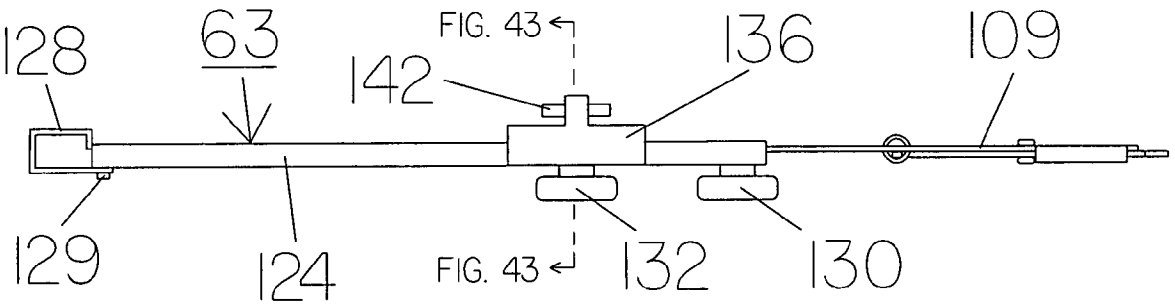
Figure 41A:
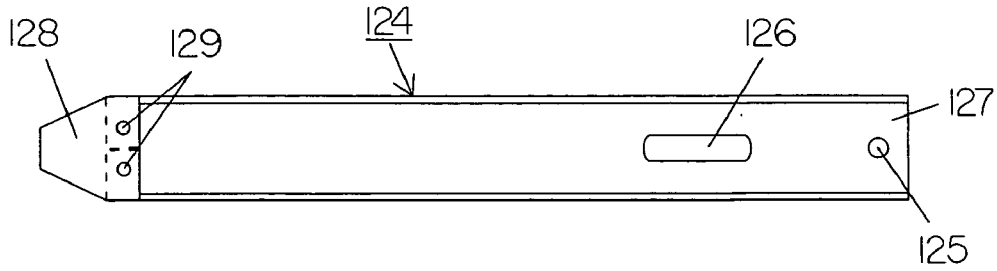
FIGS. 41A–41C are front elevational, top plan, and right side elevational views, respectively, of the universal locking assembly floating catch subassembly.
Figure 41B:
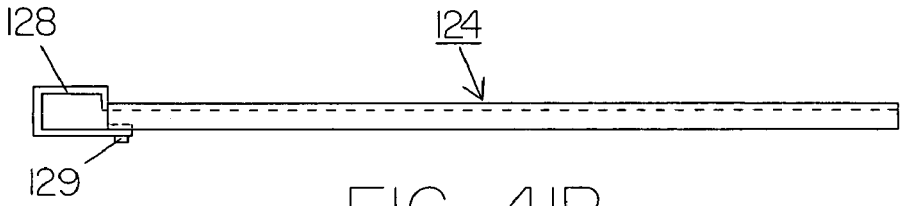
Figure 41C:
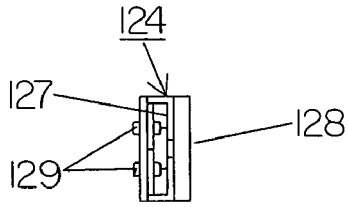
Figure 41D:
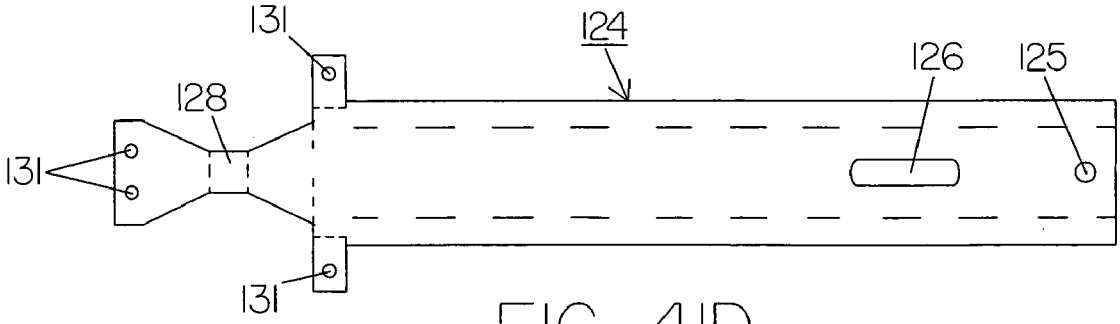
FIG. 41D shows a top plan view of the universal locking assembly floating catch subassembly catch bar component in blank form.
Figure 42:
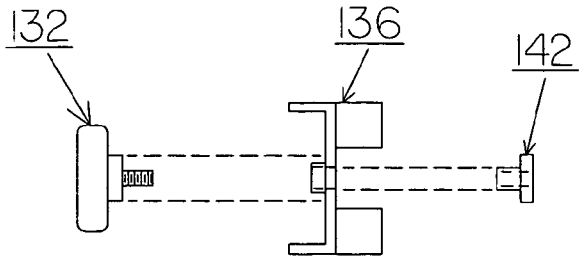
FIG. 42 is an exploded assembly view of the universal locking assembly carrier subassembly.
Figure 44A:
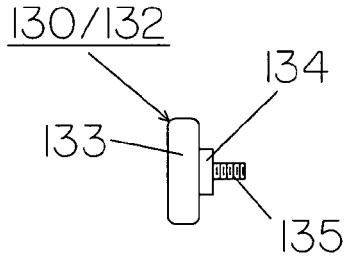
FIGS. 44A–44C are front elevational, top plan, and bottom plan views, respectively, of the universal locking assembly vertical adjustment and horizontal adjustment knob component.
Figure 44B:
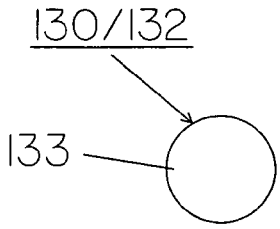
Figure 43:
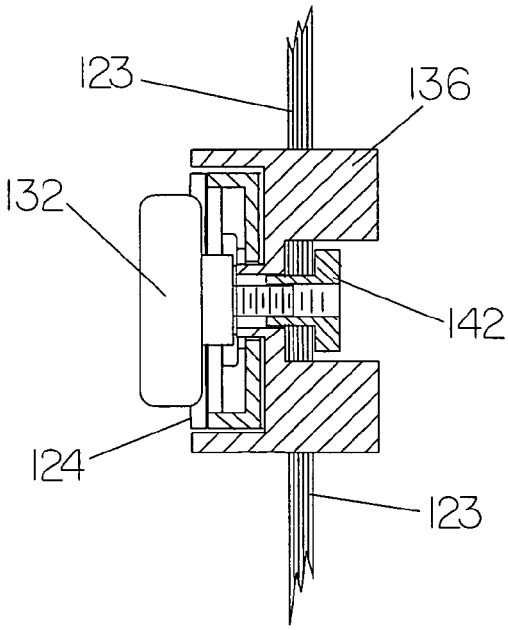
FIG. 43 is a partial cross sectional view of the universal locking assembly carrier subassembly along 43—43 of FIG. 35B.
Figure 44C:
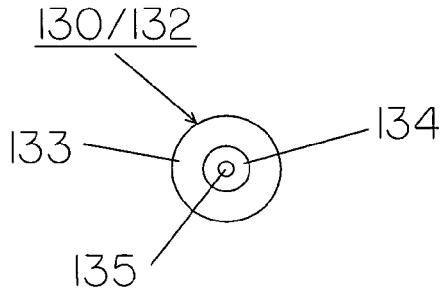
Figure 45A:
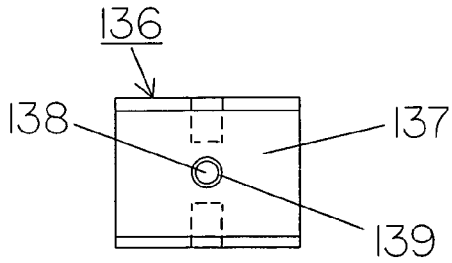
FIGS. 45A–45C are front elevational, right side elevational, and top plan views, respectively, of the universal locking assembly carrier subassembly carrier component.
Figure 46A:
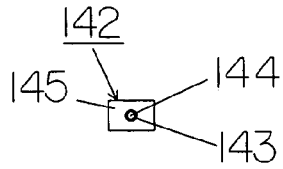
FIGS. 46A–46C are front elevational, right side elevational, and top plan views, respectively, of the universal locking assembly carrier subassembly carrier nut component.
Figure 45B:
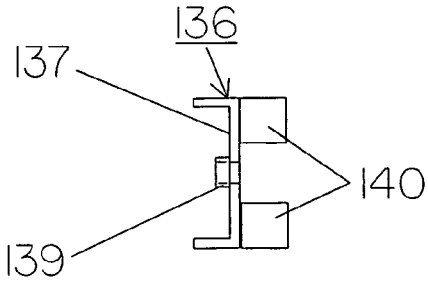
Figure 46B:
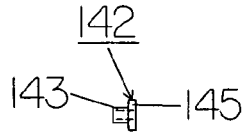
Figure 45C:
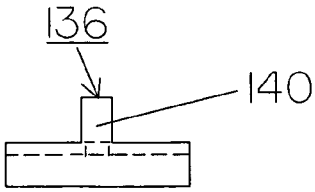
Figure 46C:
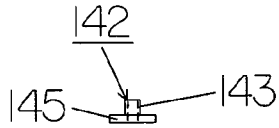

FIG. 35A is a front or interior side view of universal locking assembly 63 and FIG. 35B is a top view of universal locking assembly 63. Catch loop 128 is an integral part of floating catch 124 and is held in place by catch loop rivets 129 as shown in FIGS. 35A–B and 41A–C. FIG. 41D shows floating catch 124 as a steel blank which is formed along indicated fold lines. Once formed, catch loop 128 is held together by rivets 129 in rivet holes 131 as shown in FIGS. 41C and 41D. Vertical adjustment knob 132, as shown in FIGS. 35A–B, is designed to tighten and hold universal locking assembly 63 in place or loosen to allow vertical movement and adjustment of universal locking assembly 63 (see FIG. 47B). Vertical adjustment knob 132 consists of a grip portion 133, a hub portion 134 and a threaded stud portion 135 as shown in FIGS. 44A–C. The threaded portion 135 of vertical adjustment knob 132 fits through lateral float slot 126 in floating catch 124 shown in FIG. 41A, and through carrier 136 FIGS. 35B, 42, 43 and 45A–C. The threaded portion 135 of vertical adjustment knob 132 fits through carrier nut hole 138 in carrier nut hole collar 139 of carrier 136, FIG. 45A. After passing through lateral float slot 126 in floating catch 124 and carrier nut hole 138 in carrier nut hole collar 139 of carrier 136, threaded portion 135 of vertical adjustment knob 132 is inserted through vertical adjustment slot 48 in center module 3 of the invention as shown in FIG. 34A. After inserting threaded stud 135 of vertical adjustment knob 132 through lateral float slot 126 of floating catch 124 and carrier nut hole 138 in carrier nut hole collar 139 of carrier 136, the subassembly is placed onto the front or interior side of center module 3. Catch loop 128 of floating catch 124 is inserted through vertical adjustment slot 24 in the left or trailing side of center module 3 as shown in FIG. 34C. The subassembly consisting of carrier 136, floating catch 124 and vertical adjustment knob 132 is placed against the interior side of center module 3 on a lateral plane with carrier 136 seated in vertical carrier recess 34 of center module 3. In so doing, threaded portion 135 of vertical adjustment knob 132 and vertical adjustment guide tabs 140 of carrier 136, FIGS. 45A–C, are inserted through vertical adjustment slot 48 within vertical carrier recess 34 on the interior side wall of center module 3 and threaded into carrier nut 142, which is located in vertical adjustment slot 48 on the opposite side of interior side wall 123 of center module 3, as shown in partial cross sectional view FIG. 43.

Figure 47A:
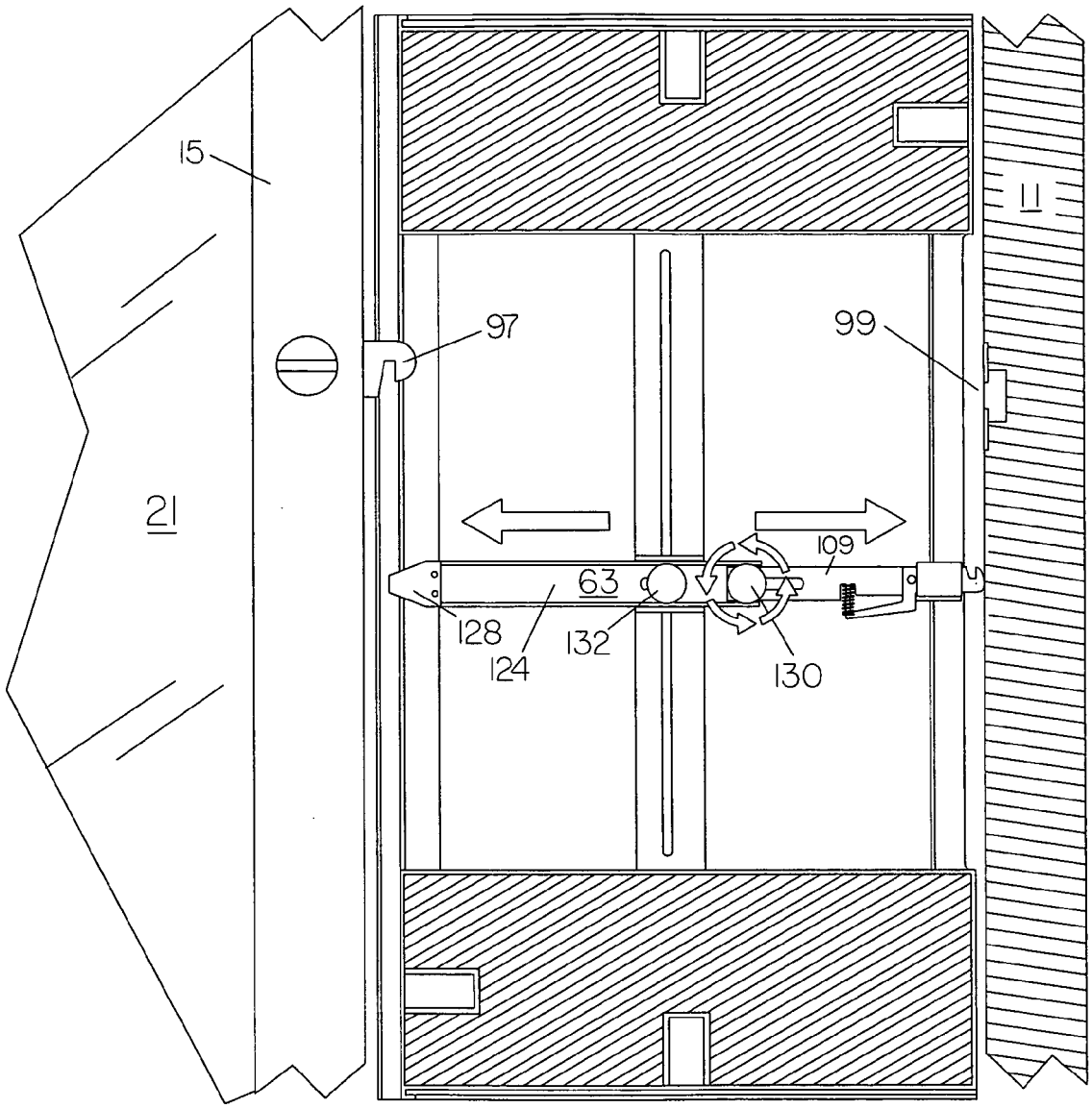
FIGS. 47A–47C are partial cross sectional front views, respectively, taken along the longitudinal axis of the center module and sliding glass patio door frame showing the universal locking assembly.
Figure 47B:
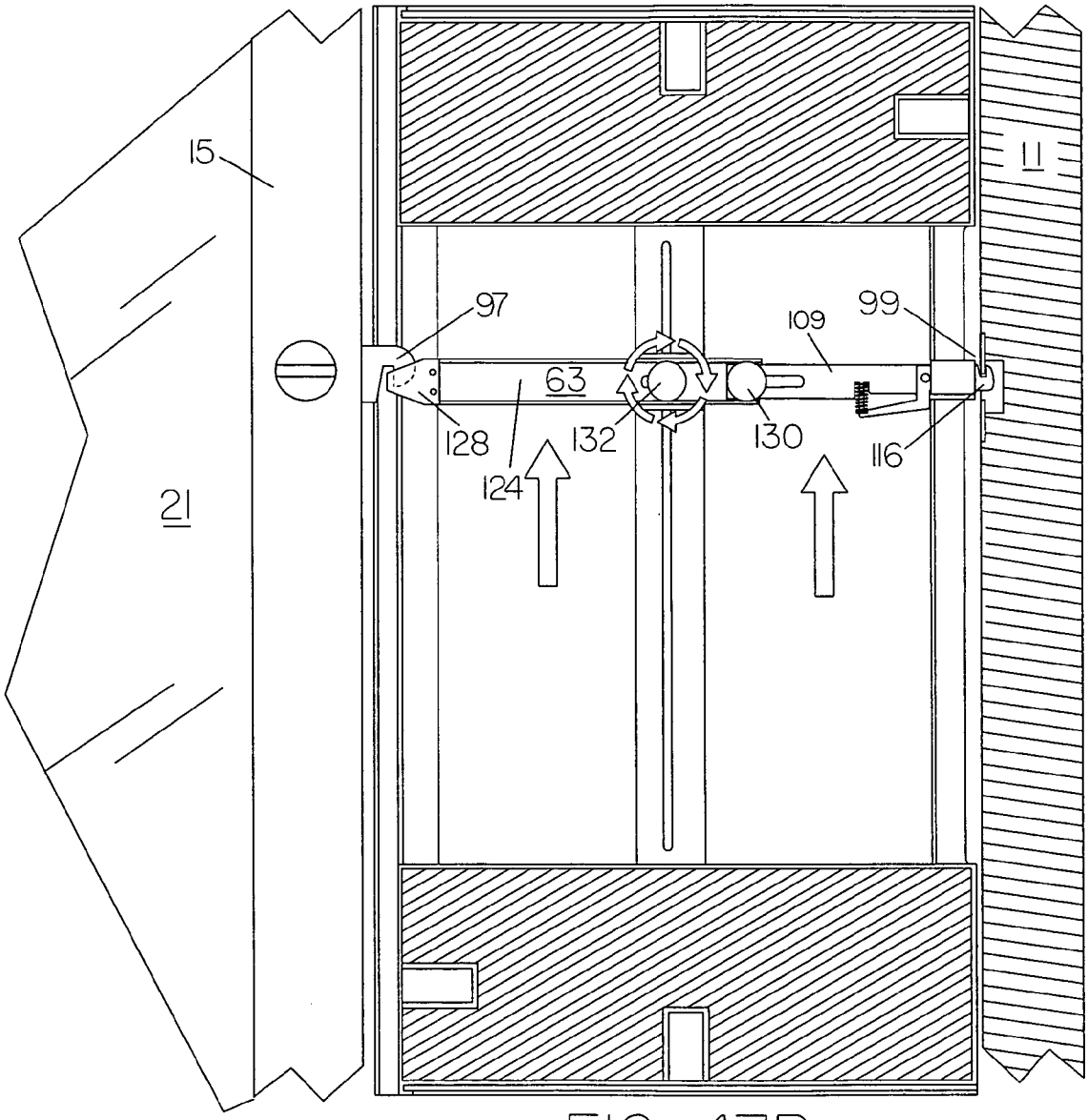
Figure 47C:
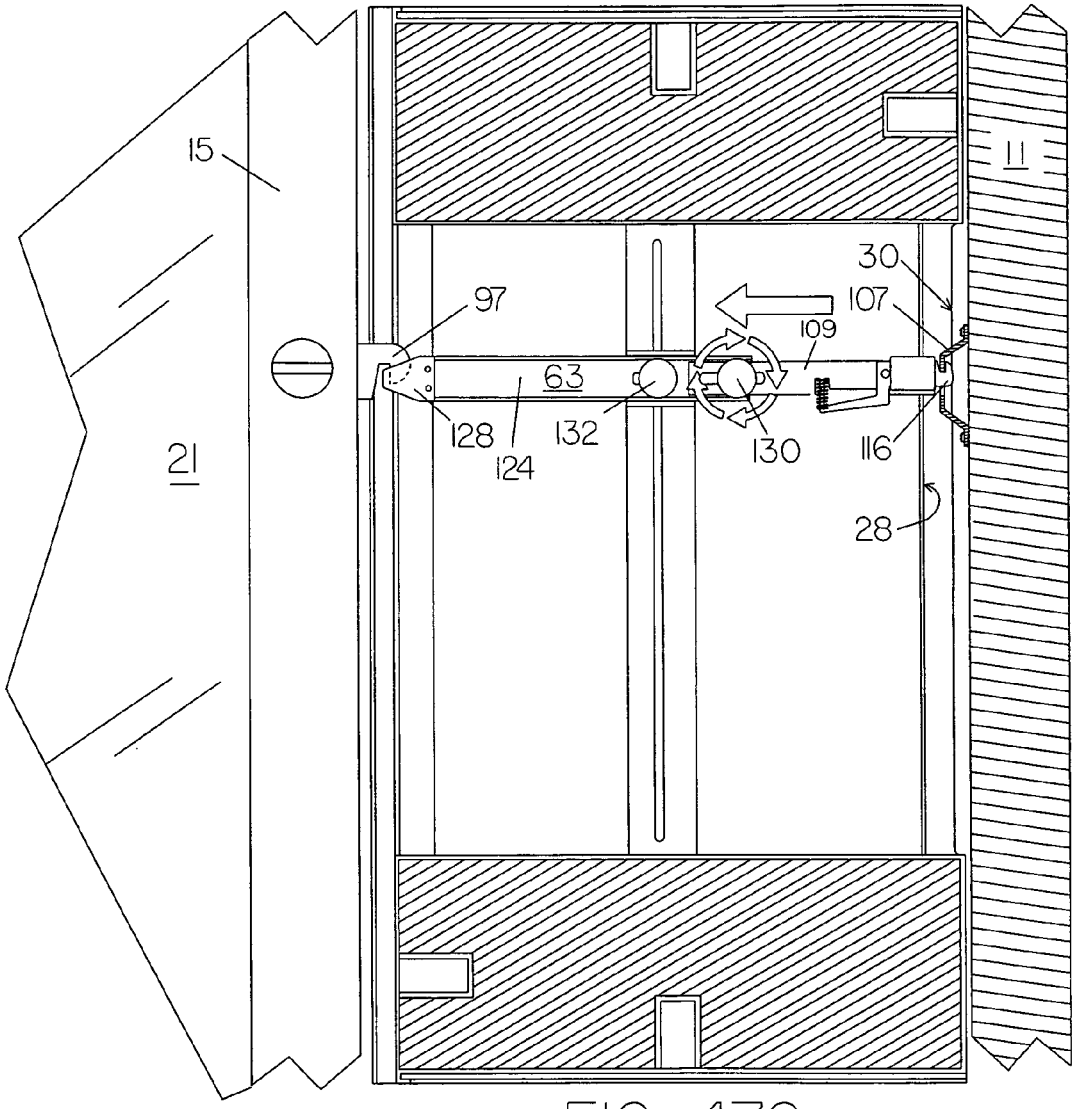

With reference to FIGS. 47A–C, when vertical adjustment knob 132 is turned counter clockwise it is loosened and permits universal locking assembly 63 to move vertically in vertical adjustment slot 48 in the interior side wall of center module 3. This vertical movement is necessary so that the universal locking assembly may be adjusted to align with various latch and catch mechanism locations as produced by various sliding glass patio door manufacturers. When installing the preferred embodiment of the invention with universal locking mechanism, it is necessary to align the catch loop 128 of floating catch 124 of universal locking assembly 63 with latch 97 in leading side frame 15 of movable sliding door 21, as shown in FIGS. 47A and 47B. When catch loop 128 in floating catch 124 of universal locking assembly 63 has been aligned with latch 97 in leading side frame 15 of movable sliding door 21 universal locking assembly can be locked in place by turning vertical adjustment knob 132 in a clockwise direction as shown in FIG. 47B. In so doing, vertical adjustment knob 132 engages and pulls carrier 136 and carrier nut 142 together in a vice like action trapping the interior side wall 123 of center module 3, as shown in FIG. 43. This vice like action prevents universal locking assembly 63 from moving on a vertical plane, thereby keeping catch loop 128 in floating catch 124 aligned with latch 97 in leading frame 15 of movable sliding door 21 to permit latch 97 to engage catch loop 128, whenever movable sliding door 21 is opened and closed as shown in FIG. 47B. Carrier 136 has a channel 137 formed by side walls. This channel is designed to contain and guide floating catch 124. Lateral float slot 126 fits over carrier nut hole collar 139 allowing floating catch 124 to travel on a lateral plane within channel 137 of carrier 136. When vertical adjustment knob 132 is turned clockwise to pull carrier 136 and carrier nut 142 together against interior side wall 123 of center module 3, vertical adjustment knob hub 134 seats against carrier nut hole collar 139, and not against floating catch 124, permitting floating catch 124 to travel laterally the distance permitted by the length of lateral float slot 126, when universal locking assembly 63 is locked in place as shown in FIG. 43. In addition to catch loop 128, catch loop rivets 129 and lateral float slot 126 floating catch 124 also has a threaded lateral adjustment knob hole 125, and the side walls form a channel 127 as shown in FIG. 41A.

Latch assembly 109, as shown in FIGS. 35A–B and 36A–C, is attached to floating catch 124 by lateral adjustment knob 130. Latch bar 110 of latch assembly 109, FIGS. 36A–B, fits into channel 127 of floating catch 124 as shown in FIGS. 35A–B. With latch bar 110 of latch assembly 109 seated within channel 127 of floating catch 124, the threaded portion 135 of lateral adjustment knob 130 (see FIG. 44A) is inserted through lateral adjustment slot 111 in latch bar 110 of latch assembly 109 (see FIG. 36A), and threaded into threaded lateral adjustment knob hole 125 in floating catch 124. When vertical adjustment knob 130 is turned in a clockwise direction, it threads into threaded vertical adjustment knob hole 125 in floating catch 124, and vertical adjustment knob hub 134 of vertical adjustment knob 132 (see FIG. 44A), is tightened against latch bar 110 of latch assembly 109 locking it in place onto floating catch 124, as shown in FIGS. 35A–B. In order to accommodate the various latch and catch mechanism locations on sliding glass patio doors 21 as produced by various manufacturers, a degree of lateral adjustment is necessary. In particular, the type and mounting configuration of sliding glass patio door latch and catch mechanisms varies relative to the distance between the sliding patio door latch and catch. When lateral adjustment knob 130 is loosened, latch assembly 109 can be adjusted on a lateral plane to extend or retract with the distance of travel limited by the length of lateral adjustment slot 111 in latch bar 110 of latch assembly 109 to engage either a flush mounted sliding glass patio door catch as shown in FIGS. 47A–B, or an externally mounted catch as shown in FIG. 47C.

Figure 36A:
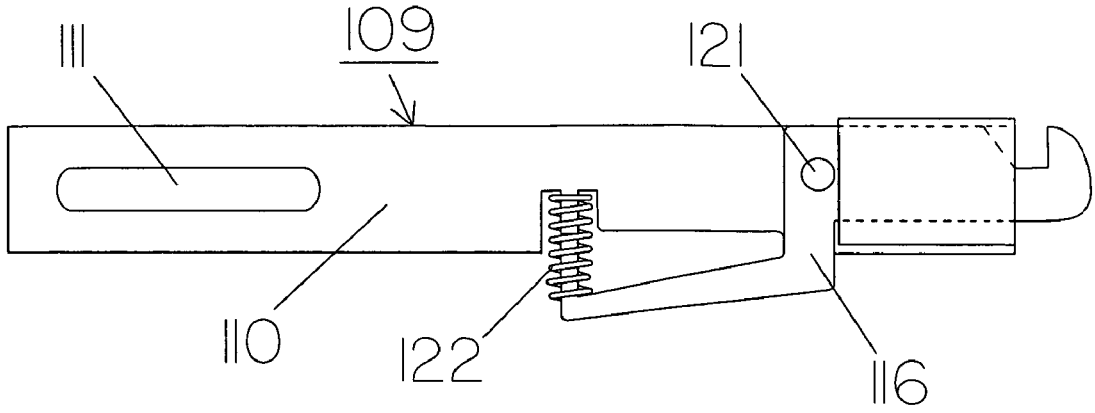
FIGS. 36A–36C are front elevational, top plan, and right side elevational views, respectively, of the universal locking assembly latch subassembly.
Figure 36B:
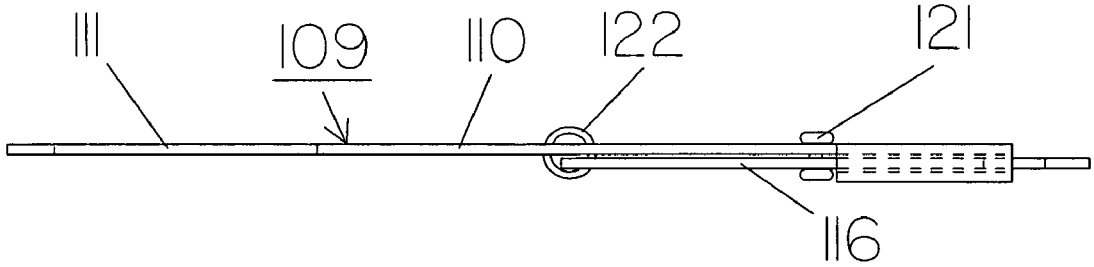
Figure 36C:
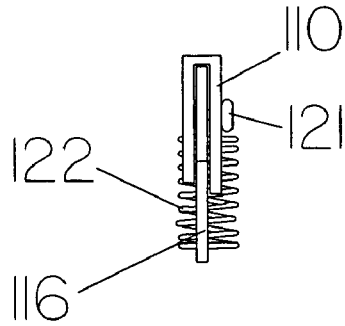
Figure 37A:
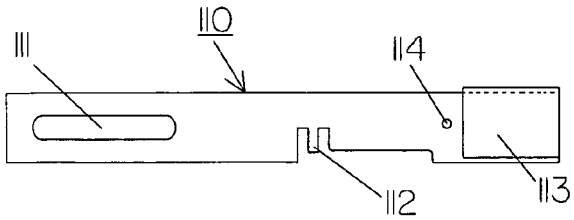
FIGS. 37A–37C are front elevational, top plan, and right side elevational views, respectively, of the universal locking assembly latch subassembly latch bar component.
Figure 38A:
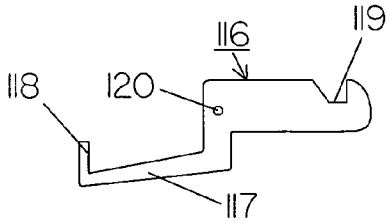
FIGS. 38A–38C are front elevational, top plan, and right side elevational views, respectively, of the universal locking assembly latch subassembly latch arm component.
Figure 37B:
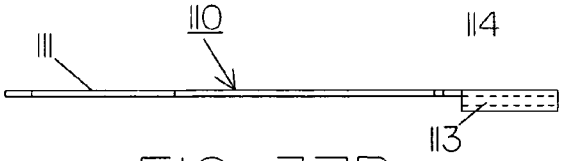
Figure 38B:
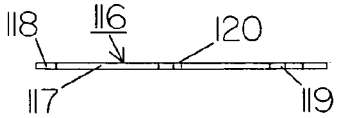
Figure 37C:
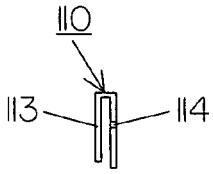
Figure 38C:
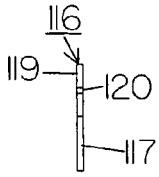
Figure 39:
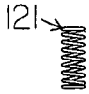
FIG. 39 is a front elevational view of the universal locking assembly latch subassembly latch spring component.
Figure 40:
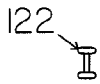
FIG. 40 is a front elevational view of the universal locking assembly latch subassembly pin component.

Latch assembly 109 consists of latch bar 110, latch 116, latch rivet 121 and latch spring 122 (see FIG. 36A). The latch bar 110 is a steel blank cut and formed to provide a lateral adjustment slot 111, latch spring retainer 112, latch rivet hole 114 and latch guide and stop 113 (see FIG. 37A). The latch 116 is fastened to latch bar 110 by rivet 122 through rivet hole 120 in latch 116 and rivet hole 114 in latch bar 110. Latch spring 121 is held in place within latch spring retainer 112 by latch arm spring guide 118 in latch arm 117 (see FIGS. 38A and 38B). When latch arm 117 is pulled against latch bar 110, spring 121 is compressed and latch 116 pivots on rivet 122 with a lever action. This lever action causes latch notch portion 119 of latch 116 to rotate away disengaging from sliding glass door catch 99 (see FIG. 47A–B) or catch 107 (see FIG. 47C), permitting the present pet door 25 to be removed from the sliding glass patio door 21. During installation of the pet door 25, the latch spring 121 pushing against latch arm 117 of latch 116 allows latch 116 to drop down and snap back into place engaging catch 99 (see FIG. 47A–B) or catch 107 (see FIG. 47C). As shown in FIGS. 47B and C, once aligned and engaged with sliding glass patio door latch 97 and either catch 99 or 107, universal locking assembly 63 forms a steel bridge between the original equipment manufacturers patio door latch and catch. As noted earlier, lateral float slot 126 allows floating catch 110 to float in channel 137 around carrier nut hole collar 139 of carrier 136. This floating feature eliminates any stress on pet door panel 25 when attempt is made to open movable sliding door 21 while locked, whereby all energy is transferred directly between the original equipment manufacturers latch and catch.

Figure 48C:
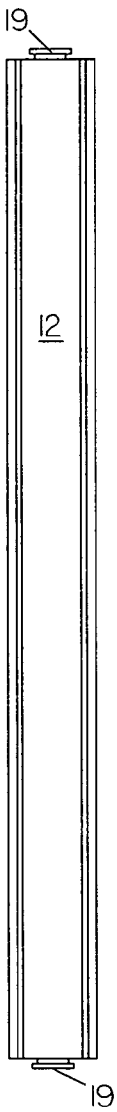
FIGS. 48A, 48C, and 48D are front, left side and right side elevational views, respectively, of the bottom module subassembly with the pet portal assembly removed.
Figure 48A:
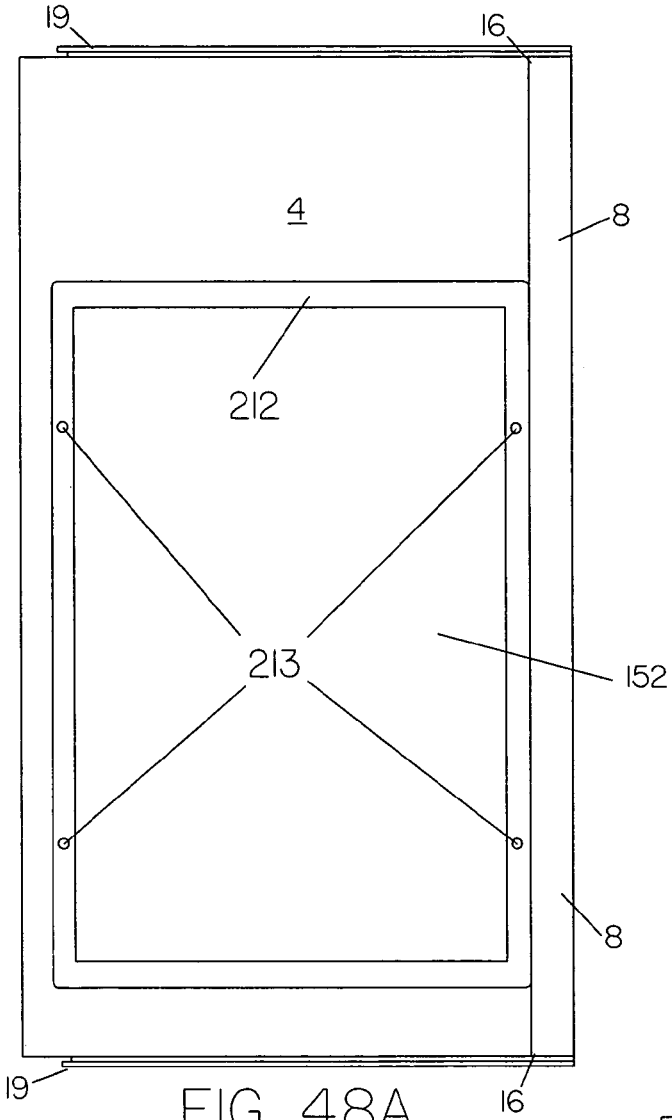
Figure 48D:
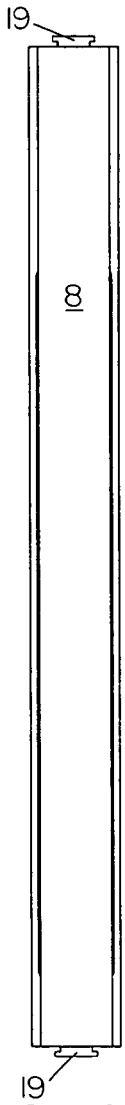
Figure 48B:
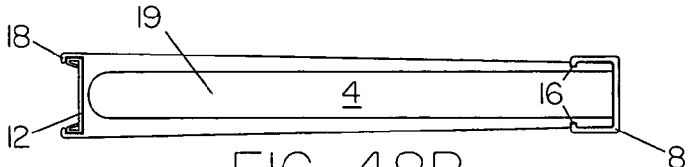
FIG. 48B is a bottom plan view of the bottom module subassembly with pet portal assembly removed, the top plan view being identical thereto.
Figures 49A, 49B, 49C, 49D, 49E:
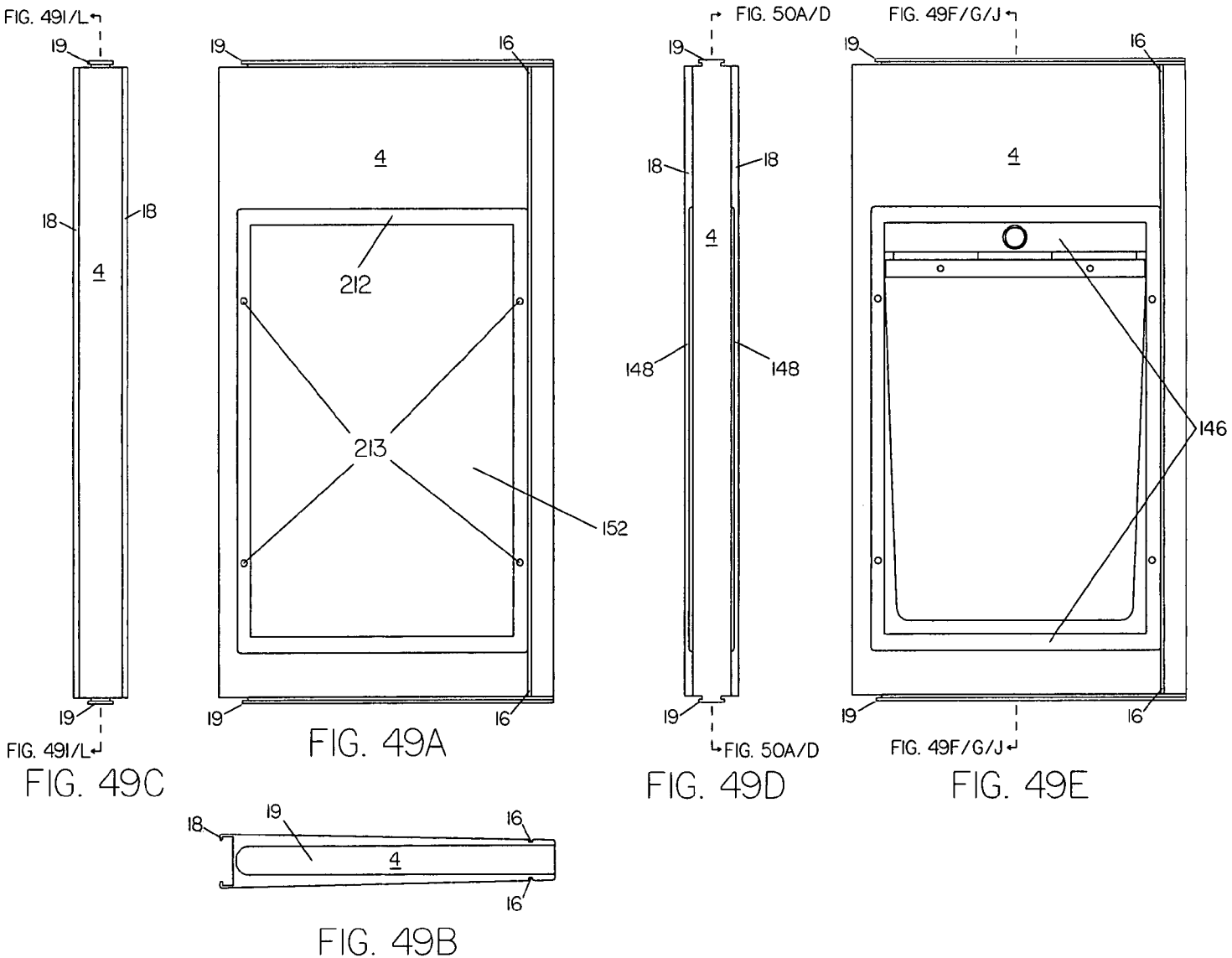
FIGS. 49A, 49C, and 49D are front, left side, and right side elevational views, respectively, of the bottom module without the pet portal assembly and weather seal shims.
FIG. 49B is a bottom plan view of the center module with the pet portal assembly and weather seal shims removed, the top plan view being identical thereto.
FIG. 49E is a front elevational view of the bottom module subassembly with the pet portal assembly installed as in the preferred embodiment of the invention.

In a preferred embodiment of the invention, the bottom module 4 contains a pet portal assembly 146, as shown is FIGS. 1–3. FIG. 48 shows various views of assembled bottom module 4 with pet portal assembly 146 removed. FIG. 48A is a front or interior view of assembled bottom module 4 with pet portal assembly 146 removed. With pet portal assembly 146 removed seating flange 212 and frame mounting holes 213 are as shown in FIGS. 48A and 49A. Except for removal of pet portal assembly 146 FIGS. 48A–D and FIGS. 49A–E are the same as FIGS. 15A–D and FIGS. 16A–E, and reference is made to these figures for a detailed description of bottom module 4.

Figure 49F:
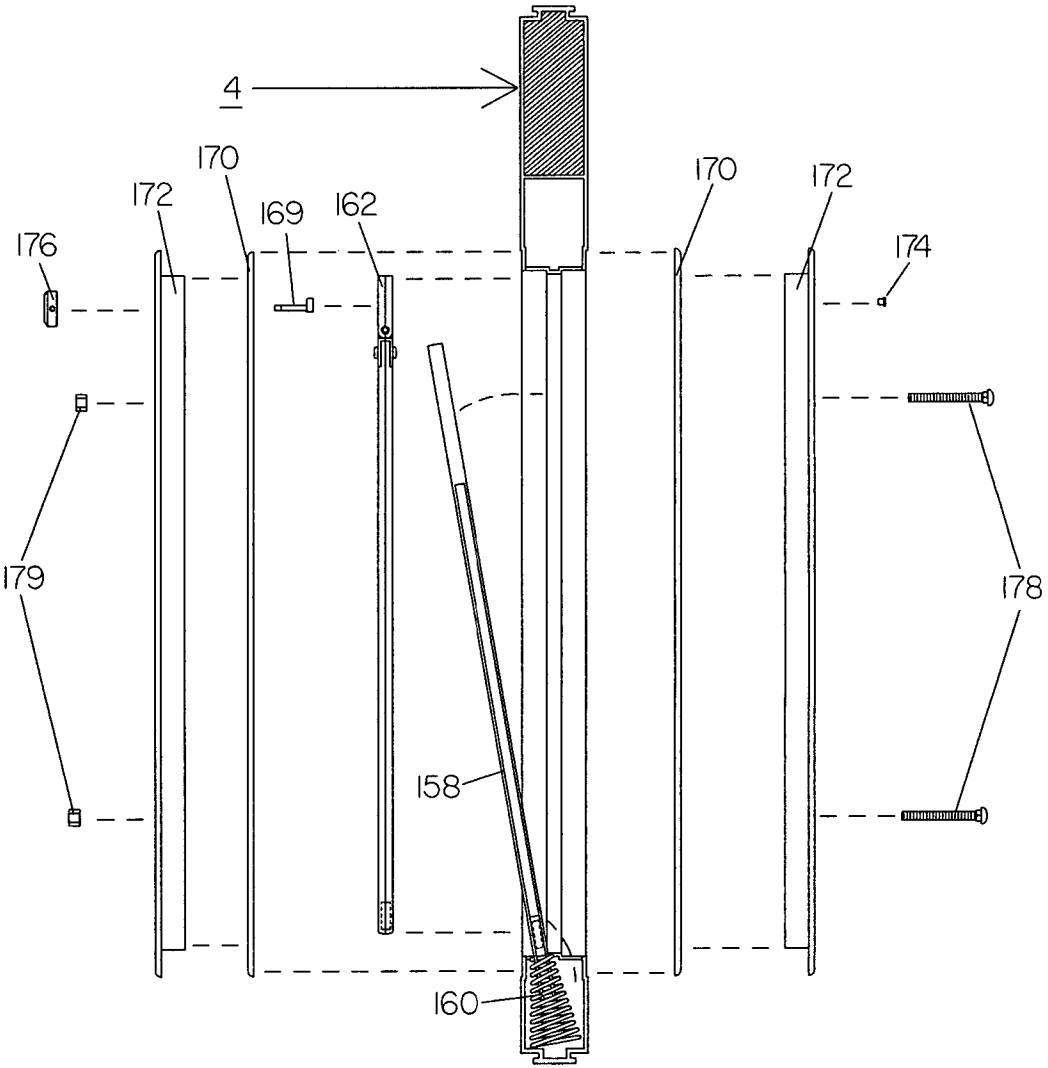
FIG. 49F is an exploded assembly view of the pet portal assembly and a partial cross sectional view along line 49F—49F of FIG. 49E of the bottom module subassembly.

FIG. 49F is an exploded assembly leading side view of pet portal assembly 146 (see FIG. 1) and a partial cross sectional leading side view of bottom module 4. Floating seal spring 160 fits onto an appendage on the bottom of floating seal 158. The bottom portion of this two component subassembly are placed into a cavity located in the uppermost portion of portal opening 152 (see FIGS. 48A and 49A), or a cavity located in the lowermost portion of portal opening 152 in bottom module 4 then rotated into place as shown in FIG. 49F. The terms top and bottom regarding bottom module 4 are relative terms since bottom module 4 may be rotated about a horizontal axis to increase or lower the height of the pet portal assembly to accommodate pets of various sizes. With floating weather seal spring 160 and floating weather seal 158 installed into bottom module 4, flap assembly 162 and flap lock cam 169 along with floating weather seal 158 are placed between frame 172 from the interior side, and frame 172 from the exterior side after gaskets 170 have been applied to the pet portal assembly seating flange on the interior and exterior sides of bottom module 4. Interior frame 172 and exterior frame 172 are identical, and bolted together using carriage bolts 178 and nuts 179 with frame gaskets 170, flap lock cam 169, flap lock assembly 162, and floating weather seal 158 sandwiched in between within opening 152 of bottom module 4, as shown in trailing side partial cross sectional view of FIG. 49G. After the interior and exterior frames 172 are bolted in place, flap lock knob 176 is attached to flap lock cam shaft 169, and flap lock cam shaft hole plug 174 is placed in the exterior frame 172. This configuration suspends flap assembly 162 from flap lock cam 169. Flap lock cam 169 is located in upper hinge 163 (see FIG. 49G) of flap assembly 162, and held in place by interior frame 172. Flap lock cam 169 shaft passes through a tubular protrusion in interior frame 172, and is attached to flap lock knob 176. When flap lock knob 176 is turned in a clockwise direction flap lock cam 169 is rotated up lifting upper hinge 163 and flap assembly 162 as indicated by directional arrows 153 and shown in FIGS. 50D and E. FIG. 49H is an enlarged trailing side partial cross sectional view of the lowermost pet portal assembly and bottom module 4. This view shows magnet 159 installed in floating weather seal 158 along with floating weather seal spring 160 and flap magnet 168 installed in flap 166. When the flap lock cam 169 is rotated up, flap 166 of flap assembly 162 is lifted out from between interior frame 172 and exterior frame 156 at the lowermost portion of pet portal opening 152 in bottom module 4, as shown in FIG. 50D. As flap 166 is lifted up from between frames 172, magnet 168 in flap 166 assisted by floating seal spring 160 pulls floating weather seal 158 up and against the lowermost portion of flap 166, as indicated by directional arrows 167 and 185 and shown in FIGS. 49I, 50D and F.

Figure 49G:
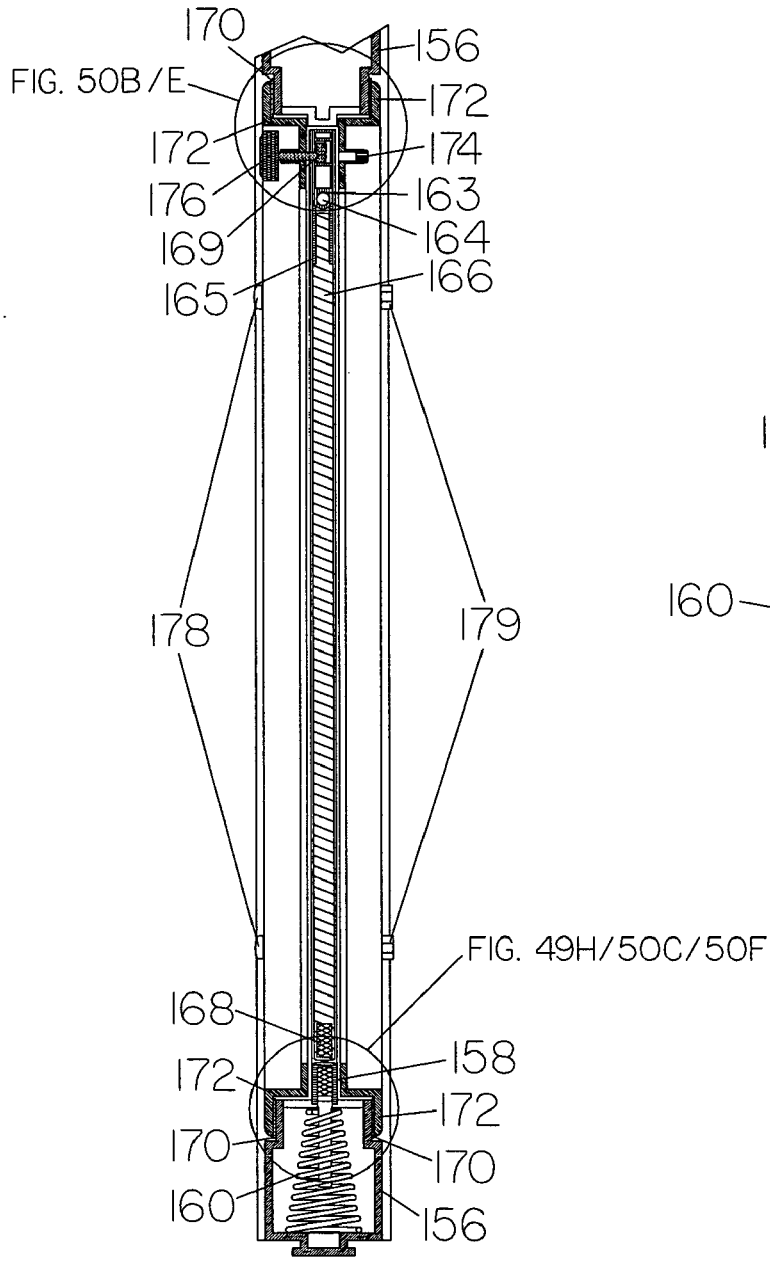
FIG. 49G is a cross sectional side view of the bottom module subassembly with pet portal assembly installed taken along line 49G—49G of FIG. 49E, illustrating the function of the floating magnetic weather seal with the pet portal flap in a closed position.
Figure 49H:
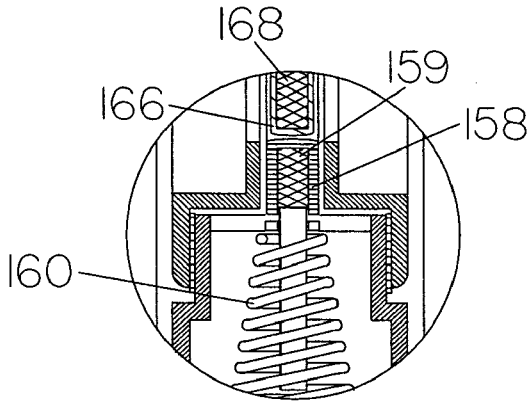
FIG. 49H is an enlarged view of the area 49H circled on the cross sectional view shown in FIG. 49G, illustrating the function of the magnetic floating weather seal with the pet portal flap in a closed position.
Figure 491:
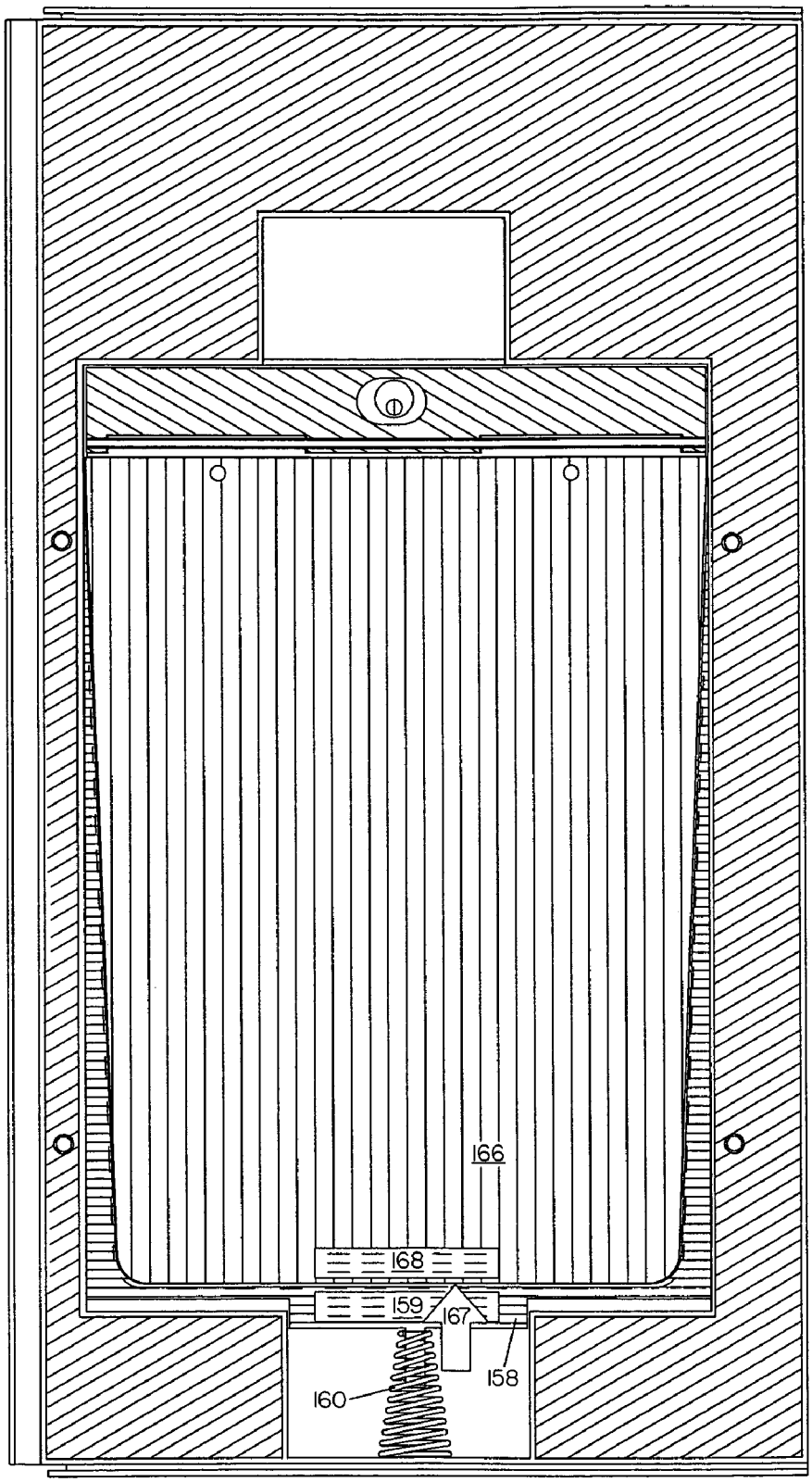
Figure 49J:
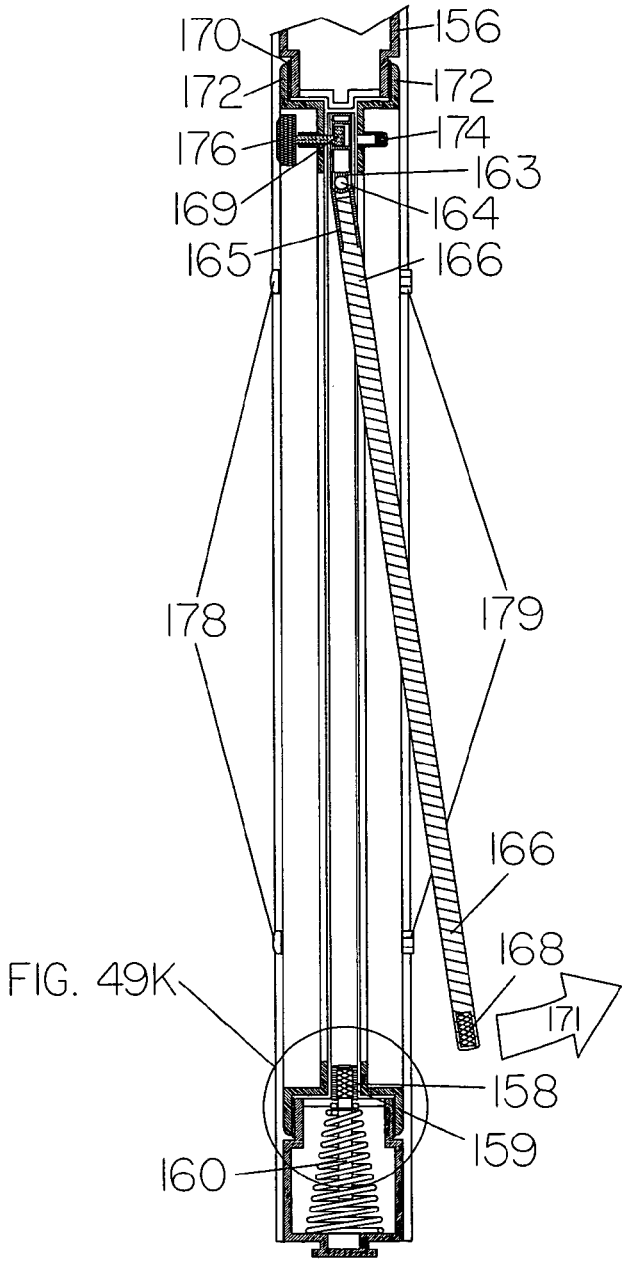
FIG. 49J is a cross sectional side view of the bottom module subassembly with pet portal assembly installed taken along line 49J—49J of FIG. 49E, illustrating the function of the floating magnetic weather seal with the pet portal flap in an open position.
Figure 49K:
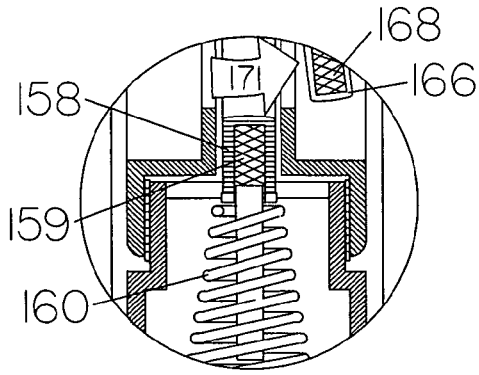
FIG. 49K is an enlarged view of the area 49K circled on the cross sectional view shown in FIG. 49J, illustrating the function of the magnetic floating weather seal with the pet portal flap in an open position.
Figure 49L:
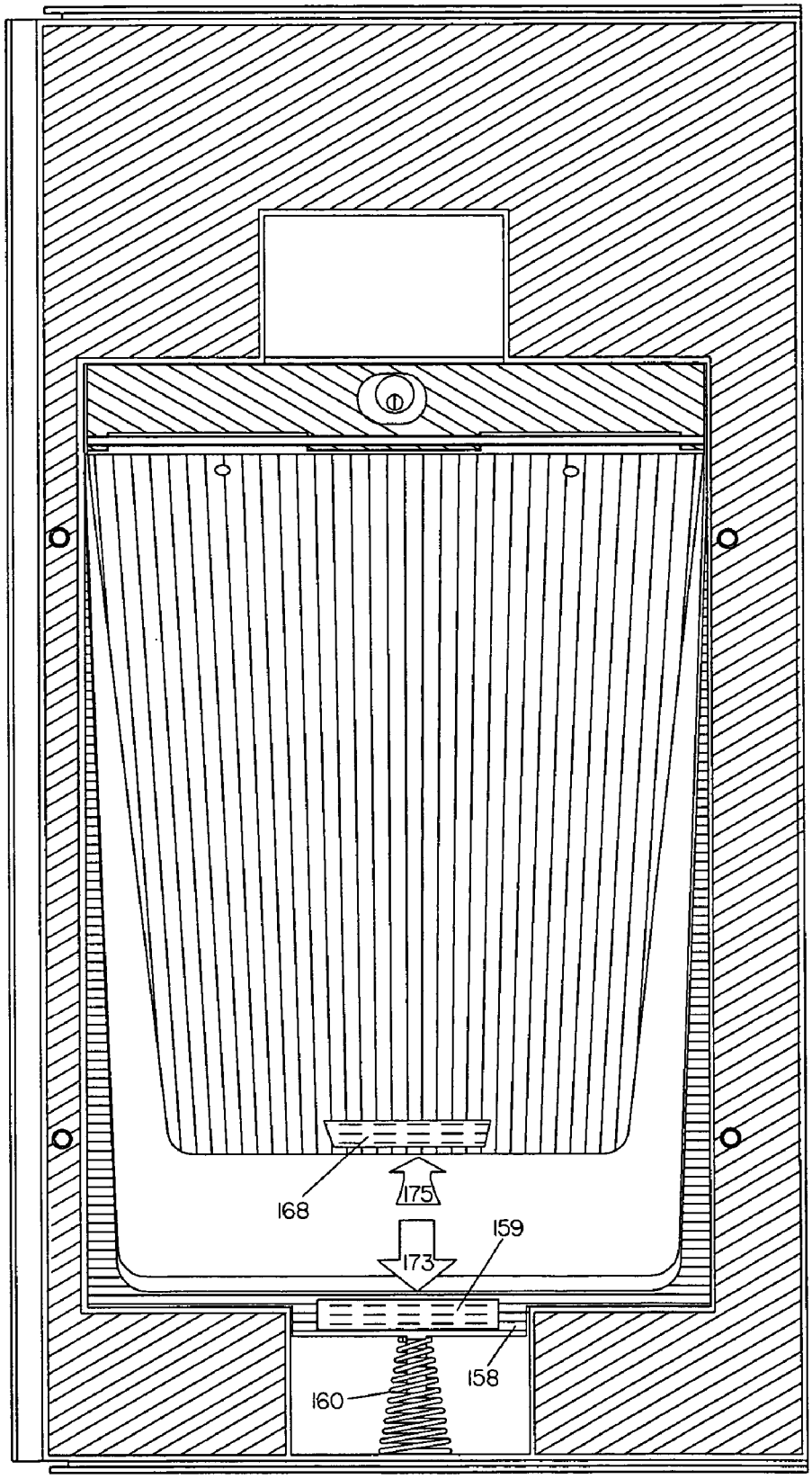
FIG. 49L is a partial cross sectional front view of the bottom module subassembly with pet portal assembly installed taken along line 49L—49L of FIG. 49C, illustrating the function of the floating magnetic weather seal with the pet portal flap in an open position.
Figure 50A:
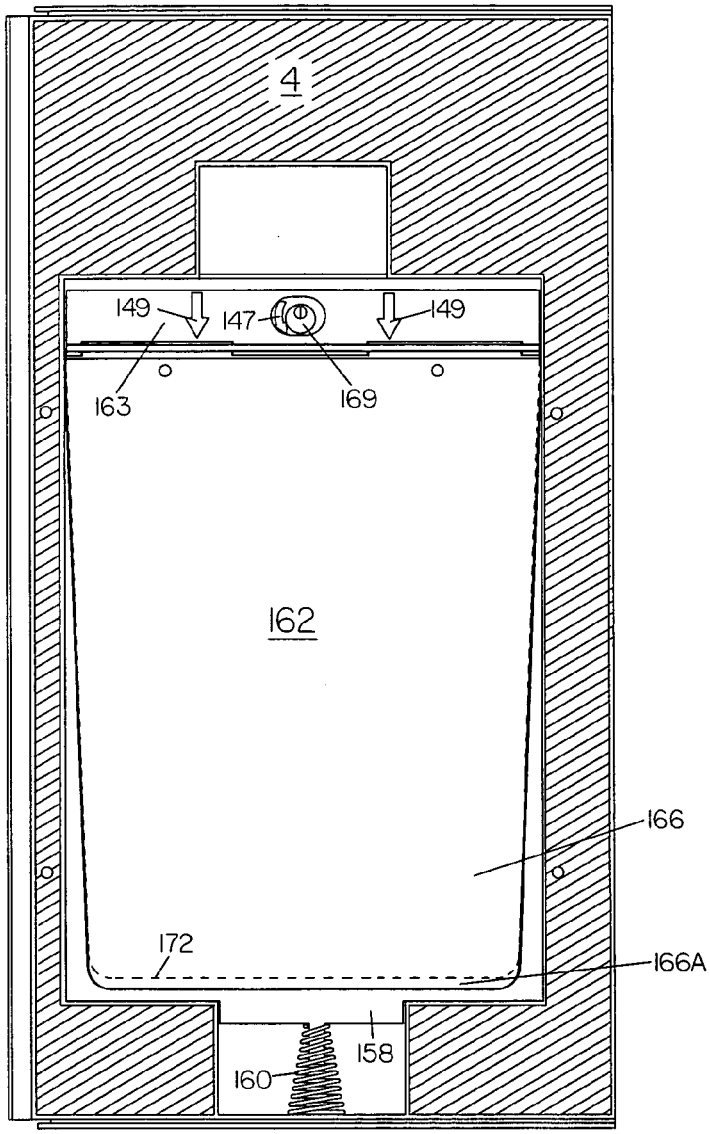
FIG. 50A is a partial cross sectional front view of the bottom module subassembly with pet portal assembly installed taken along line 50A—50A of FIG. 49D, illustrating the flap lock function with the flap in a locked position.
Figure 50B:
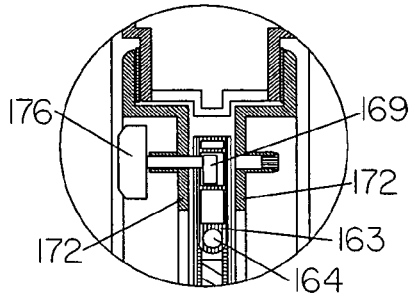
FIGS. 50B and 50C are enlarged partial cross sectional views of the cam locking assembly and the lowermost portion of the flap lock referenced in areas 50B, 50C, respectively, as circled on the cross sectional view shown in FIG. 49G, illustrating function of the flap locking mechanism in a locked position.
Figure 50C:
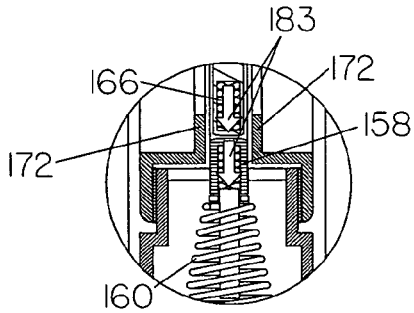
Figure 50D:
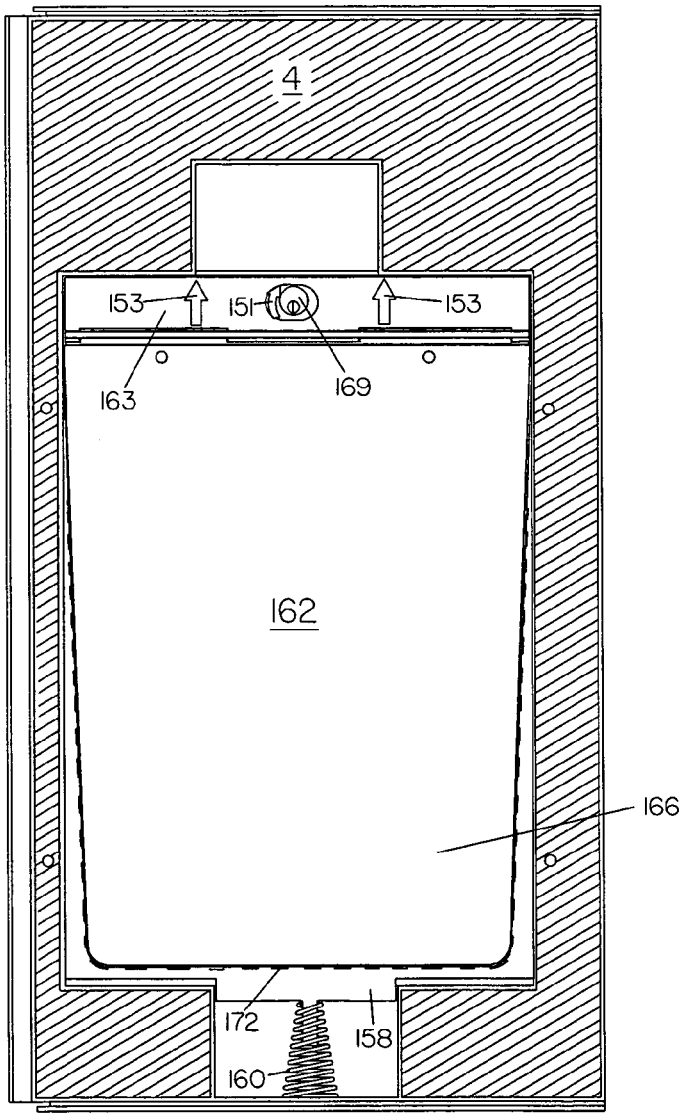
FIG. 50D is a partial cross sectional front view of the bottom module subassembly with pet portal assembly installed taken along line 50D—50D of FIG. 49D, illustrating the flap lock function with the flap in an unlocked position.
Figure 50E:
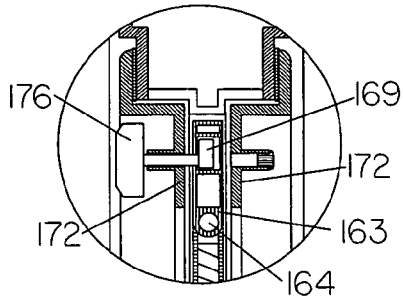
FIGS. 50E–50F are enlarged partial cross sectional views of the cam locking assembly and the lowermost portion of the flap lock referenced in areas 50E, 50F, respectively, of FIG. 49G, illustrating function of the flap locking mechanism in an unlocked position.
Figure 50F:
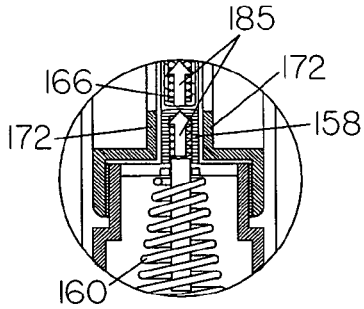

Flap 166 is attached to lower hinge 165 (see FIGS. 53A–B), and lower hinge 165 is hinged to upper hinge 163 (see FIGS. 52A–B), by hinge pin 164 as shown in FIG. 49G. This hinged arrangement permits flap 166, FIGS. 54A–B to swing about a horizontal axis as indicated by directional arrow 171 and as shown in FIGS. 49J and K. As a pet pushes flap 166 open the magnetic pull between flap magnet 168 and floating weather seal magnet 159 is broken allowing floating weather seal 158 to drop below frame 172 causing it to rest on spring 160 as shown in FIG. 49K, and indicated by directional arrows 175 and 173 and as shown in FIG. 49L. When flap lock knob 176 is turned counter clockwise, flap lock cam 169 is rotated down in upper hinge 163, lowering flap 166 of flap assembly 162 down and between interior frame 172 and exterior frame 172 trapping an area 166A of lowermost portion of flap 166 as shown in FIGS. 50A–C.

Figure 51A:
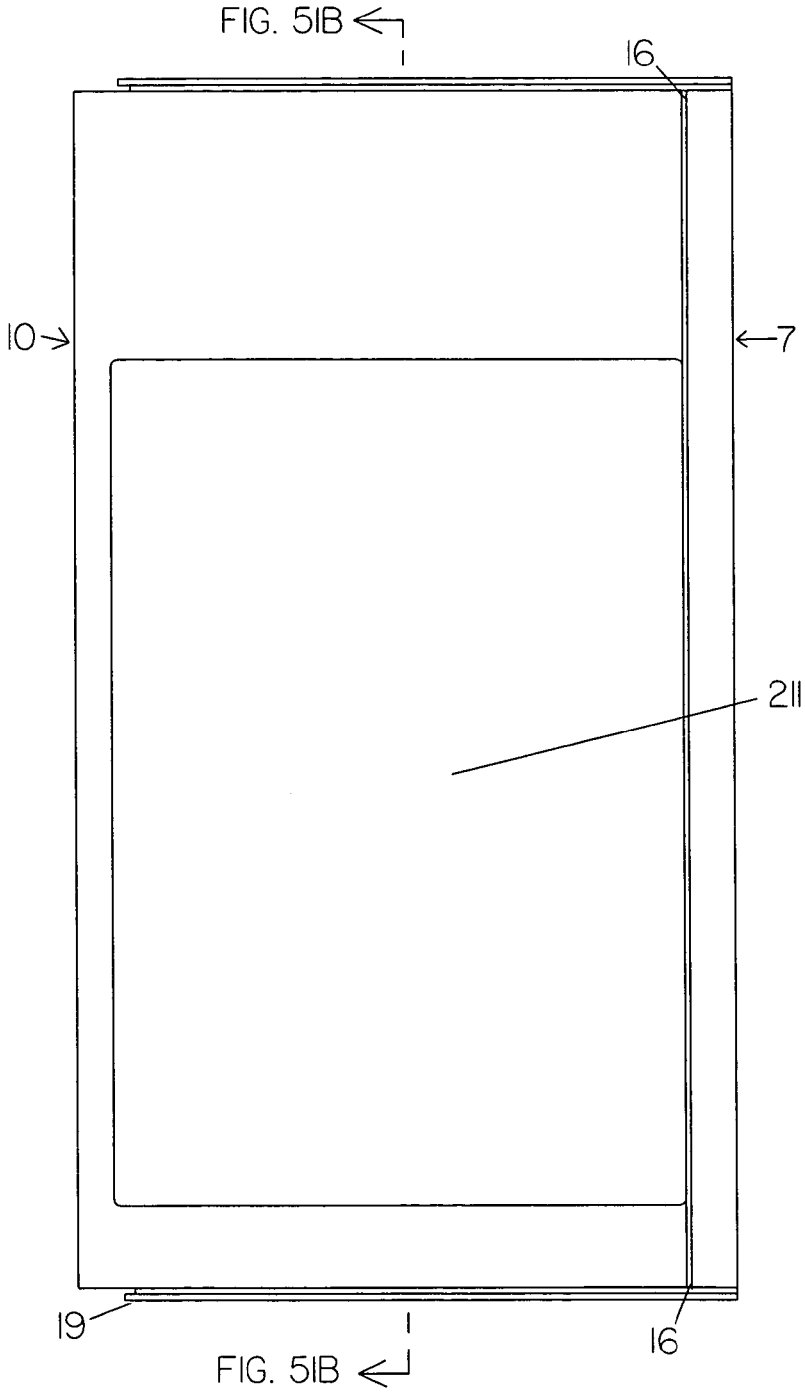
FIG. 51A is a front elevational view of the bottom module subassembly as a blank panel without a pet portal hole, designed to allow for installation of pet portals produced by various manufacturers as another embodiment of the invention.
Figure 51B:
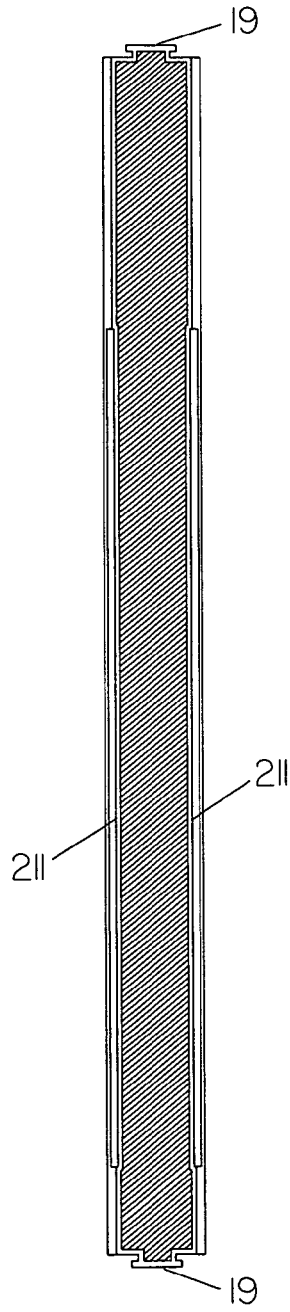
FIG. 51B is a cross sectional side view taken along line 51B—51B of FIG. 51A, of the blank bottom module subassembly without the pet portal hole, designed to allow installation of pet portals produced by various manufacturers as another embodiment of the invention.

In another embodiment of the invention bottom module 4 of pet door panel 25 is left as a blank with indented parallel surfaces as shown in FIGS. 51A and B. In this configuration most other conventional swinging door pet portals may be installed following the manufacturers instruction.

Figure 52A:
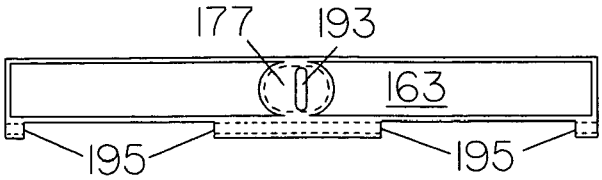
FIGS. 52A and 52B are front elevational (back elevational view being identical thereto), and right side elevational (left side elevational view being identical thereto) views, respectively, of the pet portal assembly upper hinge subassembly component.
Figure 52B:
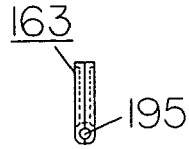
Figure 53A:
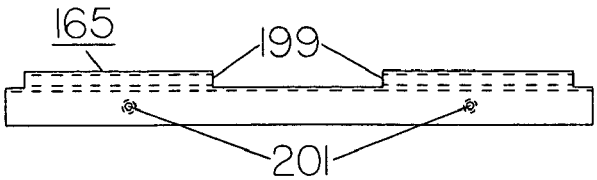
FIGS. 53A and 53B are front elevational (back elevational view being identical thereto), and right side elevational (left side elevational view being identical thereto) views, respectively, of the pet portal assembly lower hinge subassembly component.
Figure 53B:
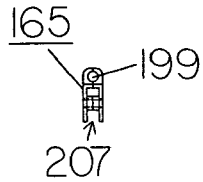
Figure 54A:
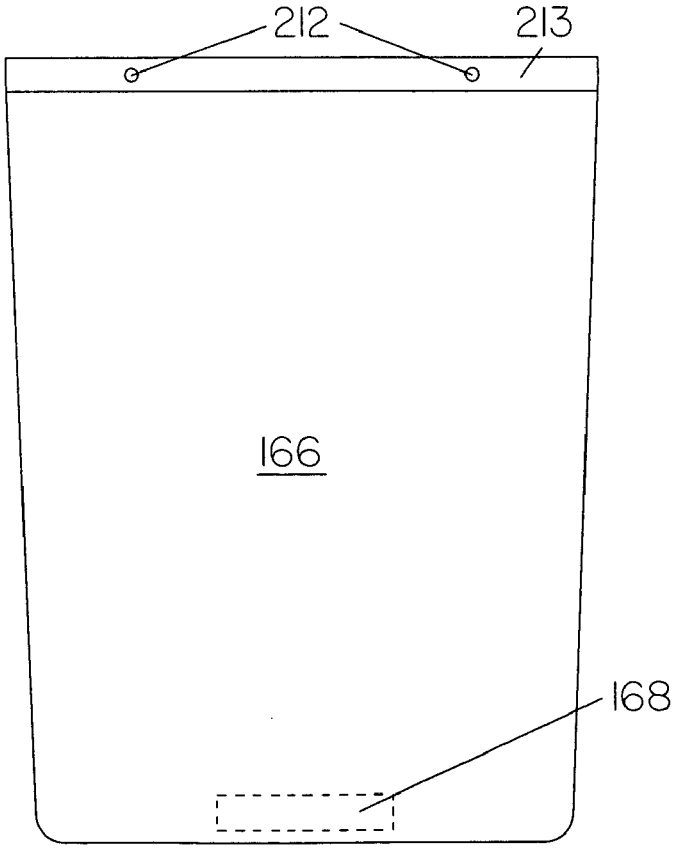
FIGS. 54A–54B are front elevational (back elevational view being identical thereto), and right side elevational (left side elevational view being identical thereto) views, respectively, of the pet portal assembly flap subassembly component.
Figure 54B:
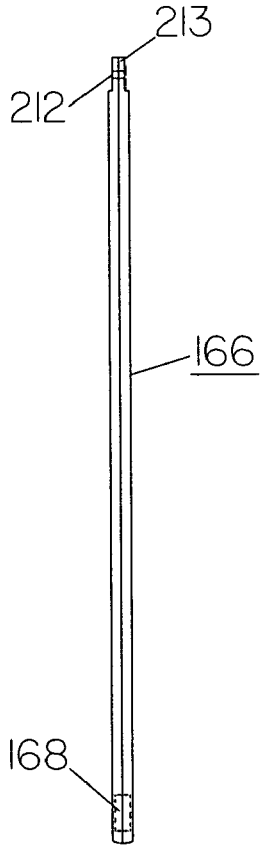

FIGS. 52A and 52B show an interior front view and leading or right side view, respectively, of upper hinge 163. Upper hinge 163 is designed to be two identical injection molded halves bonded together with integral cam follower compartment 177, cam shaft slot 193 and hinge pin holders 195. Lower hinge 165 has hinge pin holders 199 and flap rivet holes 201, as shown in FIGS. 53A and B. Lower hinge 165 is designed to be two identical injection molded halves bonded together. FIGS. 54A and 54B show interior side and leading side views, respectively, of flap 166. Flap construction should be of a composite fluted aluminum or plastic skin offering durability and optimum insulation quality. Location of flap magnet 168 is shown in the lowermost portion of flap 166.

Figure 55A:
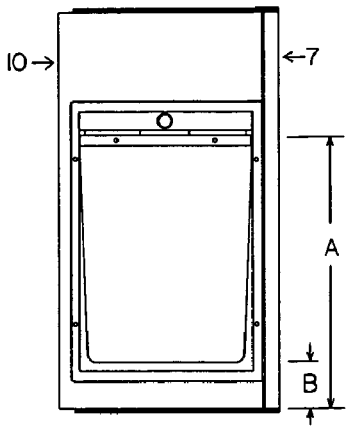
FIG. 55A is a front elevational view of the bottom module subassembly with pet portal assembly installed in a configuration to accommodate smaller pets.
Figure 55B:
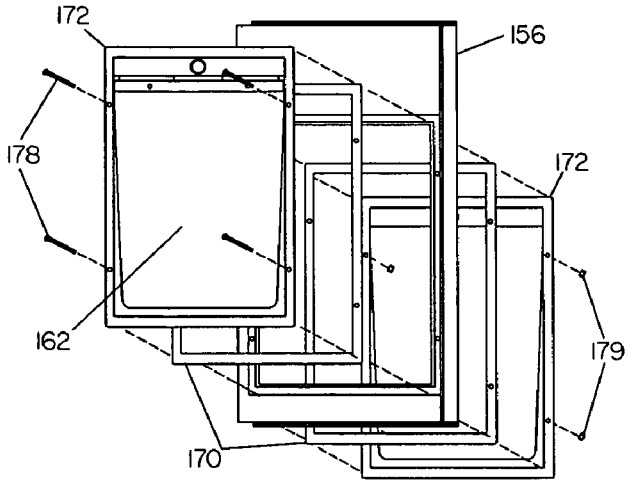
FIG. 55B is an exploded perspective assembly view of the pet portal assembly illustrating disassembly and reassembly for height and directional changes of the bottom module subassembly in the field.
Figure 55C:
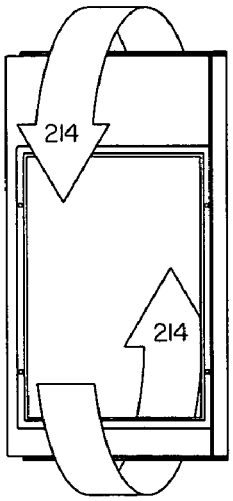
FIG. 55C is a front elevational view of the bottom module with pet portal assembly removed showing rotation of the bottom module about the horizontal axis to make a height change in the bottom module subassembly.
Figure 55D:
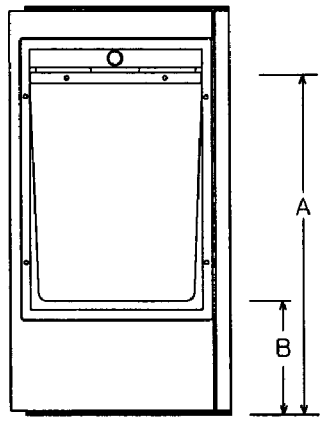
FIG. 55D is a front elevational view of the bottom module subassembly with pet portal assembly installed in a configuration to accommodate larger pets.

FIG. 55A is an interior front view of bottom module 4 with pet portal assembly 146 installed configured for lowest rise and pet portal height in a right opening sliding glass patio door. After disassembling and removing pet portal assembly 146 as shown in FIG. 55B, the height of the pet portal may be increased by rotating bottom module 4 about a horizontal axis as shown in FIG. 55C, then reassembling and installing pet portal assembly 146 as shown in FIG. 55B. After reassembling and installing pet portal assembly 146 the reconfigured door with increased pet portal height should appear as shown in FIG. 55D.

Figure 56A:
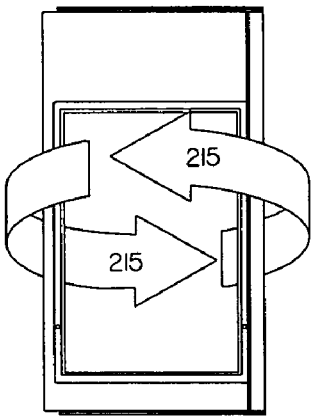
FIG. 56A is a front elevational view of the bottom module with the pet portal assembly removed showing the rotation of the bottom module about the vertical axis to change direction of the bottom module subassembly to accommodate a left opening sliding patio door.
Figure 56B:
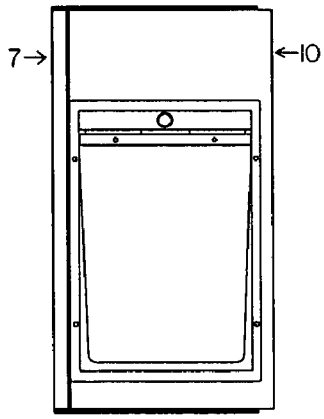
FIG. 56B is a front elevational view of the bottom module subassembly with pet portal assembly installed configured for a left opening sliding patio door.

When reconfiguring the pet door panel for a left opening sliding glass patio door assembled top module weather seal 1 and top module 2 (see FIG. 3C) are rotated about a vertical axis. Changing the center module 3 requires rotation of the module 180 degrees about the horizontal axis. In order to reconfigure the bottom module 4 with pet portal 146 installed from a right opening to left opening sliding glass patio door pet portal assembly 146 must be disassembled and removed from bottom module 4 as shown in FIG. 55B. Once pet portal assembly 146 is removed, the bottom module 4 is rotated 180 degrees about a vertical axis as shown in FIG. 56A. The reconfigured bottom module 4 for left opening sliding glass patio door should appear as shown in FIG. 56B.

Figure 57A:
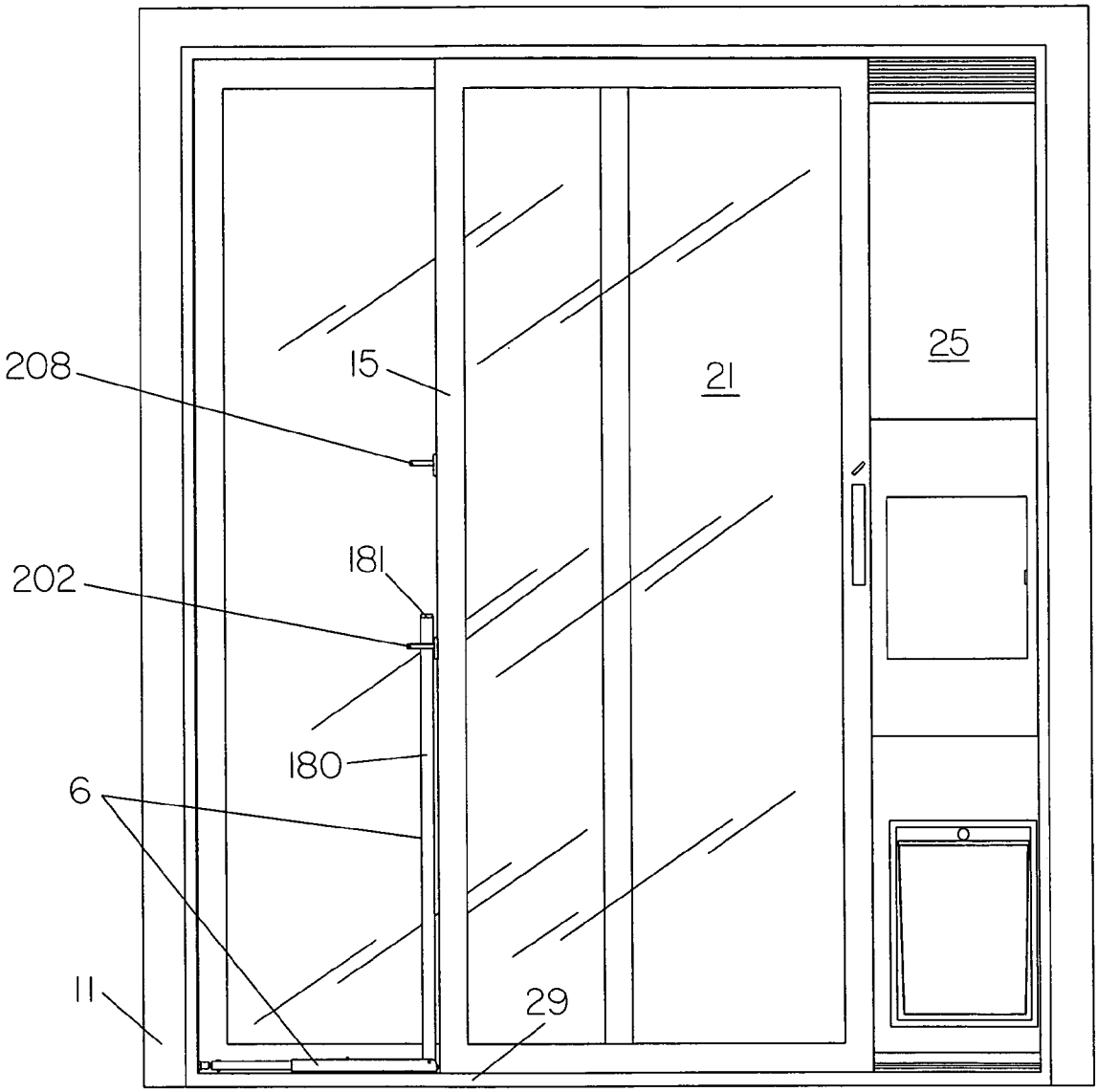
FIG. 57A is a front or interior elevational view of the sliding glass patio door with pet access door installed showing installation of the drop lock security lock in a locked position.

The handlebar of drop lock 6 is attached to the trailing side of frame 15 of movable sliding door 21 at locking bracket 202 as shown FIG. 57A. FIG. 57A is an interior side view of a sliding glass patio door with pet door panel 25 and drop lock 6 installed. A hinge pin joins the handlebar and adjustable housing so that the adjustable housing may be dropped into the lower channel portion 29 of the sliding glass patio door with the handlebar at a 90 degree angle going up the trailing side of door frame 15 of movable sliding door 21.

Figure 57B:
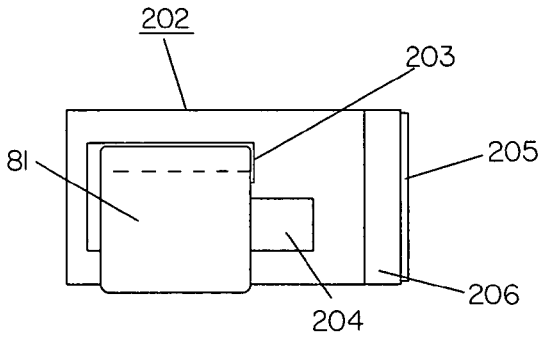
FIGS. 57B and 57C are top plan, and front elevational views, respectively, of the drop lock handlebar handle in the lower locking bracket, illustrating the configuration of the handlebar handle and lower locking bracket with the drop lock in a locked position.
Figure 57C:
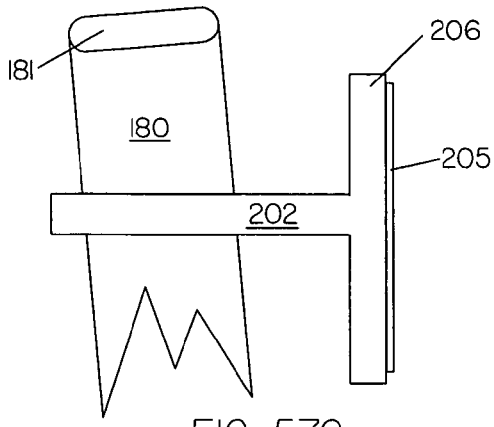
Figure 57D:
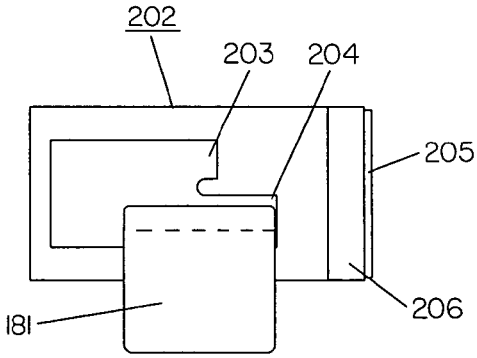
FIGS. 57D and 57E are top plan, and front elevational views, respectively, of the drop lock handlebar handle in the lower locking bracket, illustrating the configuration of the handlebar handle and lower locking bracket in a neutral position.
Figure 57E:
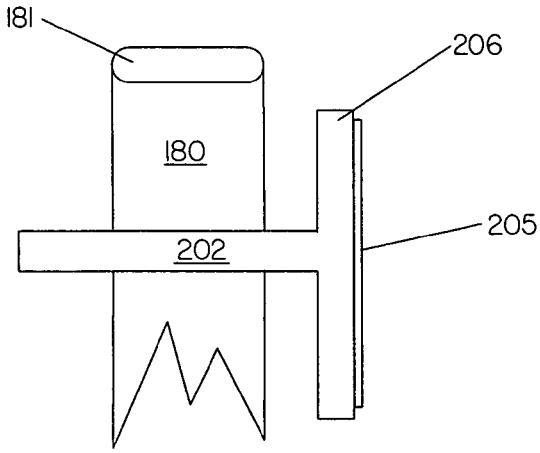
Figure 57F:
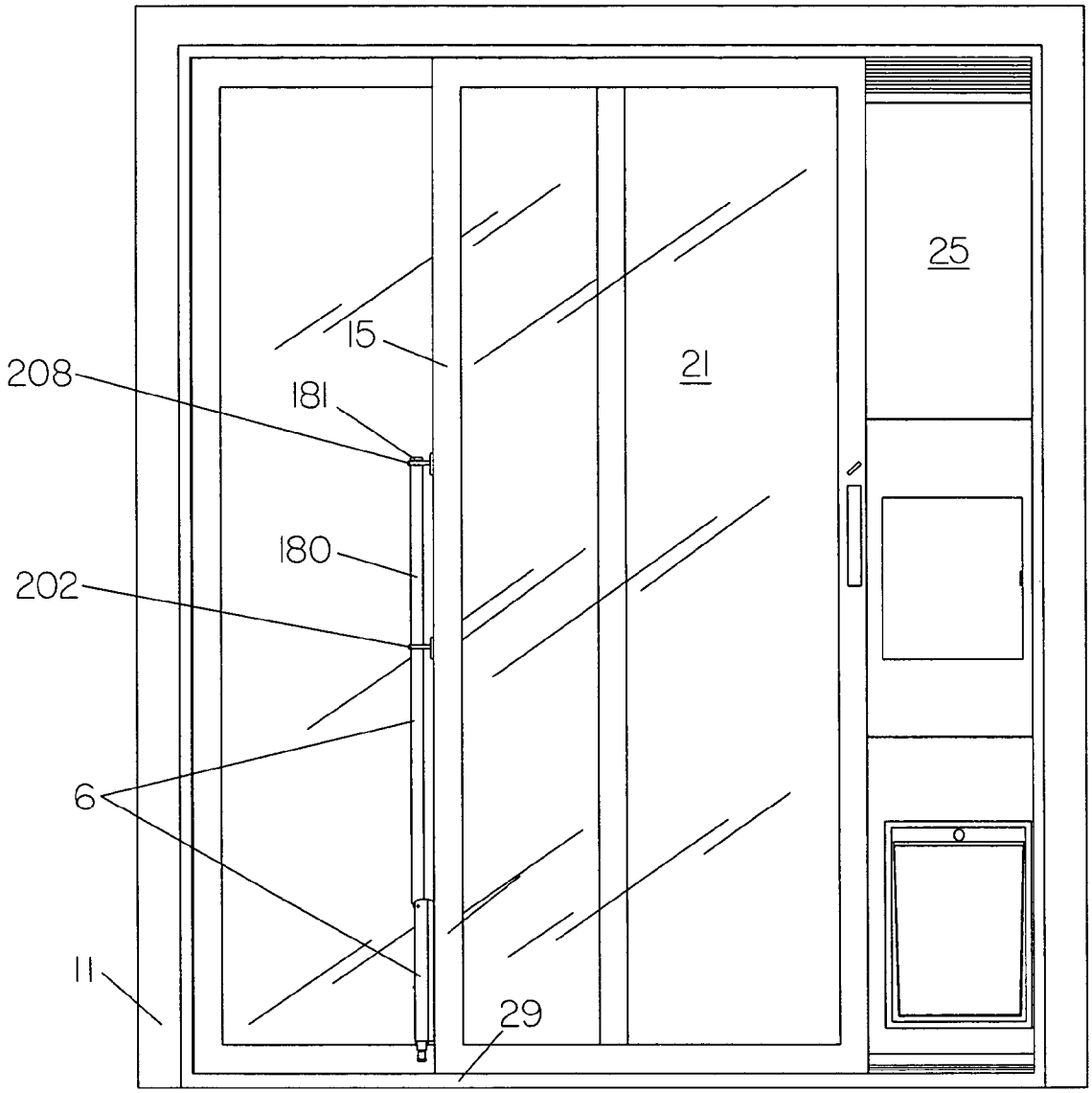
FIG. 57F is a front or interior elevational view of the sliding glass patio door with pet access door installed showing installation of the drop lock security lock in an unlocked and stored position.
Figure 57G:
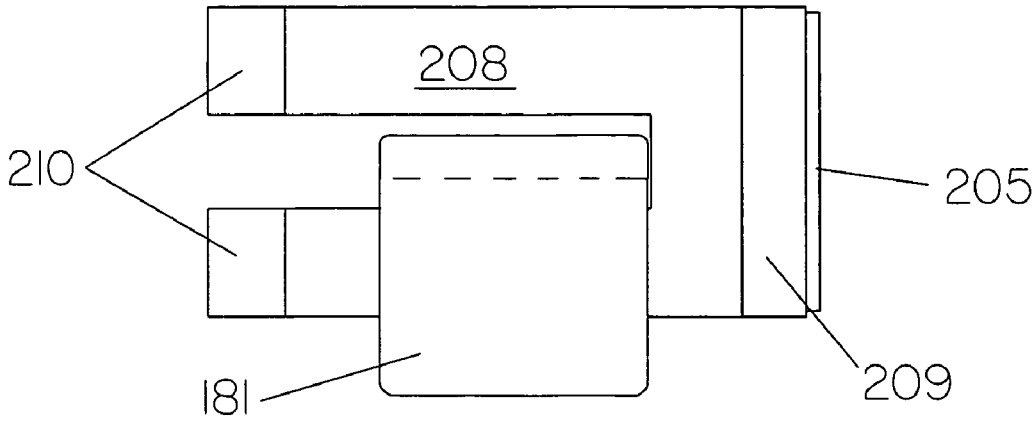
FIGS. 57G and 57H are top plan, and front elevational views, respectively, of the drop lock handlebar handle in the upper storage bracket, illustrating the configuration of the handlebar handle and upper storage bracket with the drop lock in an unlocked and stored position.
Figure 57H:
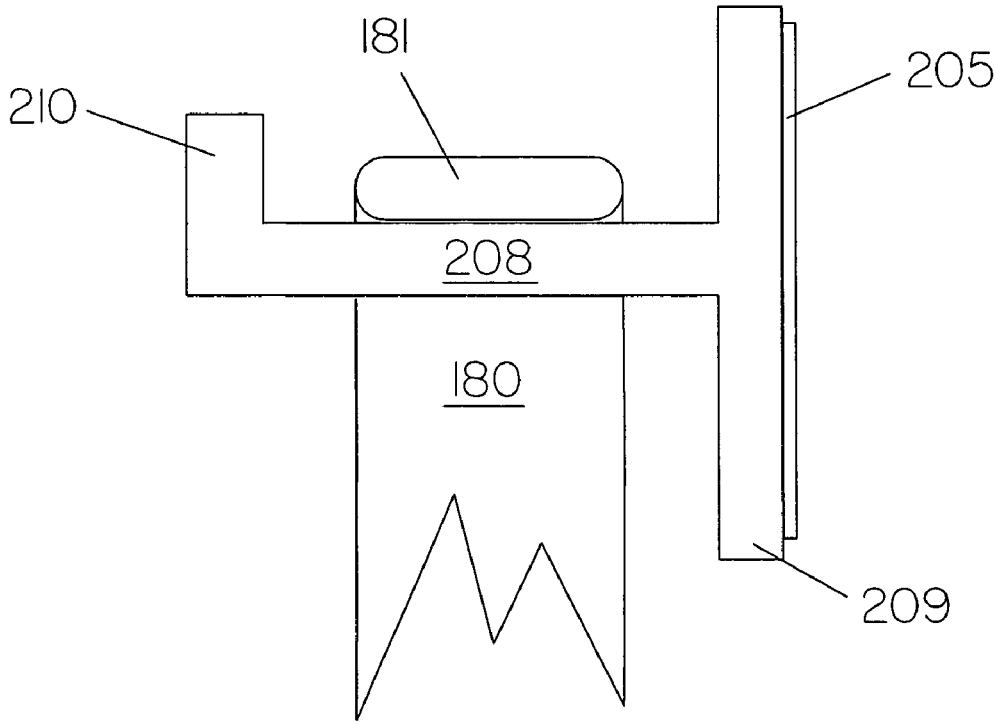

Handlebar handle 181 (see FIG. 58A) is inserted through locking bracket 202 prior to attachment to the trailing side of door frame 15 on movable sliding door 21 using self stick adhesive tape 205 on the back of mounting flange 206 shown in FIGS. 57C and 57E. With the adjustable housing 188 adjusted and lower track guide rail channel 189 in place in lower channel portion 29 of the sliding glass patio door between the upright portion of sliding patio door frame 11 and the trailing side of door frame 15 of movable sliding door 21 as shown in FIG. 57A, handlebar 180 is rocked away from door frame 15 as indicated by directional arrow 216 shown in FIG. 58K and moved into locking detent 203 as shown in FIGS. 57B and 57C. This step causes a rubber bumper 186 (see FIG. 58A) attached to the lowermost portion of handlebar 180 by hinge pin 184 just below the fulcrum to move as indicated by directional arrow 217 and push against the lowermost portion of the trailing side of door frame 15, at the point indicated by arrow 218, of movable sliding door 21 acting as a type of wedge as shown in FIG. 58K. In order to open the sliding glass patio door 21 handlebar 180 must be moved from locking detent 203 to neutral detent 204 of locking bracket 202 as shown in FIGS. 57D and 57E. Handlebar 180 is moved back to neutral detent 204 as indicated by directional arrow 216 shown in FIG. 58E. This moves the rubber bumper 186 attached to the lowermost portion of handlebar 180 by hinge pin 184 just below the fulcrum to move, as indicated by directional arrow 217, away from the trailing side of door frame 15 at the point indicated by arrow 218 as shown in FIG. 58E, allowing handlebar 180 to be lifted and raised to storage bracket 208, where the handlebar handle 181 rests on top of and in between containment forks 210 as shown in FIGS. 57G and 57H. In so doing, the adjustable housing 188 and lower track guide rail channel 189 are lifted out of lower channel portion 29 onto the trailing side of door frame 15 of movable sliding door 21, for storage as shown in FIG. 57F so that movable sliding door 21 may be opened.

Figures 58A, 58B, 58C:
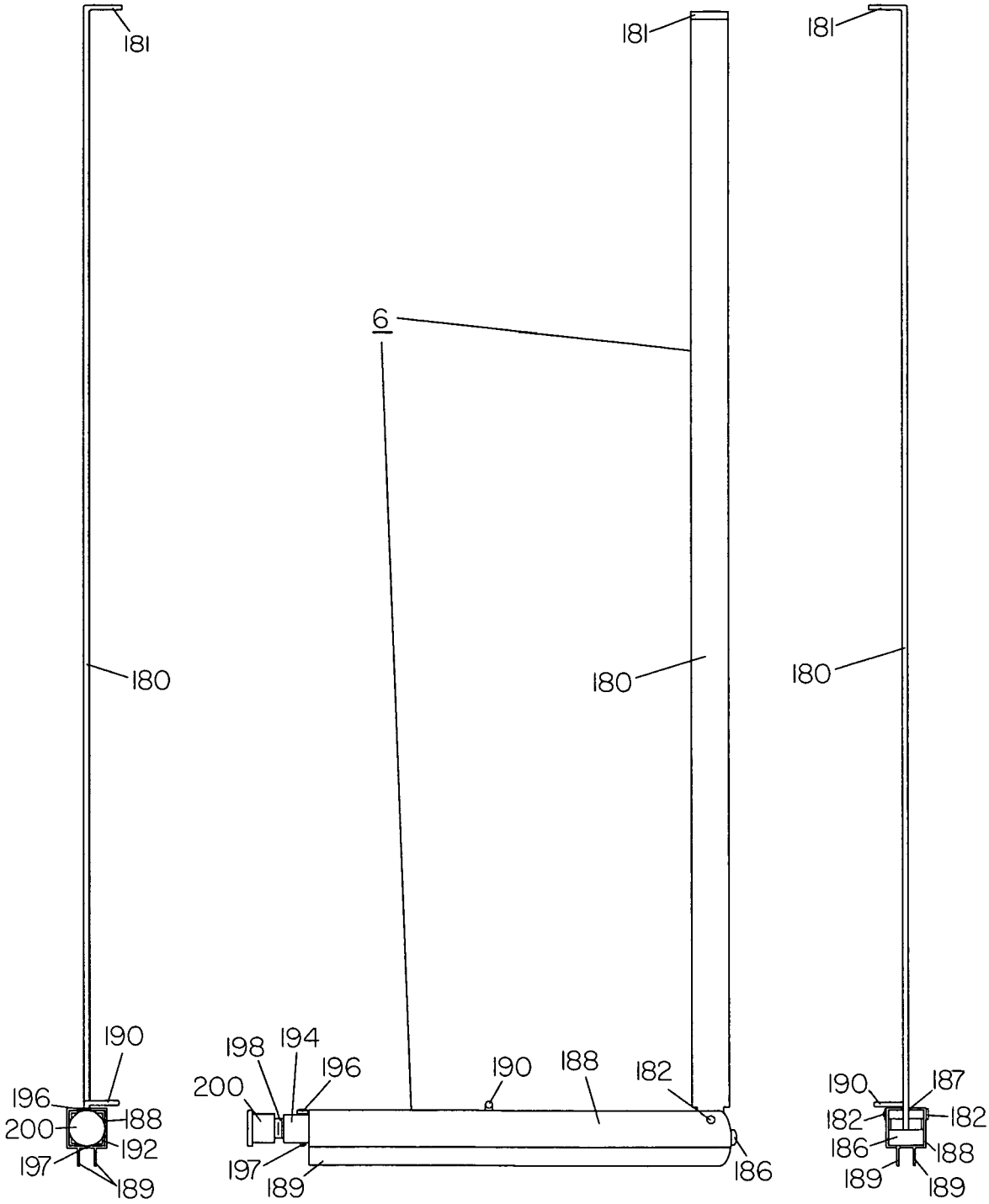
FIG. 58A is a front elevational view of the drop lock security lock in a locked position.
FIG. 58B is a left or trailing side elevational view of the drop lock security lock.
FIG. 58C is a right or leading side elevational view of the drop lock security lock.
Figure 58D:
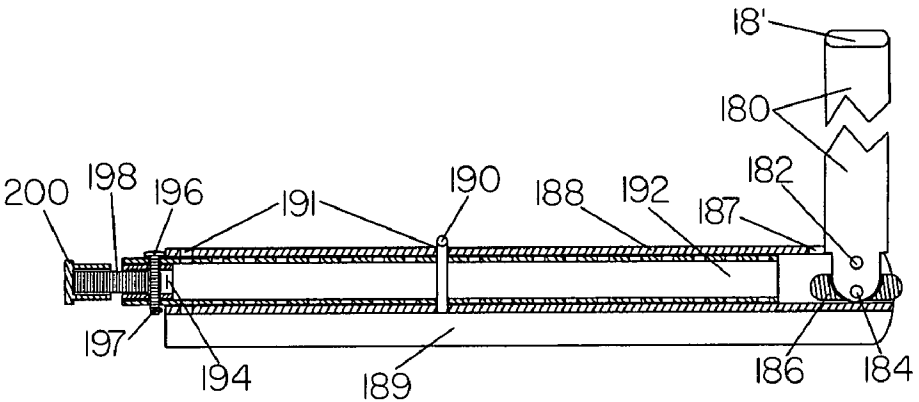
FIG. 58D is a partial cross sectional front elevational view taken along the longitudinal axis of the drop lock security lock.
Figure 58E:
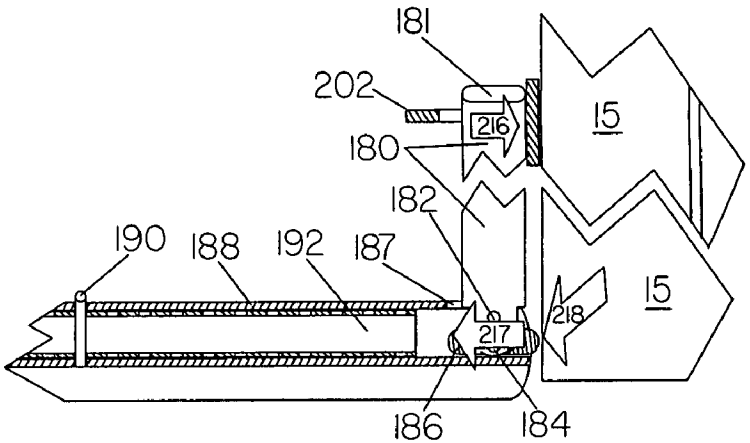
FIG. 58E is a partial cross sectional front elevational view taken along the longitudinal axis of the drop lock security lock in a locked position with the handlebar handle in a neutral position.
Figure 58F:
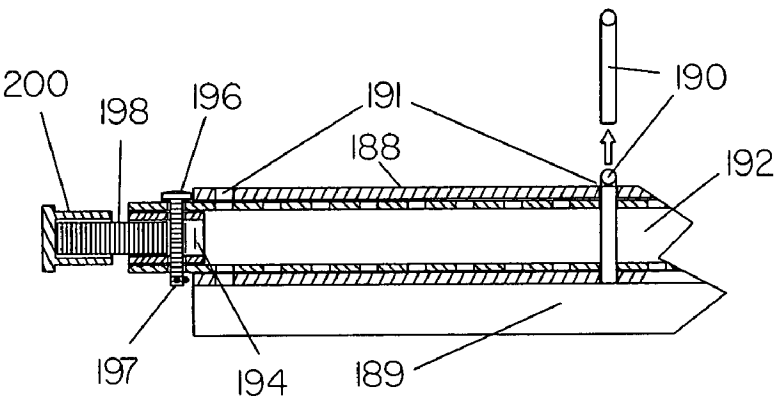
FIG. 58F is a partial cross sectional view of the drop lock security lock with the telescoping adjustment slide and fine adjustment mechanism is a retracted position.
Figure 58G:
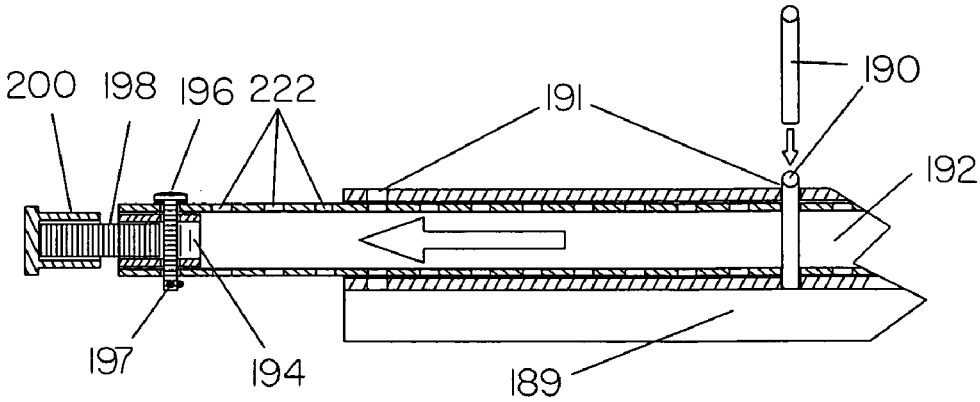
FIG. 58G is a partial cross sectional view of the drop lock security lock along a longitudinal axis with the telescoping adjustment slide in an extended position.
Figure 58H:
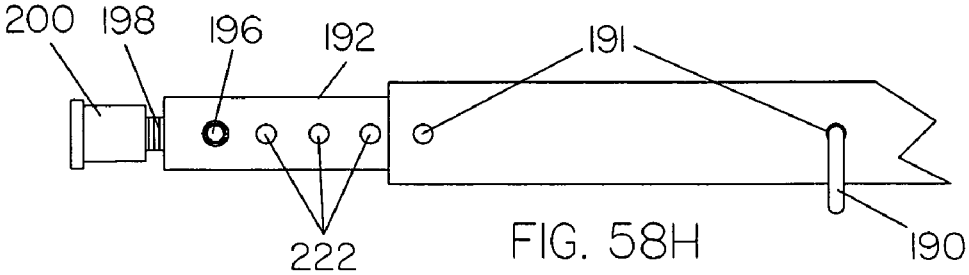
FIG. 58H is a partial top plan view of the drop lock security lock with the telescoping adjustment slide in an extended position.
Figure 58I:
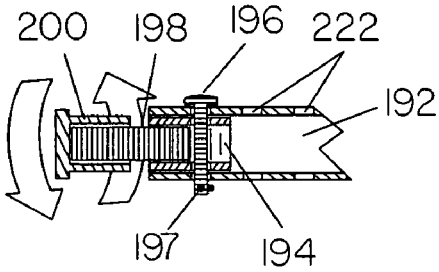
FIG. 58I is a partial cross sectional view along a longitudinal axis of the drop lock security lock showing rotation of the fine adjustment mechanism.
Figure 58J:
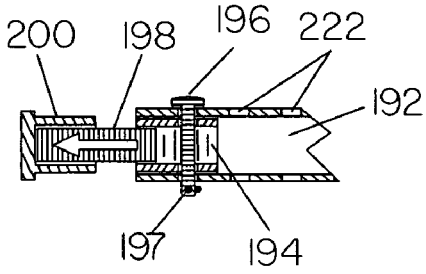
FIG. 58J is a partial cross sectional view along a longitudinal axis of the drop lock security lock with the fine adjustment mechanism in an extended position.
Figure 58K:
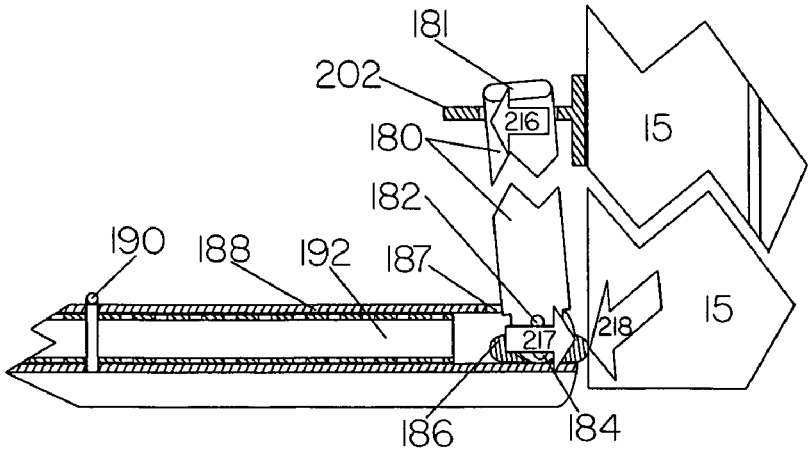
FIG. 58K is a partial cross sectional front elevational view taken along the longitudinal axis of the drop lock security lock in a locked position with the handlebar handle in a locked position.

FIG. 58A is an interior side elevational view of drop lock 6. FIG. 58B is a left or trailing side elevational view of drop lock 6. FIG. 58C is a right or leading side elevational view of drop lock 6. Approximately one inch of the uppermost portion of handlebar 180 is bent on a 90 degree angle to form handlebar handle 181 as shown in FIGS. 58A–58C. Handlebar 180 is attached to housing 188 by hinge pin 182 as shown in FIG. 58D which allows the hinge to swivel in excess of 90 degrees within handlebar slot 187 of adjustable housing 188 while allowing handlebar 180 and lower track guide rail channel 189 of adjustable housing 188 to lie flat against the trailing side of door frame 15, when drop lock 6 is in storage as shown in FIG. 57F. Rubber bumper 186 is attached to the lowermost portion of handlebar 180 just below the fulcrum created by the joining of handlebar 180 and housing 188 at hinge pin 182 as shown in FIGS. 58A–58E. Telescoping adjustment slide pin 190 fits through one of two holes 191 in housing 188 and into equidistant adjustment holes 222 in telescoping adjustment slide 192 to lock in larger incremental adjustments as shown in FIGS. 58F, 58G and 58H. When the telescoping adjustment slide 192 and housing 188 have come close to filling the gap between the upright portion of sliding glass patio door frame 11 and the trailing side of door frame 15 of movable sliding patio door 21, a finer final adjustment is accomplished by rotating adjustment grip and bumper 200 clockwise as shown in FIG. 58I, in turn unscrewing threaded fine adjustment rod 198 in threaded coupling 194 attached to telescoping adjustment slide 192 by coupling retainer pin 196 and coupling retainer pin cotter pin 197 extending the fine adjustment mechanism to obtain a snug fit (see FIGS. 58I and 58J). An internally threaded coupling 194 is actively retained via a retaining pin 196 and cotter pin 197 within a free end of housing 188, as shown, for receiving a threaded portion of rod 198.

Figure 59A:
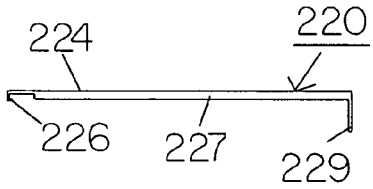
FIG. 59A is a left side elevational view of the ramp or platform resting board.
Figure 59B:
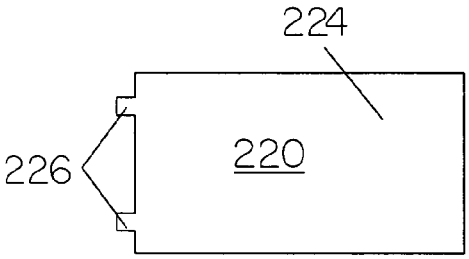
FIG. 59B is a top plan view of the ramp or platform resting board.
Figure 59D:
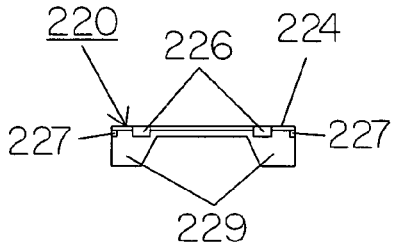
Figure 59C:
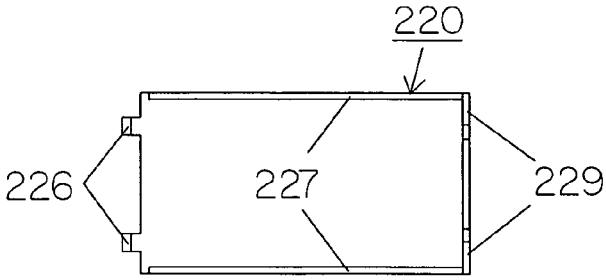
Figure 59E:
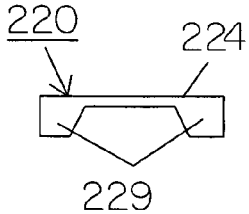
Figure 60A:
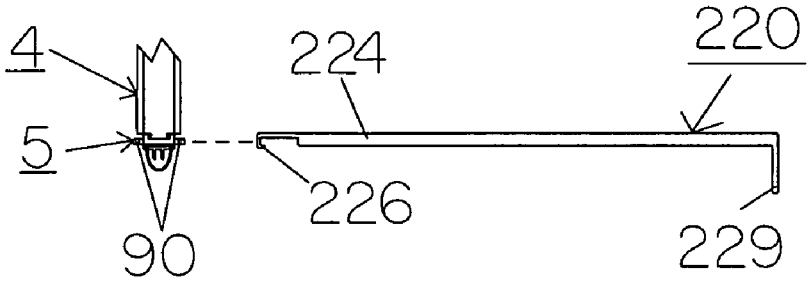
Figure 60B:
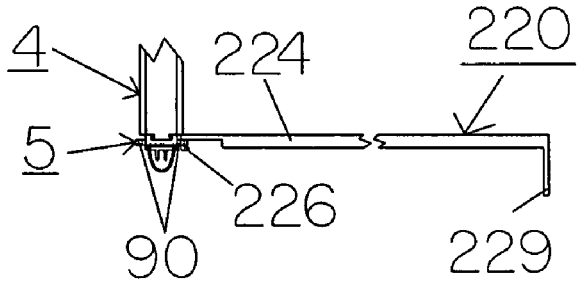
Figure 60C:
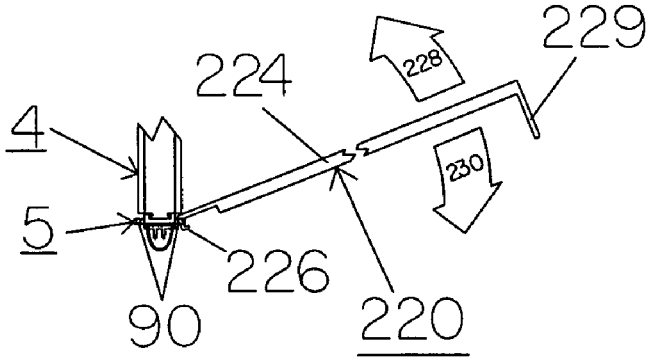

FIG. 59A is a left side elevational view of a ramp or platform resting board 220 showing ramp or platform resting board surface 224, support side wall 227, support legs 229 and attachment clasps 226. Clasps 226 attach to mounting brackets 90 located on the bottom module weather seal 5 which is attached to the bottom module 4 of the pet access door panel as shown in FIGS. 60A–60C. FIG. 59B is a top view of ramp or platform resting board 220 showing the ramp or platform resting board surface 224 and the attachment clasps 226. FIG. 59C is a bottom view of ramp or platform resting board 220 showing the attachment clasps 226, support side walls 227 and support legs 229. FIG. 59D is a back side view of ramp or platform resting board 220 showing ramp or platform resting board surface 224, attachment clasps 226, support side walls 227 and support legs 229. FIG. 59E is a front view of ramp or platform resting board 220 showing the ramp or platform resting board surface 224 and support legs 229.

FIG. 60A is an exploded assembly view of a partial left side elevational view of the lowermost portion of the pet access door panel showing bottom module 4 with bottom module weather seal 5 attached and a left side view of ramp or platform resting board 220. Attachment clasps 226 on ramp or platform resting board 220 engage mounting brackets 90 on bottom module weather seal 5 in order to attach the two components together as shown in FIG. 60B. The engagement of ramp or platform resting board clasps 226 and bottom module weather seal brackets 90 provide a hinge arrangement that permits ramp or platform resting board 220 to be raised or lowered and shown in FIGS. 60C, 60F and 60G.

Figure 60D:
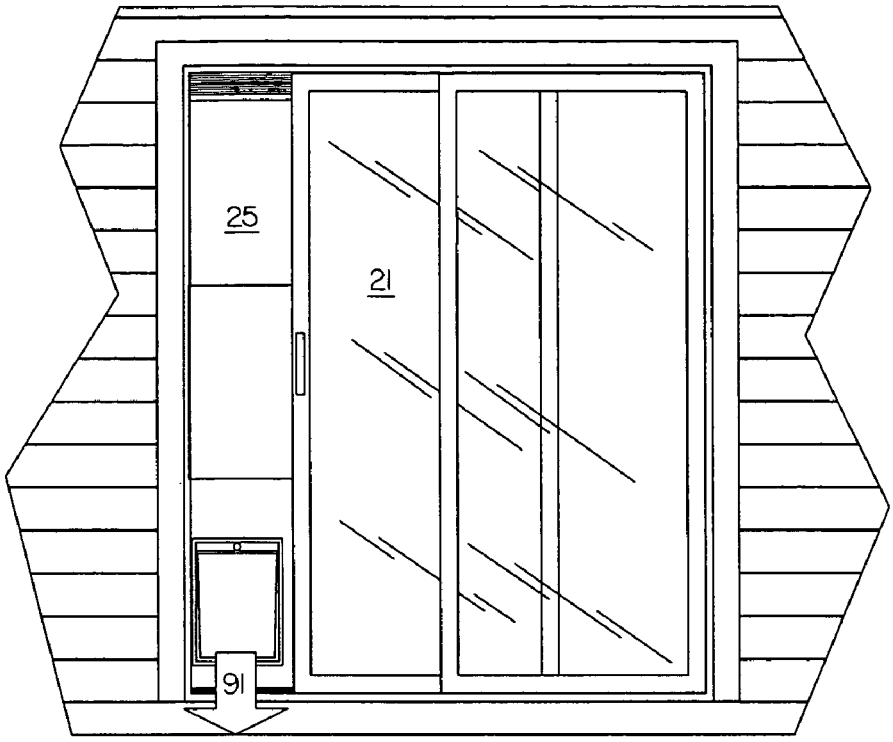
Figure 60E:
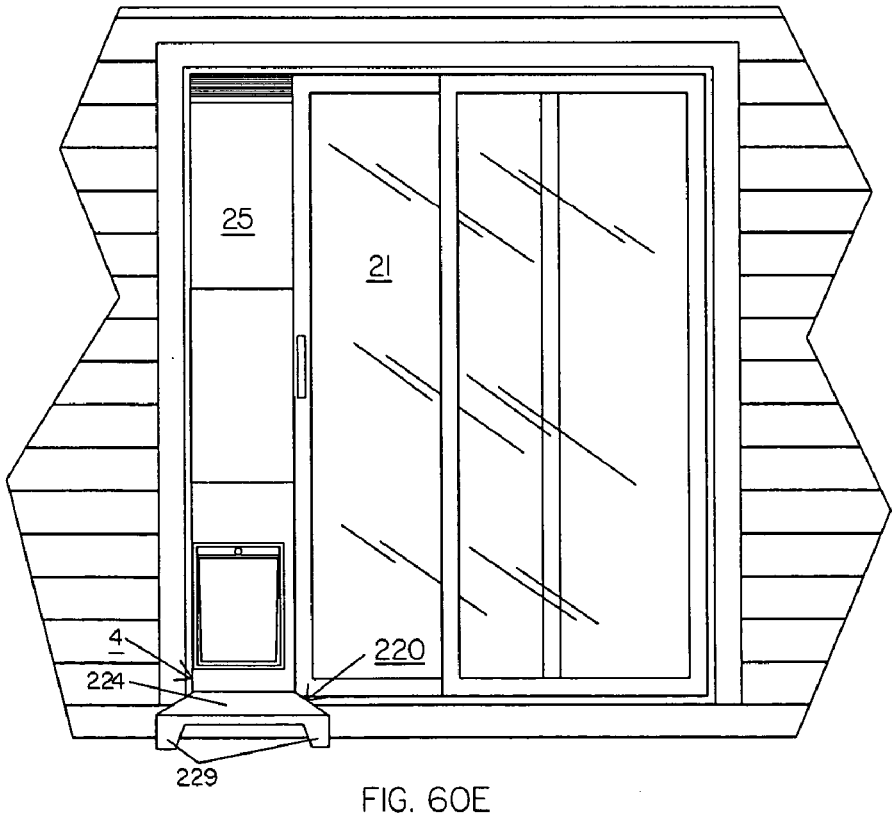
Figure 60F:
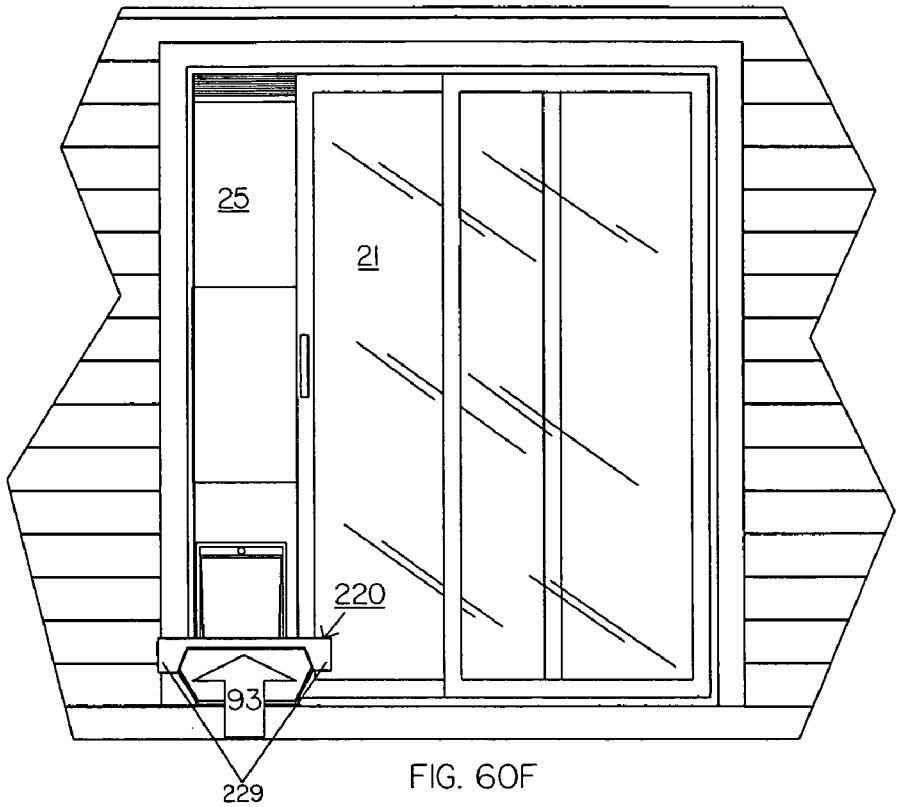
Figure 60G:
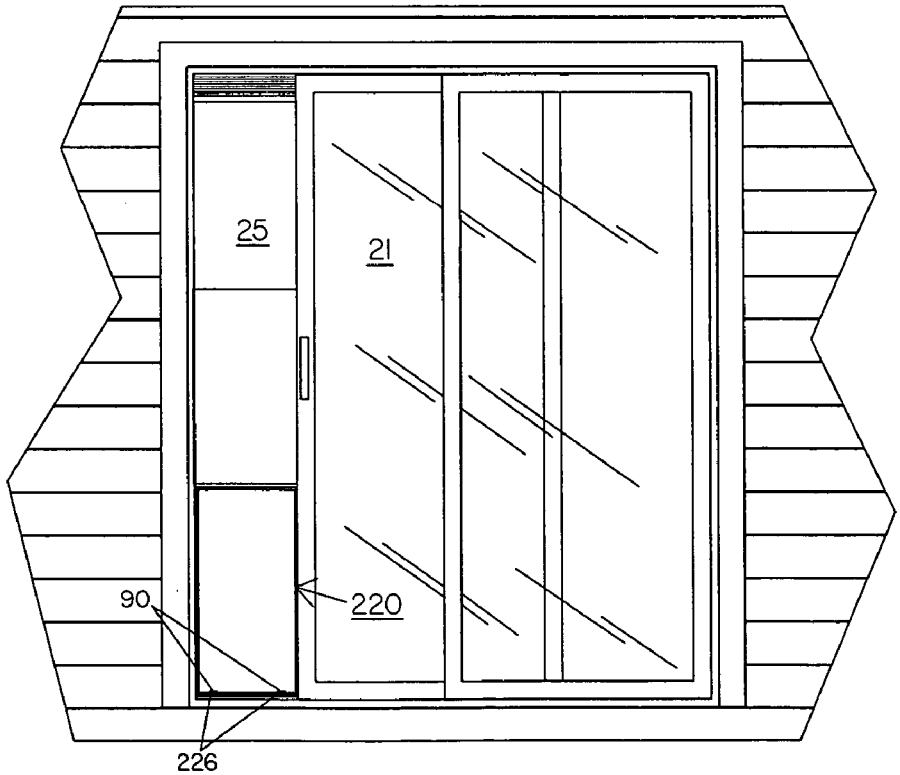

In many sliding patio door installations there may be a step down upon egress through the pet portal in the pet access door panel as shown by arrow 91 in FIG. 60D. Although FIGS. 60D–60G are exterior elevational views of a sliding glass patio door with the pet access door panel installed it should be understood that an elevated threshold in this installation may result in a step up or down upon ingress into the structure interior or egress to the structure exterior and, therefore, ramp or platform resting board 220 may be appropriate for use on the interior side of the pet access door panel and function in the same manner as shown in FIGS. 60A–60G. Mounting brackets 90 located on the both the interior and exterior sides of bottom module weather seal 5 permits the interior or exterior use of ramp or platform resting board 220. FIG. 60E is an exterior side elevational view of a sliding glass patio door with pet access door panel installed, and ramp or platform resting board 220 attached, allowing a pet to enter or exit a structure with a footing surface the same on either side of the pet portal in the pet access door panel even though there may be a step up or down. FIGS. 60F and 60G are exterior elevational views of a sliding glass patio door with pet access door panel installed and ramp or platform resting board 220 attached and being raised to an upright position to allow access to the surface under the ramp or platform resting board.

Although various embodiments of the invention have been shown and described, they are not meant to be limiting. Those of skill in the art may recognize various modifications to these embodiments, which modifications are meant to be covered by the spirit and scope of the appended claims. For example, the pet portal 146 can be installed in the lower portion of any door for ingress or egress of a pet with the door closed. Also, the drop lock 6 can be used with any typical sliding patio door.

What is claim is:

1. A portable pet portal insert for use with a sliding patio door, comprising:

independent top, center, and bottom modules, each having a top, bottom, front, back, leading side and trailing side portions all relative to said front portion;

a first interlocking mechanism affixed to the bottom portion of said top module;

a second interlocking mechanism affixed to the top portion of said center module, for interacting with said first interlocking mechanism to permit said top and center modules to be removably secured together;

a third interlocking mechanism affixed to the bottom portion of said center module;

a fourth interlocking mechanism affixed to the top of said bottom module, for interacting with said third interlocking mechanism to permit said center and bottom modules to be removably secured together;

said bottom module including means for receiving a pet portal; and said top, center, and bottom modules when assembled or secured together forming a self-contained frameless unitary assembly configured to be inserted and retained between a leading edge of said sliding patio door directly abutting against trailing edges of said modules, a vertical edge of a frame retaining the sliding patio door directly abutting against leading edges of said modules, and with a top portion of said top module, and a bottom portion of said bottom module, respectively, being within exposed top and bottom tracks retaining said sliding patio door within said frame.

2. The portable pet portal insert of claim 1, further including:

locking means for securing said pet portal insert and sliding patio door to prevent human intrusion between exterior and interior home areas associated with said sliding patio door, whereby movement of said sliding patio door and said pet portal insert is inhibited.

3. The portable pet portal insert of claim 2, wherein said locking means includes:

drop lock means selectively operable, after said insert is installed captively between said top and said bottom tracks of said frame, and between said leading edge of said sliding patio door and said vertical edge of said frame, for preventing movement of said sliding patio door away from said insert.

4. The portable pet portal insert of claim 3, wherein said drop lock means includes:

an elongated handle bar positioned proximate a trailing edge of said sliding patio door, said elongated handle bar having a free end and another end;

a locking bracket secured to a portion of said trailing edge of said sliding patio door, for adjustably retaining a portion of said elongated handle bar proximate said free end;

elongated telescoping means adapted for securement between a bottommost portion of the trailing edge of said sliding patio door, and an opposing bottommost side edge portion of said frame, said telescoping means having a side portion proximate one end hingedly connected to said another end of said elongated handle bar, said one end being proximate said trailing edge of said sliding patio door, said telescoping means having another end selectively moveable to be proximate said frame; and said locking bracket including means for positioning said elongated handle bar to selectively either force said telescoping means into tight securement between said sliding patio door and frame to lock said sliding patio door in place, or to reposition said elongated handle bar for releasing said telescoping means from its locking position.

5. The portable pet portal insert of claim 4, wherein said drop lock means further includes:

a storage bracket mounted above said locking bracket on the trailing edge of said sliding patio door, whereby with said elongated handle bar positioned for release of said telescoping means, said elongated handle bar can be pulled upward into said storage bracket, for storing said elongated handle bar and telescoping means in a vertical orientation proximate the trailing edge of said sliding patio door.

6. The portable pet portal insert of claim 4, wherein said telescoping means includes:

an elongated outer tubular housing having a side portion proximate one end hingedly attached to said another end of said elongated handle bar, and an open opposite end;

an inner tubular member slideably contained within said tubular housing, with one end of the inner tubular member protruding from said tubular housing; and means for selectively adjusting the length of said inner tubular member protruding from said tubular housing.

7. The portable pet portal insert of claim 6, wherein said telescoping means further includes:

bumper means threadedly secured to the one end of said inner tubular member, for providing a fine adjustment of the overall length of said telescoping means.

8. The portable pet portal insert of claim 3, wherein said locking means further includes:

universal lock means for rigidly connecting a latch extending from the leading edge of said sliding patio door to an opposing door catch in said frame.

9. The portable pet portal insert of claim 8, wherein said universal lock means is mounted in said center module.

10. The portable pet portal insert of claim 9, wherein said universal lock means includes:

a universal catch for directly connecting to said latch of said sliding patio door; and a universal latch for directly connecting to said door catch in said frame.

11. The portable pet portal insert of claim 10, wherein said universal lock means further includes:

means for selectively adjusting the distance between said universal catch and said universal latch, for permitting said universal latch to engage either a flush mounted or externally mounted door catch in said frame.

12. The portable pet portal insert of claim 11, wherein said universal lock means further includes:

means for selectively adjusting the vertical positioning of said universal catch and said universal latch, for correspondence to the height of said latch of said sliding patio door and said door catch in said frame.

13. The portable pet portal insert of claim 10, wherein said universal lock means further includes:

means for selectively adjusting the vertical positioning of said universal catch and universal latch, for correspondence to the height of said latch of said sliding patio door and associated opposing door catch in said frame.

14. The portable pet portal insert of claim 1, further including:

weather seal shim means affixed to the leading and trailing sides of said top, center, and bottom modules, and to the top of said top module and bottom of said bottom module, respectively, for providing a weather seal between the leading edge of said sliding patio door, and said frame, and said top, center and bottom modules when assembled successively together and inserted within said top and bottom tracks affixed to top and bottom portions of said frame between said leading edge of said sliding patio door and a closure vertical edge channel of said frame.

15. The portable pet portal of claim 14, wherein said weather seal shim means includes:

a plurality of first weather seal shims independently affixed to the trailing side portions of said top and bottom modules, respectively;

a plurality of second weather seal shims independently affixed to the leading side portions of said top and bottom modules, respectively;

a third weather seal shim affixed to the trailing side portion of said center module;

a fourth weather seal shim affixed to the leading side portion of said center module;

a fifth weather seal shim affixed to the top portion of said top module; and a sixth weather seal shim affixed to the bottom portion of said bottom module.

16. The portable pet portal insert of claim 15, wherein said fifth weather seal shim includes vertically adjustable resilient means for permitting said insert to fit securely between said tracks of top and bottom of different heights.

17. The portable pet portal insert of claim 16, wherein said fifth weather seal shim vertically adjustable resilient means includes:

an elongated sleeve having a bottom portion secured within an elongated channel in a top portion of said top module; and a spring biased mechanism enclosed by said sleeve for constantly exerting an upward force away from said top module against a top outer portion of said sleeve, for forcing the top portion of said sleeve securely into a channel of said top track of said frame, and providing a weather seal at points of contact therebetween.

18. portable pet portal insert of claim 15, wherein said plurality of first weather seal shims each include:

said top and bottom modules having identical trailing side widths;

an elongated strip of material configured to be captively held between elongated opposing grooves formed within elongated lip members protruding from the trailing side of said top and bottom modules, respectively, said strip having a recessed channel configured for snugly receiving a leading side or edge portion of said sliding patio door.

19. The portable pet portal insert of claim 15, wherein each of said plurality of second weather seal shims each include:

said top and bottom modules having identical leading side widths, and each having elongated grooves on front and back portions proximate respective leading sides; and a U-shaped elongated strip of resilient material having free side edges bent inward toward one another, for permitting said second weather seal shims to be pushed onto the leading sides of said top and bottom modules with the side edges of the former snapped into the grooves of the latter, the outside dimensions of said second weather seal shims being configured for fitting snugly into a portion of a channel of said vertical edge of said frame.

20. The portable pet portal insert of claim 15, wherein said third weather seal shim includes:

an elongated strip of material configured to be captively held between elongated opposing grooves formed within elongated lip members protruding from the trailing side portion of said center module, said strip having a recessed channel configured for snugly receiving a central portion of said sliding patio door.

21. The portable pet portal insert of claim 15, wherein said fourth weather seal shims includes:

said center module having elongated grooves on front and back portions proximate its leading side portion, widths of the center module and the leading side portions of said top and bottom modules being substantially equal; and a U-shaped elongated strip of resilient material having free side edges bent inward toward one another, for permitting the strip to be pushed onto the leading side portion of said center module with said side edges snapped into the grooves outside dimensions of said fourth weather seal shim being configured for fitting snugly into a central portion of a channel within the vertical edge of said frame.

22. The portable pet portal insert of claim 15, wherein said sixth weather seal shim includes:

an elongated sleeve having a bottom portion secured within an elongated channel in a bottom portion of said bottom module; and a sleeve retainer enclosed within said sleeve, and secured to said sleeve and the bottom portion of said bottom module, said sleeve providing a weather seal between said bottom module and a portion of a said bottom track of said frame.

23. The portable pet portal insert of claim 15, further including:

a first ramp having one end adapted for removable securement to lowermost exterior mounting brackets of said sixth weather seal shim, for permitting a pet easy exterior ingress and egress to and from said pet portal.

24. The portable pet portal insert of claim 23, further including:

a second ramp having one end adapted for removable securement to a lowermost interior mounting bracket of said sixth weather seal shim, for permitting a pet easy interior ingress and egress to and from said pet portal.

25. The portable pet portal insert of claim 4, further including:

a ramp having one end adapted for removable securement to lowermost exterior mounting brackets of said fourth weather seal shim, for permitting a pet easy exterior ingress and egress to and from said pet portal.

26. The portable pet portal insert of claim 4, further including:

a ramp having one end adapted for removal securement to lowermost interior mounting bracket of said fourth weather seal shim, for permitting a pet easy interior ingress and egress to and from said pet portal.

27. The portable pet portal insert of claim 1, further including:

weather seal shim means affixed to the trailing side portions of said top, center, and said bottom portion modules, and to the top portion of said top module and bottom of said bottom module, respectively, for providing a weather seal between the leading edge of said sliding patio door, and said frame, and said top, center and bottom modules when assembled successively together and inserted within said top and bottom tracks affixed to top and bottom portions of said frame between a leading edge of said sliding patio door and a closure vertical edge channel of said frame.

28. The portable pet portal insert of claim 27, wherein said weather seal shim means includes:

a plurality of first weather seal shims independently affixed to the trailing side portions of said top and bottom modules, respectively;

a second weather seal shim affixed to the trailing side portion of said center module;

a third weather seal shim affixed to the top of said top portion module; and a fourth weather seal shim affixed to the bottom portion of said bottom module.

29. The portable pet portal insert of claim 28, wherein said third weather seal shim includes vertically adjustable resilient means for permitting said insert to fit securely between said tracks of frames of different heights.

30. The portable pet portal insert of claim 28, wherein said third weather seal shim vertically adjustable resilient means includes:

an elongated sleeve having a bottom portion secured within an elongated channel in a top portion of said top module; and a spring biased mechanism enclosed by said sleeve for constantly exerting an upward force away from said top module against a top outer portion of said sleeve, for forcing the top portion of said sleeve securely into a channel of said top track of said frame, and providing a weather seal at points of contact therebetween.

31. The portable pet portal insert of claim 28, wherein each of said plurality of first weather seal shims each include:

trailing sides of said top and bottom modules having identical widths;

an elongated strip of material configured to be captively held between elongated opposing grooves formed within elongated lip members protruding from the trailing side portion of said top and bottom modules, respectively, said strip having a recessed channel configured for snugly receiving said leading edge of said sliding patio door.

32. The portable pet portal insert of claim 28, wherein said second weather seal shim includes:

an elongated strip of material configured to be captively held between elongated opposing grooves formed within elongated lip members protruding from the trailing side portion of said center module, said strip having a recessed channel configured for snugly receiving a central portion of said sliding patio door.

33. The portable pet portal insert of claim 8, wherein said fourth weather seal shim includes:

an elongated sleeve having a bottom portion secured within an elongated channel in a bottom portion of said bottom module; and a sleeve retainer enclosed within said sleeve, and secured to said sleeve and the bottom portion of said bottom module, said sleeve providing a weather seal between said bottom module and a portion of said bottom track of said frame.

34. The portable pet portal insert of claim 1, wherein said means for receiving said pet portal includes a cutout portion of said bottom module adapted for securely mounting said pet portal therein, said pet portal including:

a portal frame secured to circumferential portions of said cutout in said bottom module; and a flap mounted within an opening in said portal frame, and hingedly mounted at a top section thereof to an upper portion of said portal frame, said flap being dimensioned to permit it to be easily pivotally moved between interior and exterior positions relative to said bottom module, for permitting a pet to pass in either direction through said bottom module.

35. The portable pet portal insert of claim 34, wherein said pet portal further includes:

a flap lock for selectively locking said flap in said portal frame, to prevent any movement of said flap beyond said portal frame.

36. The portable pet portal insert of claim 35, wherein said pet portal further includes:

a floating weather seal, for insuring that said flap always returns to a position wholly in said portal frame subsequent to any pivotal movement of said flap away from said frame.

37. The portable pet portal insert of claim 36, wherein said flap lock includes:

manually operable cam means operable on an interior portion of said portal frame, for selectively either moving a bottommost portion of said flap downward into a lowermost channel in a bottom portion of said portal frame, thereby locking said flap in said portal frame, or for moving said flap upward out of engagement with said channel, thereby permitting pivotal movement thereof.

38. The portable pet portal insert of claim 37, wherein said floating weather seal includes:

a first ferromagnetic material installed in the bottommost portion of said flap; and a second ferromagnetic material installed in a bottom portion of said portal frame for interacting attractively with said first ferromagnetic material to insure said flap comes to rest wholly within said frame after any pivotally movement of said flap.

39. The portable pet portal insert of claim 38, wherein said floating weather seal further includes:

said second ferromagnetic material being resiliently mounted via spring biasing into said lowermost channel in the bottom portion of said frame, whereby when said cam means is operated for lowering the bottom portion of said portal flap, the cam is moved into said channel while pushing said second ferromagnetic material downward against the force of said spring bias.

40. The portable pet portal insert of claim 35, wherein said flap lock includes:

manually operable cam means operable on an interior portion of said portal frame, for selectively either moving a bottommost portion of said flap downward into a lowermost channel in a bottom portion of said portal frame, thereby locking said flap in said portal frame, or for moving said flap upward out of engagement with said channel, thereby permitting pivotal movement thereof.

41. The portable pet portal insert of claim 34, wherein said pet portal further includes:

a floating weather seal, for insuring that said flap always returns to a position wholly in said portal frame subsequent to any pivotal movement of said flap away from said frame.

42. The portable pet portal insert of claim 41, wherein said floating weather seal includes:

a first ferromagnetic material installed in the bottommost portion of said flap; and a second ferromagnetic material installed in a bottom portion of said portal frame for interacting attractively with said first ferromagnetic material to insure said flap comes to rest wholly within said frame after any pivotally movement of said flap, whereby either or both of said first and second ferromagnetic material is or are magnetized.

43. A drop lock for a sliding patio door, said sliding patio door including a door frame having upper and lower tracks for receiving a sliding patio door, the frame also being adapted for retaining a fixed window component, the sliding patio door including vertical leading and trailing sides, the leading side closing upon a first vertical side portion of the frame, the trailing side opposing a second vertical side portion of the frame, said drop lock comprising:

an elongated handle bar positioned proximate the trailing side of said sliding patio door, said handle having a free end and another end;

a locking bracket secured to a portion of said trailing side of said sliding patio door, for adjustably retaining a portion of said elongated handle bar proximate its free end;

elongated telescoping means adapted for securement between a bottommost portion of the trailing side of said sliding patio door, and an opposing bottommost second vertical side portion of said frame, said elongated telescoping means having a side portion proximate one end hingedly connected to said another end of said elongated handle bar, said one end being proximate said trailing side of said sliding patio door, said elongated telescoping means having said another end selectively moveable to be proximate the second vertical said portion of said frame; and said locking bracket including means for positioning said handle to selectively either force said elongated telescoping means into tight securement between said sliding patio door and said frame to lock said sliding patio door in place when said leading side of said patio door abuts against said first vertical side portion of said frame, or to reposition said elongated handle bar releasing said elongated telescoping means from its locking position.

44. The drop lock of claim 43, further including:

a storage bracket mounted above said locking bracket on the trailing side of said sliding patio door, whereby with said elongated handle bar positioned for release of said elongated telescoping means, said elongated handle bar can be pulled upward into said storage bracket, for storing said elongated handle bar and elongated telescoping means in a vertical orientation proximate the trailing side of said sliding patio door.

45. The drop lock of claim 43, wherein said elongated telescoping means includes:

an elongated outer tubular housing having a side portion proximate one end hingedly attached to said another end of said elongated handle bar, and an open opposite end;

an inner tubular member slideable contained within said elongated outer tubular housing, with one end of the inner tubular member protruding from said elongated outer tubular housing; and means for selectively adjusting the length of said inner tubular member protruding from said elongated outer tubular housing.

46. The drop lock of claim 45, wherein said elongated telescoping means further includes:

bumper means threadedly secured to the one end of said inner tubular member, for providing a fine adjustment of the overall length of said elongated telescoping means.

47. A pet portal for installation in either a cutout portion in a lower section of a door, or in a cutout portion in a lower section of an insert for a sliding patio door, said pet portal comprising:

a frame adapted for securement to circumferential portions of either one of said cutouts in said door or said insert;

a flap mounted within an opening in said frame, and hingedly mounted at a top section thereof to an upper portion of said frame, said flap being dimensioned to permit pivotal movement between interior and exterior positions relative to said frame, for permitting a pet to pass in either direction through the pet portal; and a flap lock for selectively locking said flap in said frame, to prevent any movement of said flap beyond said frame, said flap lock including:

manually operable cam means operable on an interior portion of said frame, for selectively moving a bottommost portion of said flap downward into a lowermost channel in a bottom portion of said frame, by locking said flap in said frame, or allowing movement of said flap upward out of engagement with said channel, thereby permitting pivotal movement thereof.

48. The pet portal of claim 47, further including:

a floating weather seal, for insuring that said flap always returns to a position wholly in said frame subsequent to any pivotal movement of said flap away from said frame.

49. The pet portal of claim 48, wherein said floating weather seal includes:

a first ferromagnetic material installed in the bottommost portion of said flap; and a second ferromagnetic material installed in a bottom portion of said portal frame for interacting attractively with said first ferromagnetic material to insure said flap comes to rest wholly within said portal frame after any pivotally movement of said flap.

50. The pet portal of claim 49, wherein said floating weather seal further includes:

said second ferromagnetic material being resiliently mounted via spring biasing into said lowermost channel in the bottom portion of said portal frame, whereby when said cam means is operated for lowering the bottom portion of said flap, the flap is moved into said channel while pushing said second ferromagnetic material downward against the force of said spring bias.

* * * * *